US009278522B2

(12) United States Patent
Alleyne et al.

(10) Patent No.: US 9,278,522 B2
(45) Date of Patent: Mar. 8, 2016

(54) HIGH RESOLUTION SENSING AND CONTROL OF ELECTROHYDRODYNAMIC JET PRINTING

(71) Applicant: THE BOARD OF TRUSTEES OF THE UNIVERSITY OF ILLINOIS, Urbana, IL (US)

(72) Inventors: Andrew Alleyne, Urbana, IL (US); Kira Barton, Urbana, IL (US); Sandipan Mishra, Troy, NY (US); Placid Ferreira, Champaign, IL (US); John Rogers, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 14/033,765

(22) Filed: Sep. 23, 2013

(65) Prior Publication Data

US 2014/0092158 A1 Apr. 3, 2014

Related U.S. Application Data

(63) Continuation of application No. 12/916,934, filed on Nov. 1, 2010, now Pat. No. 8,562,095.

(51) Int. Cl.

| | |
|---|---|
| ***B41J 29/38*** | (2006.01) |
| ***B41J 2/045*** | (2006.01) |
| ***B41J 2/06*** | (2006.01) |
| ***B41J 2/125*** | (2006.01) |

(52) U.S. Cl.

CPC ..... *B41J 2/04576* (2013.01); *B41J 2/06* (2013.01); *B41J 2/125* (2013.01)

(58) Field of Classification Search

None

See application file for complete search history.

(56) References Cited

U.S. PATENT DOCUMENTS

| | | | |
|---|---|---|---|
| 3,949,410 | A | 4/1976 | Bassous et al. |
| 4,658,269 | A | 4/1987 | Rezanka |
| 5,790,151 | A | 8/1998 | Mills |
| 5,838,349 | A | 11/1998 | Choi et al. |
| 6,276,775 | B1 | 8/2001 | Schulte |
| 6,451,191 | B1 | 9/2002 | Bentsen et al. |

(Continued)

FOREIGN PATENT DOCUMENTS

| | | |
|---|---|---|
| EP | 1 477 230 | 11/2004 |
| WO | WO 2009/011709 | 1/2009 |

OTHER PUBLICATIONS

Afzali et al. (Web Release Jul. 9, 2002) "High-Performance, Solution-Processes Organic Thin Film Transistors from a Novel Pentacene Precursor," *J. Am. Chem. Soc.* 124(30):8812-8813.

(Continued)

*Primary Examiner* — Geoffrey Mruk
*Assistant Examiner* — Bradley Thies
(74) *Attorney, Agent, or Firm* — Lathrop & Gage LLP

(57) ABSTRACT

Provided are various methods and devices for electrohydrodynamic (E-jet) printing. The methods relate to sensing of an output current during printing to provide control of a process parameter during printing. The sensing and control provides E-jet printing having improved print resolution and precision compared to conventional open-loop methods. Also provided are various pulsing schemes to provide high frequency E-jet printing, thereby reducing build times by two to three orders of magnitude. A desktop sized E-jet printer having a sensor for real-time sensing of an electrical parameter and feedback control of the printing is provided.

22 Claims, 39 Drawing Sheets

(56) References Cited

U.S. PATENT DOCUMENTS

| | | | | |
|---|---|---|---|---|
| 6,742,884 | B2 | 6/2004 | Wong et al. | |
| 7,158,277 | B2 | 1/2007 | Berggren et al. | |
| 7,641,325 | B2 | 1/2010 | Steiner et al. | |
| 8,562,095 | B2 | 10/2013 | Alleyne et al. | |
| 2006/0102525 | A1 | 5/2006 | Volkel et al. | |
| 2007/0017505 | A1 | 1/2007 | Lipp et al. | |
| 2007/0064066 | A1* | 3/2007 | Piatt et al. | 347/74 |
| 2007/0064068 | A1 | 3/2007 | Piatt et al. | |
| 2011/0170225 | A1 | 7/2011 | Rogers et al. | |
| 2011/0187798 | A1 | 8/2011 | Rogers et al. | |

OTHER PUBLICATIONS

Ahn et al. (2007) "Iterative Learning Control: Brief Survey and Categorization, Systems, Man, and Cybernetics, Part C: Applications and Reviews," *IEEE Transactions* 37(6):1099-1121.

Anagnostopoulos et al. (2003) "Micro-Jet Nozzle Array for Precise Droplet Metering and Steering Having Increased Droplet Deflection," 12th Int. Conf. on Solid State Sensors, Actuators and Microsystems (Boston, MA) 1:368-371.

Arias et al. (2004) "All Jet-Printed Polymer Thin-Film Transistor Active-Matrix Backplanes," *Appl. Phys. Let*. 85(15):3304-3306.

Arimoto et al. (1984) "Bettering Operation of Robots by Learning," *J. Robotic Syst*. 1(2):123-140.

Babel et al. (Web Release Apr. 27, 2005) "Electrospun Nanofibers of Blends of Conjugated Polymers: Morphology, Optical Properties, and Field-Effect Transistors," *Macromolecules* 38(11):4705-4711.

Barry et al. (Web Release Aug. 27, 2005) "Charging Process and Coulomb-Force-Directed Printing of Nanoparticles with Sub-100-nm Lateral Resolution," *Nano Lett*. 5(10):2078-2084.

Barton et al. (Aug. 2010) "A Desktop Electrohydrodynamic Jet Printing System," *Mechatronics* 20(5):611-616.

Barton K., (Mar. 2010) "Electrohydrodynamic Jet Printing System," Lemelson-Illinois Student Prize Finalist.

Barton et al. (Mar. 2010) "E-Jet Printing," Power Point Presentation, Industry Advisory Board Meeting for Nano-Learning Center.

Bassous et al. (1977) "Ink Jet Printing Nozzle Arrays Etched in Silicon," *Appl. Phys. Lett*. 31(2):135-137.

Bean, K.E. (1978) "Ansiotropic Etching of Silicon," *IEEE Trans. Electron Dev*. 25(10)1185-1193.

Bharathan et al. (1998) "Polymer Electroluminescent Devices Processed by Inkjet Printing: I. Polymer Light-Emitting Logo," *Appl. Phys. Lett*. 72(21):2660-2662.

Bietsch et al. (2004) "Rapid Functionalization of Cantilever Array Sensors by Inkjet Printing," *Nanotechnology* 15:873-880.

Blazdell et al. (1999) "Preparation of Ceramic Inks for Solid Freeforming Using a Continuous Jet Printer," *J. Mater. Syn. Process*. 7(6):349-356.

Blazdell et al. (1995) "The Computer Aided Manufacture of Ceramics Using Multilayer Jet Printing," *J. Mater. Sci. Lett*. 14(22):1562-1565.

Boning et al. (Oct. 1996) "Run by Run Control of Chemical-Mechanical Polishing," *IEEE Trans. Comp. Packag. Manufact. Technol. C* 19(4):307-314.

Bristow et al. (2006) "A High Precision Motion Control System with Application to Microscale Robotic Deposition," *IEEE Trans. Control Systems Technol*. 26(3):96-114.

Bristow et al. (2006) "A Survey of Iterative Learning Control," *Control Systems Magazine, IEEE* 26(3):96-114.

Burns et al. (2003) "Inkjet Printing of Polymer Thin-film Transistor Circuits," *MRS Bulletin*, 28:829-834.

Calvert (2001) "Inkjet Printing for Materials and Devices," *Chem. Mater*. 13(10):3299-3305.

Chabinyc et al. (2005) "Printing Methods and Materials for Large-Area Electronic Devices," *Proceedings of the IEEE* 93(8):1491-1499.

Chang P. C. et al. (2004) "Film morphology and Thin Film Transistor Performance of Solution-Processed Oligothiophenes," *Chem. Mater*. 16:4783-4789.

Chang et al. (2006) "Inkjetted Crystalline Single Monolayer Oligothiphene OTFTs," *IEEE Trans. Electron. DEv*.53(4):594-600.

Chang, S. C. et al. (1999) "Multicolor Organic Light-Emitting Diodes Processed by Hybrid Inkjet Printing," *Adv. Mater*. 11:734-737.

Chang et al. (1998) "Dual-Color Polymer Light-Emitting Pixels Processed by Hybrid Inkjet Printing," *Appl. Phys. Lett*. 73(18):2561-2563.

Chen et al. (2006) "Scaling Law for Pulsed Electrohydrodynamic Drop Formation," *Appl. Phys. Lett*. 89:124103.

Chen et al. (2005) "The Role of Metal-Nanotube Contact in the Performance of Carbon Nanotube Field Effect Transistors," *Nano Lett*. 5:1497-1502.

Chen et al. (1997) "An Iterative Learning Control in Rapid Thermal Processing," In: Proc. THE IASTED Int. Conf. on Modeling, Simulation and Optimization (MSO'97), Singapore pp. 189-192.

Chen et al. (Web Release Apr. 13, 2006) "Electrohydrodynamic 'Drop-and-Place' Particle Deployment," *Appl. Phys. Lett*. 88:154104.

Cheng K. et al. (2005) "Inkjet Printing, Self-Assembled Polyelectrolytes, and Electroless Plating: Low Cost Fabrication of Circuits on a Flexible Substrate at Room Temperature," *Macromol. Rapid Commun*. 26:247-264.

Cheung et al. (2002) 2nd Ann. Int. Conf. on Microtechnologies in Medicine and Biology (Madison, WA, USA) pp. 71-75.

Choi et al. (2008) "Scaling Laws for Jet Pulsations Associated with High-Resolution Electrohydrodynamic Printing," *Appl. Phys. Lett*. 92(12):123109.

Cloupeau et al. (Sep. 1994) "Electrohydrodynamic Spraying Functioning Modes: A Critical Review," *J. Aerosol Sci*. 25(6):1021-1036.

Collins et al. (Web Release Dec. 2007) "Electrohydrodynamic Tip Streaming and Emission of Charged Drops from Liquid Cones," *Nat. Phys*. 4:149-154.

Creagh et al. (2003) "Design and Performance of Inkjet Printheads for Non Graphic Arts Applications," *MRS Bulletin* 28:807-811.

Dearden et al. (2005) "A Low Curing Temperature Curing Temperature Silver Ink for Use in Inkjet Printing and Subsequent Production of Conductive Tracks," *Macromol. Rapid Commun*. 26:315-318.

Deepkishore Mukhopadhyay et al. (Apr. 4, 2007) "Exploiting Differential Etch Rates to Fabricate Large-Scale Nozzle Arrays with Protudent Geometry," *J. Micromech. Microeng*. 17(5):923-930.

Del Castillo et al. (1997) "Run-to-run Process Control: Literature Review and Extensions," *J. Quality Technol*. 29(2):184-196.

Del Castillo et al. (1998) "An Adaptive Run-to-Run Optimizing Controller for Linear and Nonlinear Semiconductor Process," *IEEE Trans Semiconductor Manufacturing* 11(2):285-295.

Duke et al. (Mar. 10, 2002) "The Surface Science of Xerography," *Surf. Sci*. 500:1005-1023.

Farooqui et al. (1992) "Microfabrication of Submicron Nozzles in Silicon Nitride," *J. Microelectromech. Syst*. 1(2):86-88.

Forrest S. R. (2004) "The Path to Ubiquitous and Low-Cost Organic Electronic Applications on Plastics," *Nature*, 428:911-918.

Gans et al. (2004) "Inkjet Printing of Polymers: State of the Art and Future Development," *Adv. Mater*. 16:203-213.

Genda et al. (2004) "Micro-Patterned Electret for High Power Electrostatic Motor," 17$^{th}$ IEEE International Conference on Micro Electro Mechanical Systems, pp. 470-473.

Gomez et al. (1994) "Charge and Fission of Droplets in Electrostatic Sprays," *Phys. Fluids* 6(1):404-414.

Graham-Rowe, D. (Sep. 13, 2007) "Nanoscale Inkjet Printing," *Technology Review* published by MIT, http://technologyreview.com/computing/19373/page1/.

Han et al. (May 2002) "Tool Path-Based Deposition Planning in Fused Deposition Process," *J. Manuf. Sci. Eng*. 124(2):462-472.

Hayati et al. (Jan. 2, 1986) "Mechanism of Stable Jet Formation in Electrohydrodynamic Atomization," *Nature* 319:41-42.

Hayati et al. (1987) "Investigations Into Mechanisms of Electrohydrodynamic Spraying of Liquids," *J. Colloid Interf. Sci*. 117:205-221.

Hayes et al. (1998) "Micro-Jet Printing of Polymers and Solder for Electronics Manufacturing," *J. Electron. Manufac*. 8:209-216.

Hebner et al. (1998) "Local Tuning of Organic Light-Emitting Diode Color by Dye Droplet Application," *Appl. Phys. Lett*. 73:1775-1777.

(56) References Cited

OTHER PUBLICATIONS

Heller M. J. (2002) "DNA Microarray Technology: Devices, Systems, and Applications," *Ann. Rev. Biomed. Eng.* 4:129-153.
Hiller et al. (2002) "Reversibly Erasable Nanoporous Anti-Reflection Coatings from Polyelectrolyte Multilayers," *Nature Mater.* 1:59-63.
Huang et al. (Web Release Dec. 11, 2006) "Organic Field-Effect Inversion-Mode Transistors and Single-Component Complementary Inverters on Charges Electrets," *J. Appl. Phys.* 100:114512.
Huang et al. (Jan. 2007) "Organic Field-Effect Transistors and Unipolar Logic Gates on Charged Electrets from Spin-On Organosilsesquioxane," *Adv. Funct. Mater.* 17(1):142-153.
International Search Report and Written Opinion, Corresponding to International Application No. PCT/US07/77217, Mailed Jun. 3, 2008.
Jacobs et al. (2001) "Submicrometer Patterning of Charge in Thin-Film Electrets," *Science* 291:1763-1766.
Jacobs et al. (Web Release Nov. 4, 2002) "Approaching Nanozerography: The Use of Electrostatic Forces to Position Nanoparticles with 100nm Scale Resolution," *Adv. Mater.* 149(21):1553-1557.
Jaworek et al. (Oct. 1996) "Forms of the Multijet Mode of Electrohydrodynamic Spraying," *J. Aerosol Sci.* 27(7):979-986.
Jayasinghe et al. (2004) "Electric-Field Driven Jetting from Dielectric Liquids," *Appl. Phys. Lett.* 85:4243-4245.
Jayasinghe et al. (2006) "Electrohydrodynamic Jet Processing: An Advanced Electric Field-Driven Jetting Phenomenon for Processing Living Cells," *Small* 2:216-219.
Jayasinghe (2006) "Stable Electric-Field Driven Cone-Jetting of Concentrated Biosuspensions," *Lab Chip.* 6:1086-1090.
Jung et al. (2000) Fabrication of a Nanosize Metal Aperture for a Near Field Scanning Optical Microspray Sensor Using Photoresist Removal and Sputtering Techniques, *J. Vac. Sci. Technol. A* 18:1333-1337.
Juraschek et al. (Aug. 3, 1998) "Pulsation Phenomena During Electrospray Ionization," *Int. J. Mass Spectrom.* 177(1):1-15.
Kang et al. (Apr. 2007) "High Performance Electronics Using Dense, Perfectly Aligned Arrays of Single Walled Carbon Nanotubes," *Nature Nanotech.* 2:230-236.
Kawamoto et al. (2005) "Fundamental Investigation on Electrostatic Ink Jet Phenomena in Pin-to-Plate Discharge System," *J. Imaging Sci. Technol.* 49:19-27.
Khatavkar et al. (2005) "Diffuse Interface Modeling of Droplet Impact on a Pre-Patterned Solid Surface," *Macromol. Rapid Commun.* 26(4):298-303.
Kim et al. (Sep. 2008) "Electrohydrodynamic Drop-On-Demand Patterning in Pulsed Cone-Jet Mode at Various Frequencies," J. *Aerosol Sci.* 39(9):819-825.
Kim W. et al. (2005) "Electrical Contacts to Carbon Nanotubes Down to 1nm in Diameter," *Appl. Phys. Lett.* 87:173101.
Kim et al. (2009) "On Demand Electrohydrodynamic Jetting with Meniscus Control by a Piezoelectric Actuator for Ultra-Fine Patterns," *J. Micromech. Microeng.* 19:107001.
Kobayashi et al. (Jun. 1, 2000) "A Novel RGB Multicolor Light-Emitting Polymer Display," *Synthetic Metals* 111:125-128.
Kocabas et al. (2006) "Spatially Selective Guided Growth of High-Coverage Arrays and Random Networks of Single-Walled Carbon Nanotubes and their Integration into Electronic Devices," *JACS* 128:4540-4541.
Korkut et al. (Jan. 25, 2008) "Enhanced Stability of Electrohydrodynamic Jets Through Gas Ionization," *Phys. Rev. Lett.* 100(3):034503.
Kuoni et al. (2003) "A Modular High Density Multichannel Dispenser for Microarray Printing," 12th Int. Conf. on Solid State Sensors, Actuators and Microsystems (Boston, MA) 1:372-375.
Le, H. P. (1998) "Progress and Trends in Ink-Jet Printing Technology," *J. Imag. Sci. Technol.* 42:49-62.
Lee et al. (2007) "Electrohydrodynamic Printing of Silver Nanoparticles by Using Focused Nanocolloid Jet," *Appl. Phys. Lett.* 90:0819051-0819053.
Lee et al. (2008) Structuring of Conductive Silver Line by Electrohydrodynamic Jet Printing and Its Electrical Characterization, *J. Phys.* 142(1):012039.
Lee et al. (2005) "A Printable Form of Single-Crystalline Gallium Nitride for Flexible Optoelectronic Systems," *Small* 1:1164-1168.
Lemmo et al. (1998) "Inkjet Dispensing Technology: Application in Drug Discovery," *Curr. Opin. Biotechol.* 9:615-617.
Lenggoro et al. (Nov. 1, 2006) "Nanoparticle Assembly on Patterned 'Plus/Minus' Surfaces from Electrospray of Colloidal Dispersion," *J. Colloid Interface Sci.* 303(1):124-130.
Lewis et al. (2004) "Direct Writing in Three Dimensions," *Mater. Today* 7:32-39.
Li et al. (May 2006) "Aspirin Particle Formation by Electric-Field-Assisted Release of Droplets," *Chem. Eng. Sci.* 61:3091-3097.
Li et al. (Web Release Aug. 2, 2004) "Electrospinning of Nanofibers: Reinventing the Wheel," *Adv. Mater.* 16(14):1151-1170.
Ling et al. (2004) "Thin Film Deposition, Patterning, and Printing in Organic Thin Film Transistors," *Chem. Mater.* 16:4824-4840.
Liu et al. (Dec. 2005) "Low-Voltage All-Polymer Field Effect Transistor Fabricated Using an Inkjet Printing Technique," *Macromol. Rapid Commun.* 26(24):1955-1959.
MacDonald N C (Sep. 1996) "SCREAM MicroElectroMechanical Systems," *Microelectron. Eng.* 32:49-73.
Marginean et al. (Web Release Mar. 3, 2006) "Charge Reduction in Electrosprays: Slender Nanojets as Intermediates," *J. Phys. Chem.* B 110(12):6397-6404.
Marginean et al. (Aug. 9, 2006) "Order-Chaos-Order Transitions in Electrosprays: The Electrified Dripping Faucet," *Phys. Rev. Lett.* 97(6):064502.
Marginean et al. (2004) "Flexing the Electrified Meniscus: The Birth of a Jet in Electrosprays," *Anal. Chem.* 76:4202-4207.
McCarty et al. (Mar. 7, 2008) "Electrostatic Charging Due to Separation of Ions at Interfaces: Contact Electrification of Ionic Electrets," *Angew Chem. Int. Ed.*47(12):2188-2207.
Menard et al. (2004) "A Printable Form of Silicon for High Performance Thin Film Transistors on Plastic Substrates," *Appl. Phys. Lett.* 84(26):5398-5400.
Menard et al. (Apr. 2007) "Micro and Nanopatterning Techniques for Organic Electronic and Optoelectronic Systems," *Chem. Rev.* 107(4):1117-1160.
Mesquida et al. (Web Release Sep. 5, 2001) "Attaching Silica Nanoparticles from Suspension onto Surface Charge Patters Generated by a Conductive Atomic Force Microscope Tip," *Adv. Mater.* 13(18):1395-1398.
Mishra et al. (Aug. 2010) "High Speed Drop-on-Demand Printing with a Pulsed Electrohydrodynamic Jet." *J. Micromech. Microeng.* 20:095026:1-8.
Mishra et al. (2007) "Precision Positioning of Wafer Scanners: An Application of Segmented Iterative Learning Control," *Control Systems Magazine* 27(4):20-25.
Mishra et al. (2010) "Control of High-Resolution Electrohydrodynamic Jet Printing," American Control Conference, Baltimore, MD, Jun. 30, 2010-Jul. 2, 2010, pp. 6537-6542.
Mishra et al. (Apr. 2010) "A Desktop Electrohydrodynamic Jet Printing System with Integrated High-Resolution Sensing and Control," Presented at the 2010 ASPE Control Precision Systems Conference, Apr. 11-13, 2010, Cambridge MA.
Molesa et al.(2004) Technical Digest—International Electron Devices Meeting p. 1072-1074.
Moon et al. (Apr. 2002) "Ink-Jet Printing of Binders for Ceramic Components," *J. Am. Ceramic Soc.* 85(4):755-762.
Moore et al. (1988) "Learning Control for Robotics," In: Proceedings of 1988 International Conference on Communications and Control, Baton Rouge, Louisiana pp. 240-251.
Morris et al. (Sep. 18, 2000) "Microfabrication of a Metal Fuel Injector Nozzle Array," *Proc. SPIE* 4174:58-65.
Mukhopadhyay et al. (Apr. 4, 2007) "Exploiting Differential Etch Rates to Fabricate Large-Scale Nozzle Arrays with Protudent Geometry," *J. Micromech. Microeng.* 17:923-930.
Murata et al. (2005)." Super-fine ink-jet printing: toward the minimal manufacturing system" *Microsystem Technologies* 12:2-7.

(56) References Cited

OTHER PUBLICATIONS

Nallani et al. (2005) "Wafer Level Optoelectronic Device Packaging Using MEMS," *Proceedings of SPIE : Smart Sensors, Actuators, and MEMS II*, 5836, 116-127 (2005.
Nguyen et al. (Web Release May 1, 2009) "Mechanism of Electrohydrodynamic Printing Based on AC Voltage without a Nozzle Electrode," *Appl. Phys. Lett*. 94(17):173509.
Office Action corresponding to U.S. Appl. No. 12/947,120, dated May 8, 2012.
Okamoto et al. (2000) "Microarray Fabrication with Covalent Attachment of DNA Using Bubble Jet Technology," *Nat. Biotechnol*. 18:438-441.
Okazaki et al. (2004) "Microfactory—Concept, History, and Developments," *J. Manuf. Sci. Eng*. 126:837-844.
Olthuis et al. (1992) "On the Charge Storage and Decay Mechanism in Silicon Dioxide Electrets," *IEEE Trans Electr. Insul*. 27(4):691-697.
Pai et al. (1993) "Physics of Electrophotography," *Rev. Mod. Phys*. 65(1):163-211.
Parashkov et al. (2005) "Large Area Electronics Using Printing Method," *Proc. IEEE* 93:1321-1329.
Park et al. (2008) "Nanoscale Patterns of Oligonucleotides Formed by Electrohydrodynamic Jet Printing with Applications in Biosensing and Nanomaterials Assembly," *Nano Lett* 8(12):4210-4216.
Park et al. (2006) "In Situ Deposition and Patterning of Single Walled Carbon Nanotubes by Laminar Flow and Controlled Flocculation in Microfluidic Channels," *Angew. Chem. Int. Ed*. 45:581-585.
Park et al. (Web Release Jan. 12, 2010) "Nanoscale, Electrified Liquid Jets for High-Resolution Printing of Charge," *Nano Letters* 10:584-591.
Park et al. (Web Release Aug. 5, 2007) "High-Resolution Electrohydrodynamic Jet Printing," *Nature Materials* 6:782-789.
Park et al. (2007) "High Resolution Electrohydrodynamic Jet Printing for Printed Electronics," *Nano-CEMMS Industry Advisory Meeting*, University of Illinois at Urbana Champaign.
Paul et al. (2003) "Additive Jet Printing of Polymer Thin-Film Transistors," *Appl. Phys. Lett*. 83(10):2070-2072.
Payne et al. ( Web Release Apr. 10, 2004) "Robust, Soluble Pentacene Ethers," *Organic Letters* 6(10):1609-1612.
Pingree et al. (Web Release Dec. 4, 2009) "Electrical Scanning Probe Microscopy o Active Organic Electronic Devices," *Adv. Mater*. 21(1):19-28.
Preisler et al. (Web Release May 26, 2005) "Ultrathin Epitaxial Germanium on Crystalline Oxide Metal-Oxide-Semiconductor-Field-Effect Transistors," *Appl. Phys. Lett*. 86(22):223504.
Qin et al. (2003) "Adaptive Run-to-Run Control and Monitoring for a Rapid Thermal Processor," *J. Vacuum Sci. Technol. B Microelectronics Nanometer Struct*. 21(1):301-310.
Rayleigh L. (1879) "On the Capillary Phenomena of Jets," *Proc. R. Soc. Lond*. 29:71- 97.
Redinger et al. (2004) "An Ink-Jet-Deposited Passive Component Process for RFID," *IEEE Trans. Electron Dev*. 51(12):1978-1973.
Ressier et al. (2008) "Electrostatic Nanopatterning of PMMA by AFM Charge Writing for Directed Nano-Assembly," *Nanotechnology* 19:135301.
Salata O. V. (2005) "Tools of Nanotechnology: Electrospray," *Curr. Nanosci*. 1:25-33.
Samarasinghe et al. (2006) "Printing Gold Nanoparticles with an Electrohydrodynamic Direct-Write Device," *Gold Bulletin* 39:48-53.
Sanaur et al. (2006) "Jet-Printed Electrodes and Semiconducting Oligomers for Elaboration of Organic Thin-Film Transistors," *Organic Electronics* 7:423-427.
Savill, D. (Jan. 1997) "Electrohydrodynamics: The Taylor-Melcher Leaky Dielectric Model," *Ann. Rev. Fluid Mech*. 29:27-64.
Scharnberg et al. (Web Release Jan. 2, 2007) "Tuning the Threshold Voltage of Organic Field-Effect Transistors by an Electret Encapsulating Layer," *Appl. Phys. Lett*. 90:013501.
Schonenberger et al. (Feb. 15, 1992) "Charge Flow During Metal Insulator Contact," *Phys. Rev. B* 45(7):3861-3864.
Seemann et al. (Web Release Sep. 11, 2007) "Local Surface Changes Direct the Deposition of Carbon Nanotubes and Fullerenes into Nanoscale Patterns," *Nano Lett*. 7(10):3007-3012.
Sekitani et al. (Apr. 1, 2008) "Organic Transistors Manufactured Using Inkjet Technology with Subfemtoliter Accuracy," *Proc. Nat. Acad. Sci. USA* 105(13):4976-4980.
Sele et al. (2005) "Lithography-Free, Self-Aligned Inkjet Printing with Sub-Hundred Nanometer Resolution," *Adv. Mater*. 17:997-1001.
Shimoda et al. (2003) "Inkjet Printing of Light-Emitting Polymer Displays," *MRS Bulletin* 28:821-827.
Shimoda et al. (2006) "Solution-Processed Silicon Films and Transistors," *Nature* 440:783-786.
Shtein et al. (2004) "Direct Mask-Free Patterning of Molecular Organic Semiconductors Using Organic Vapor Jet Printing," *J. Appl. Phys*. 96(8):4500-5407.
Sigmund P. (1987) "Mechanisms and Theory of Physical Sputtering by Particle Impact," *Nuc. Instrum. Methods Phys. Res*. 27:1-20.
Sirringhaus et al. (2000) "High-Resolution Inkjet Printing of All-Polymer Transistor Circuits," *Science* 290:2123-2126.
Smith et al. (2005) "Observation of Strong Direct-Like Oscillator Strength in the Photoluminescence of Si Nanoparticles," *Phys. Rev. B* 72:205307.
Smith et al. (Web Release Jul. 11, 2002) "Spreading Diagrams for the Optimization of Quill Pin Printed Microarray Density," *Langmuir* 18(16):6289-6293.
Smith et al. (1993) "Continuous Ink-Jet Print Head Utilizing Silicon Micromachined Nozzles," *Sensors Actuators A* 43:311-316.
Son et al. (2005) "Formation of Pb/63Sn Solder Bumps Using a Solder Droplet Jetting Method," *IEEE Trans. Electron. Packag. Manufact*. 28(3):274-281.
Stachewicz et al. (Web Release Jan. 21, 2009) "Relaxation Times in Single Event Electrospraying Controlled by Nozzle Front Surface Modification," *Langmuir* 25(4):2540-2549.
Stachewicz et al. (Web Release Dec. 3, 2009) "Stability Regime of Pulse Frequency for Single Event Electrospraying," *Appl. Phys. Lett*. 95(22):224105.
Sturm et al. (Jul. 1998) "Patterning Approaches and System Power Efficiency Considerations for Organic Led Displays," SPIE Conference on Organic Light-Emitting Materials and Devices II, San Diego, California *Proceedings of SPIE Volume*: 3476, p. 208-216.
Stutzmann et al. (2003) "Self-Aligned, Vertical Channel, Polymer Field Effect Transistors," *Science* 299:1881-1885.
Subramanian et al. (Dec. 2005) "Printed Organic Transistors for Ultra-Low-Cost RFID Applications," *IEEE Trans. Components Packag. Technol*. 28(4):742-747.
Sullivan et al. (2007) "Development of a Direct Three-Dimensional Biomicrofabrication Concept Based on Electrospraying a Custom Made Siloxane Sol," *Biomicrofluidics* 1:0341031-03410310.
Sun et al. (Web Release May 29, 2002) "Large-Scale Synthesis of Uniform Nanowires Through a Soft, Self-Seeding, Polyol Process," *Adv. Mater*. 14( 11):833-837.
Sun et al. (Web Release Mar. 3, 2004) "Mechanistic Study on the Replacement Reaction Between Silver Nanostructures and Chloroauric Acid in Aqueous Medium," *J. Am. Chem. Soc*. 126(12):3892-3901.
Sun et al. (Dec. 5, 2006) "Controlled Buckling of Semiconductor Nanoribbons for Stretchable Electronics," *Nat. Nanotechnol*. 1:201-207.
Suryavanshi et al. (Web Release Feb. 21, 2006) "Probe-Based Electrochemical Fabrication of Freestanding Cu Nanowire Array," *Appl. Phys. Lett*. 88:083103.
Szczech et al. (2002) "Fine-Line Conductor Manufacturing Using Drop-On-Demand pzt Printing Technology," *IEEE Trans. Electron. Packaging Manufacturing* 25(1):26-33.
Tang et al. (Web Release Mar. 7, 2001) "Generation of Multiple Electrosprays Using Microfabricated Emitter Arrays for Improved Mass Spectrometric Sensitivity," *Anal. Chem*. 73(8):1658-1663.
Taylor G. (1969) "Electrically Driven jets," *Proc. Roy. Soc. Lond: Ser. A, Math Phys. Sci*. 313(1515):453-475.
Tseng et al. (2002) "A High-Resolution High-Frequency Monolithic Top-Shooting Microinjector Free of Satellite Drops—Part II: Fabri-

(56) References Cited

OTHER PUBLICATIONS cation, Implementation, and Characterization," *J. Microelectromechanical Syst*. 11(5):437-447.
Tseng et al. (2002) "A High-Resolution High-Frequency Monolithic Top-Shooting Microinjector Free of Satellite Drops—Part I: Concept, Design, and Model," *J. Microelectromechanical Syst*. 11(5):427-436.
Tzeng et al. (Web Release Apr. 24, 2006) "Templated Self-Assembly of Colloidal Nanoparticles Controlled by Electrostatic Nanopatterning on a $Si_3N_4/SiO_2/Si$ Electret," *Adv. Mater*. 18(9):1147-1151.
Uchiyama (1978) "Formulation of High-Speed Motion Pattern of a Mechanical Arm by Trial," *Trans. SICE* (*Soc. Instrum. Contr. Eng.*) 14 (6) (1978) 706-712 (in Japanese, English Abstract).
Volkman et al. (2003) Materials Research Society Symposium Proceedings; Warrendale, PA, p. 391.
Wang et al. (2006) "Solid Freeform Fabrication of Thin-Walled Ceramic Structures Using an Electrohydrodynamic Jet," *J Am Ceram Soc* 89(5):1727-1729.
Wang et al. (2006) "Low-Cost Fabrication of Submicron All Polymer Field Effect Transistors," *Appl. Phys. Lett*. 88:133502/1-133502/3.
Wang et al. (Web Release Apr. 25, 2005) "Polymeric Nanonozzle Array Fabricated by Sacrificial Template Imprinting," *Adv. Mater*. 17(9):1182-1186.
Wang et al. (Feb. 8,2004) "Dewetting of Conducting Polymer Inkjet Droplets on Patterned Surfaces," *Nature Materials* 3:171-176.
Wang et al. (2009) "Fully Voltage-Controlled Electrohydrodynamic Jet Printing of Conductive Silver Tracks with a Sub 100 μm Linewidth," *J. Appl. Phys*. 106:0249071-0249074.
Wang et al. (2005) "High Resolution Print-Patterning of a Nano-Suspension," *J. Nanoparticle Res*. 7:301-306.
Wickware et al. (2001) "Mass Spectroscopy: Mix and Match," *Nature* 413:869.
Williams et al. (1996) "Etch Rates for Micromachining Processing," *J. Microelectromech. Syst*. 5(4):256-269.
Williams et al. (2003) "Etch Rates for Micromachining Processing—Part II," *J. Microelectromech. Syst*. 12(6):761-778.
Wong et al. (2003) "Hydrogenated Amorphous Silicon Thin-Film Transistor Arrays Fabricated by Digital Lithography," *IEEE Electron Dev. Lett*. 24:577-579.
Wong et al. (2002) "Amorphous Silicon Thin-Film Transistors and Arrays Fabricated by Jet Printing," *Appl. Phys. Lett*.80(4):610-612.
Youn et al. (2009) "Electrohydrodynamic Micropatterning of Silver Ink Using Near Field Electrohydrodynamic Jet Printing with Tilted-Outlet Nozzle," *Appl. Phys. A* 96:933-938.
Yuan et al. (Apr. 2003) "MEMS-Based Piezoelectric Array," *Micoelectron. Eng*. 66:767-772.

* cited by examiner

FIG. 30B
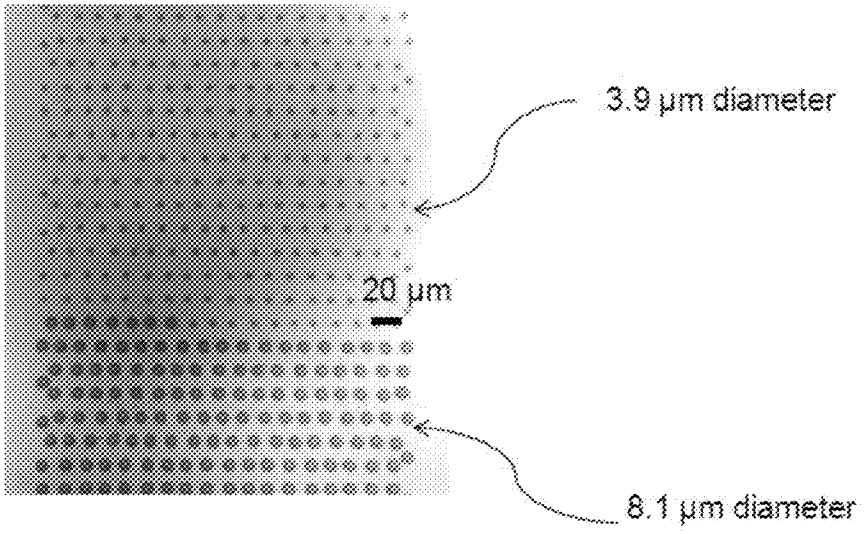
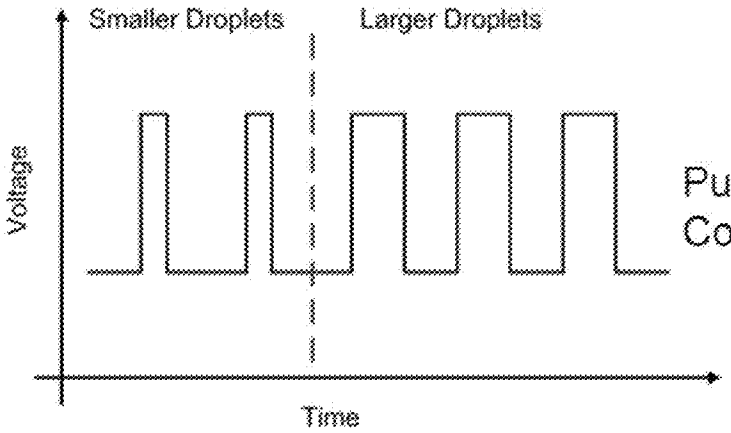
FIG. 30C
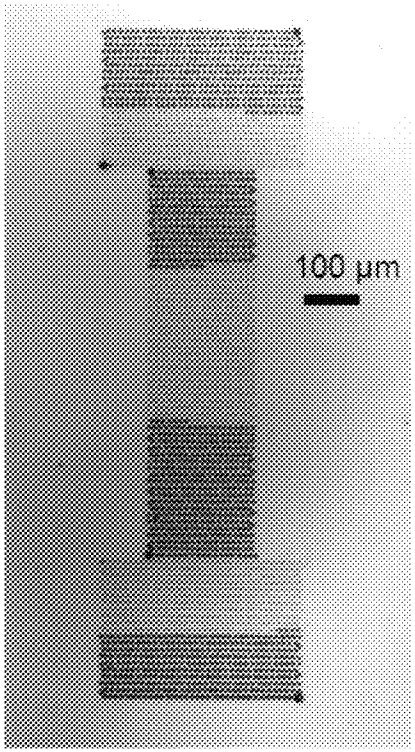
FIG. 30A

HIGH RESOLUTION SENSING AND CONTROL OF ELECTROHYDRODYNAMIC JET PRINTING

CROSS-REFERENCE TO RELATED APPLICATIONS

This application is a continuation of U.S. patent application Ser. No. 12/916,934, filed Nov. 1, 2010, which is hereby incorporated by reference to the extent it is not inconsistent with the present disclosure.

STATEMENT REGARDING FEDERALLY SPONSORED RESEARCH OR DEVELOPMENT

This invention was made with government support under DMI-0328162 awarded by the National Science Foundation. The government has certain rights in the invention.

BACKGROUND OF THE INVENTION

Provided herein are methods and devices for electrohydrodynamic jet (E-jet) printing, including e-jet systems and devices of PCT Pub. No. 2009/011709 (71-07WO). In particular, the performance and throughput of E-jet systems are improved through active control of one or more parameters that affect E-jet printing by various approaches for sensing current output during printing. Utilizing the sensing and control processes provided herein provides improved e-jet printing characterized by high resolution, precision and speed, specifically improved printing registration, consistent and robust printing results (both spacing and size), droplet size control, drop-on-demand printing and single droplet deposition on the order of $1\times10^{-6}$ pL. The improved printing capabilities of the present invention are applicable to a number of industries including inkjet and printed electronics, security, biotechnology (DNA and protein arrays, biosensors) and photonic industries.

Conventional sensing and monitoring techniques, such as image processing, generally require off-line data analysis and are not conducive for real-time feedback control. Accordingly, the systems and processes provided herein address the problem of providing rapid and real-time control of E-jet printing, thereby achieving significantly improved printing results as characterized by one or more of print resolution, print precision and print speed

SUMMARY OF THE INVENTION

Provided herein are processes and systems of E-jet printing that provide significantly improved printing capability by employing sensing and control of process and electrical parameters. In an aspect, current-based detection is used to monitor the e-jet printing performance and optimize printing by controlling a process parameter such as the input voltage or current, to provide high resolution and precision printing, including for fast printing speeds.

Voltage or current input control, including inputs based on real-time sensing of e-jet printing condition, provides faster and more reliable printing, which in turn is amenable to process automation and incorporation into viable manufacturing applications based on higher throughput and enhanced print consistency, control and reliability. The e-jet printing with sensing and control systems disclosed herein are capable of printing frequencies on the order of kHz (such as 1 kHz and higher) and droplet volumes of about $1\times10^{-6}$ pL or even smaller. In contrast, comparable e-jet printing systems typically have a printing frequency range of about 1-3 Hz. Traditional ink jet printing can access high print frequency (e.g., about 50-200 kHz), but are limited to much larger printed droplet volumes (e.g., about 20 pL).

Also provided are high-speed or frequency printing methods based on pulsed input signals. For example, using modulated voltage inputs results in jetting frequencies significantly higher than those achieved by fixed-voltage printing systems. In addition, printed droplet size and print frequency can each be independently changed by varying pulse characteristics, even in the middle of printing run. Similarly, current input modulation can be used to obtain these faster jetting frequencies.

Control systems provided herein may be characterized generally as feedback and feedforward control. Aspects of feedforward control may employ process maps to intelligently guide the selection of one or more process parameters and/or electrical parameters to achieve or maintain a desired printing condition. The use of process maps and current detection feedback to select and control a process parameter or printing condition such as back pressure, voltage input, current input, and offset height, for a particular jetting mode is a significant and fundamental improvement for E-jet printing.

Provided herein are various sensing and control systems and methods for use with electrohydrodynamic jet (e-jet) printing. In one aspect, the e-jet printing relates to a system or method as disclosed in PCT Pub. No. WO2009/011709 (71-07WO), which is specifically incorporated by reference herein for the various disclosed e-jet systems and methods.

In one embodiment, the method is for high resolution, speed and precision electrohydrodynamic jet printing of a printable fluid, by providing a nozzle containing a printable fluid and a substrate having a substrate surface. The substrate surface is placed in fluid communication with the nozzle. An electric potential difference is provided or established between the nozzle and the substrate surface to establish an electrostatic force to said printable fluid in the nozzle, thereby controllably ejecting the printable fluid from the nozzle onto the substrate. The potential is provided by any means known in the art, including such as by a current generator and/or a voltage generator electrically connected to the nozzle tip and/or the substrate, so long as a resultant electrostatic force is capable of controllably ejecting the printable fluid. A process parameter is monitored during printing. In an aspect, the process parameter is the current output during printing, wherein current spikes are associated with droplet ejection and printing. A process parameter is controlled, based on the monitored current output, to provide high resolution, high speed and high precision electrohydrodynamic jet printing. For example, if the current output spike frequency deviates from a desired frequency, a process parameter is correspondingly varied to bring the current output spike frequency back to the desired frequency.

"Resolution" refers to the ability to consistently print a certain size from an individual droplet, or to consistently provide desired spacing between printed features. In an aspect, "high resolution" refers to a print size or spacing from a range that is selected from a range between 10 nm and 1000 nm, between 10 nm and 500 nm, or between 10 nm and 100 nm.

"Speed" refers to the speed at which fluid is printed, including for example the relative speed between the nozzle and substrate, while maintaining high resolution and high precision. In an aspect, "high speed" refers to a printing speed selected from a range that is selected from between 300 μm/s and 10 mm/s, or between 1 mm/s and 10 mm/s. Speed also may refer to the frequency of printed droplet deposition, and can readily range from greater than 10 Hz, through to the kHz range, such as up to 100 kHz.

"Precision" refers to droplet placement accuracy, including the ability to print an individual droplet to a specific location on the substrate. In an aspect, "high precision" refers to a placement accuracy selected from a range that is between 10 nm and 1000 nm, between 10 nm and 500 nm, or between 10 nm and 100 nm.

In an embodiment, the controlled process parameter is an electrical parameter such as the electric potential difference or an electric current. For example, electric potential can be controlled directly by varying the potential to one or both of the nozzle and substrate. Alternatively, electric potential can be controlled indirectly by varying the electric current in the circuit, such as an electric current to the nozzle and fluid contained therein. Because the electric potential is proportional to current, varying one of electric potential or current results in a corresponding variation of the other parameter. In an aspect, the controlled process parameter is an electrical potential input to the E-jet system, such as the nozzle tip and/or substrate. In an aspect, the electrical potential input is pulsed.

In an embodiment, the process parameter is any one or more parameter that affects a printing condition. In an aspect, the process parameter is electric potential difference between the nozzle and the substrate, stand-off height between the nozzle and the substrate, fluid pressure of the printable fluid in the nozzle or substrate composition. Varying any of these process parameters can affect printing condition. There are, of course, other relevant process parameters, such as room conditions including temperature and humidity that can also affect printing condition.

In an aspect, the printing condition is print frequency, droplet size, or both print frequency and droplet size. In an aspect, printing condition is droplet volume or the size of printed droplet on the substrate surface. In an aspect, the printing condition relates to a statistical characterization of a desired print frequency, droplet volume, droplet placement, or characteristic size of a printed feature on the substrate.

In an embodiment, the controlling step is selected from the group consisting of: modulating the electric potential difference to provide real-time feedback control of print frequency or droplet size; modulating the fluid pressure to provide real-time feedback control of print frequency or droplet size; and providing a two-dimensional pattern of substrate composition topography to provide real-time feedback control of print frequency or droplet size as a function of relative position of the nozzle and substrate. Such modulation can provide "on the fly" change to print droplet size or print frequency along the substrate surface as the nozzle moves relative to the substrate.

In one embodiment, the process parameter is stand-off height and the printing condition is print frequency or droplet size, and the controlling step comprises modulating the electric potential difference to provide real-time feedback control of print frequency or droplet size.

In another embodiment the process parameter is fluid pressure within the nozzle and the printing condition is print frequency or droplet size, and the controlling step comprises modulating the fluid pressure to provide real-time feedback control of print frequency or droplet size.

In another embodiment, the process parameter is substrate composition and the printing condition is print frequency or droplet size, and the controlling step comprises varying the substrate composition topography to provide real-time feedback control of print frequency or droplet size. In an aspect, substrate composition topography is varied to achieve varying hydrophobicity, charge distribution, droplet placement, and feature geometry. In an aspect, the substrate geometry is varied, such as by providing relief or recess features. In an aspect, the substrate composition topography is varied, such as by providing locations with varying substrate materials or surface coatings. Any substrate variations that impact stand-off height or charge distribution can impact the electric field around the nozzle tip, thereby impacting a printing condition.

In an aspect, the controlling step relates to modulating voltage or current during printing, thereby controllably changing print droplet size as a function of position on the substrate surface during printing. In an aspect, the modulating comprises pulsing the voltage or current during printing.

In an embodiment, the controlling step comprises modulating during printing one or more of voltage, current, stand-off height, and printable fluid pressure. Such modulating is used to controllably change print droplet size or print frequency as a function of the relative position of the nozzle and substrate surface during printing.

In an aspect, the monitored process parameter is current during printing, and any of the methods provided herein further comprise recording the current during printing and identifying off-line a current spike with an individual printed droplet. With this information, a process map is generated by identifying a printing condition from the current spike (and other known process parameters used when the printing was performed). With such a process map, a user may identify appropriate process parameters to achieve a desired printing condition for a subsequent print. Those appropriate process parameters are input during printing to achieve a desired printing condition. Accordingly, the controlling step in this aspect further comprises inputting the identified process parameter during printing to provide printing control.

Information from a process may be used in the controlling step to provide guidance as to appropriate process parameter to achieve the desired printing condition, thereby providing printing control. In this aspect, desired printing characteristics are better maintained and/or more rapidly achieved. For example, a process map for a specific printing fluid, stand-off height and substrate composition can be used to provide a process parameter(s) matched to the desired printing condition. A process map can also be used to guide the printing in a real-time aspect, such as when good operation is achieved, but a sudden drift necessitates a corresponding sudden change in a process parameter, a process map can provide information and guidance as to an appropriate process parameter to maintain the desired printing condition.

In an aspect, any of the methods relate to a printing condition selected from the group consisting of jetting frequency, droplet residual charge and droplet size.

In an embodiment, the identifying off-line step is repeated for a plurality of individual printed droplets. Using a plurality or a sequence of droplets provides for better and more accurate printing control, as the printing condition is an average of a number of separate printed droplets.

In an embodiment, any of the methods further comprise providing a process map to provide run-to-run control of the printing, wherein the process map is generated by detecting current spikes during printing to determine jetting frequency for one or more process parameters.

In an aspect, the run-to-run control compensates for substrate surface tilt, thereby providing controlled printing over a range of stand-off distances. This aspect is particularly useful for situations where substrates cannot be uniformly and consistently positioned with respect to parallel, and can be particularly important in fine-printing situations where small changes in stand-off distance result in unwanted printing condition deviation (e.g., frequency, size, and/or position).

In an embodiment, any of the methods relate to a controlling step that is by feedforward control from a process map specific for the printable fluid, thereby compensating for repetitive or run-to-run variations in a process parameter. In this embodiment, a process condition is a measurable or known property of relevance to printing, including but not limited to, temperature, humidity, stand-off height, substrate tilt, substrate characteristics such as composition, charge, coating, roughness, surface geometry or any other known spatially-varying parameter over the substrate surface. In this manner, the process map can be obtained for a specific printable fluid for different process parameters, to provide information about appropriate process parameters to achieve the desired printing condition. If temperature or humidity were to change or drift, a process parameter (e.g., voltage) may be accordingly changed based on the corresponding process map, thereby maintaining desired printing parameter or characteristic.

Alternatively (or in addition to), the controlling step is by feedback control of a measured voltage or measured current, wherein the voltage or the current is measured in real-time during printing to compensate for real-time variation in a process condition. In this aspect, the process condition relates to variations that are not necessarily predicted or readily detected, such as variations attributed to manufacturing tolerances: including nozzle coating, circularity and diameter as well as substrate composition and fluid composition. The process conditions also include unpredictable occurrences such as nozzle restrictions, electrical contact or potential variations, and unforeseen variations in stand-off height or back pressure.

In an embodiment, any of the methods provided herein relate to a process parameter that is voltage or current, and the method further comprises monitoring the voltage or current output during printing and modulating the voltage or current input to the E-jet system to obtain a user-selected print resolution, optimized printing speed, or both print resolution and printing speed. In this embodiment, the current and/or voltage are directly manipulated to achieve desired printing condition of speed and/or resolution.

Any of the methods relate to a modulating step that comprises pulse modulated voltage or current control, such as selecting a pulse shape, pulse duration and/or pulse spacing, for the modulated voltage or current.

In an embodiment, any of the methods relate to a controlling step that is by both feedback and feedforward control, to provide a two degree of freedom control to maintain a printing condition, wherein the printing condition is selected from the group consisting of: jetting frequency; print resolution; droplet size; placement accuracy; and droplet spacing.

In an aspect, any of the methods relate to printing that is one or more of: droplet on demand printing; a printing frequency range up to 100 kHz; a printed droplet volume having a range that is between $1\times10^{-3}$ pL and $1\times10^{-6}$ pL; a placement accuracy having a standard deviation less than or equal to 100 nm, including less than or equal to 50 nm, or less than or equal to tens of nm; high print fidelity for up to 100% variation in stand-off height; and plurality of printable fluids contained in a plurality of nozzles.

In an embodiment, the methods provided herein are further characterized in terms of a regulating step comprising applying a pulsed voltage or current, to eject a plurality of droplets, each droplet having a volume that is less than or equal to $1\times10^{-3}$ pL ($1\times10^{-15}$ L), wherein the plurality of droplets coalesce to form a single droplet on the substrate.

In an aspect, the pulsed voltage or current is a shaped waveform.

In an embodiment, any of the methods relates to overwriting of a previously printed feature. In this aspect, the printing resolution, precision and fidelity can be particularly important as the overwriting can relate to small printed features, including on the order of 10 nm to 100 nm.

In an embodiment, the methods provided herein can be used in a number of different applications, including a manufacturing process selected from the group consisting of: electronic device fabrication; chemical sensor fabrication; biosensor fabrication; optical device fabrication; tissue scaffold fabrication; biomaterials fabrication; and secure document fabrication.

In another embodiment, provided herein are devices, such as an E-jet printing device, or component thereof, capable of carrying out any of the methods described herein. In an embodiment, the E-jet printing device component comprising one or more printing nozzles, a current or voltage sensor for detecting real-time sensing for real-time feedback and feedforward control, and a voltage or current generator operably connected to the one or more printing nozzles. The device provides a print resolution that is selected from a range between 10 nm to 10 μm for a printing frequency that ranges that is greater than 0 Hz and less than or equal 100 kHz and a placement accuracy that is selected from a range that is better than 500 nm, such as ranging from 10 nm to less than or equal to 500 nm. In an aspect, the device is a desktop printing device having a footprint less than or equal to 1 $m^2$, such as on the order of about 2 feet by 2 feet. Footprint refers to the total surface area occupied by the device.

In an aspect, the device is further characterized in that the print resolution and placement accuracy are maintained without varying a stand-off distance between the nozzle and a substrate to which the nozzle prints. This is particularly advantageous in that the device is simpler and more cost-effective than other E-jet printing systems requiring z-control in order to reliably provide desired print condition. The present device, in contrast, can readily maintain and achieve the print condition without actively changing a set-off or stand-off distance by varying one or more process parameters during printing. Accordingly, the device exemplified herein costs less than ⅕ the price of a typical E-jet system. Any of the systems provided herein may employ a multiple syringe fixture for holding multiple different printable fluids, thereby providing printing of multiple printable fluids with a single part.

In another embodiment, the invention is a method of high-speed electrohydrodynamic jet printing by providing a nozzle containing a printable fluid and a substrate having a substrate surface. The substrate surface is placed in fluid communication with the nozzle and a pulsed electric potential difference is applied between the nozzle and the substrate surface to establish an electrostatic force to the printable fluid in the nozzle, thereby controllably ejecting the printing fluid from the nozzle onto the substrate. The pulsed electric potential has a maximum voltage $V_h$ and a minimum baseline voltage $V_l$, when not pulsed, wherein $V_l$ is sufficiently large to maintain a Taylor Cone at the tip of the nozzle without ejecting the printable fluid.

In this manner, during printing ejected droplet size can be selected by adjusting pulse width and ejected droplet print frequency selected by adjusting pulse spacing.

In an aspect, the method optionally comprises adjusting one or more pulse parameters during printing to control a printed droplet diameter on the substrate surface during printing.

In an embodiment, such pulsing decreases print time by at least a factor of 30, or at least a factor of 100, or at least a factor of 1000, without substantially degrading print resolution or print precision, compared to a method that does not pulse. For example, the improved printing speed achieved herein can reduce a 69 hour build-time down to about 4, while maintaining and even improving deposition consistency by a factor of about three. Any of the pulsing methods described herein can also be used with any of the sensing and control methods, thereby providing additional print control and stability, even at extremely high print frequencies in the kHz range or higher.

Traditional ink jet printing methods are inherently limited with respect to applications requiring high resolution. For example, additional processing steps are required to obtain high-resolution printing (e.g., less than 20 μm resolution). In particular, the substrate to be printed may be subjected to pre-processing, such as by photolithography-based pre-patterning to assist placement, guiding and confining of ink or printable fluid placement. Embodiments of the E-jet systems and methods disclosed herein provide for direct high-resolution printing (e.g., better than 20 μm), without a need for such substrate surface processing. Provided herein are various sensing and control protocols and devices for E-jet printing, including for the E-jet printing described in WO 2009/011709, which is specifically incorporated by reference for the E-jet methods, systems, and components thereof, to the extent not inconsistent with this disclosure.

Methods and systems disclosed herein are further capable of providing resolution in the sub-micron range by electrohydrodynamic inkjet (e-jet) printing. The methods and systems are compatible with a wide range of printing fluids including functional inks, fluid suspensions containing a functional material, and a wide range of organic and inorganic materials, with printing in any desired geometry or pattern. Furthermore, manufacture of printed electrodes for functional transistors and circuits demonstrate the methods and systems are particularly useful in manufacture of electronics, electronic devices and electronic device components. The methods and devices are optionally used in the manufacture of other device and device components, including biological or chemical sensors or assay devices.

The devices and methods disclosed herein recognize that by maintaining a smaller nozzle size, the electric field can be better confined to printing placement and access smaller droplet sizes; furthermore, the sensing and control aspects disclosed herein provide even better printing characteristics. Accordingly, in an aspect of the invention, the ejection orifices from which printing fluid is ejected are of a smaller dimension than the dimensions in conventional inkjet printing. In an aspect the orifice may be substantially circular, and have a diameter that is less than 30 μm, less than 20 μm, less than 10 μm, less than 5 μm, or less than less than 1 μm. Any of these ranges are optionally constrained by a lower limit that is functionally achievable, such as a minimum dimension that does not result in excessive clogging, for example, a lower limit that is greater than 100 nm, 300 nm, or 500 nm. Other orifice cross-section shapes may be used as disclosed herein, with characteristic dimensions equivalent to the diameter ranges described. Not only do these small nozzle diameters provide the capability of accessing ejected and printed smaller droplet diameters, but they also provide for electric field confinement that provides improved placement accuracy compared to conventional inkjet printing. The combination of a small orifice dimension and related highly-confined electric field provides high-resolution printing, with even better printing characteristics when various sensing and control systems described herein are also employed.

In an embodiment, the electrohydrodynamic printing system has a nozzle with an ejection orifice for dispensing a printing fluid onto a substrate having a surface facing the nozzle. A voltage source is electrically connected to the nozzle so that an electric charge may be controllably applied to the nozzle to cause the printing fluid to be correspondingly controllably deposited on the substrate surface. Because an important feature in this system is the small dimension of the ejection orifice, the orifice is optionally further described in terms of an ejection area corresponding to the cross-sectional area of the nozzle outlet. In an embodiment, the ejection area is selected from a range that is less than 700 $\mu m^2$, or between 0.07 $\mu m^2$-0.12 $\mu m^2$ and 700 $\mu m^2$. Accordingly, if the ejection orifice is circular, this corresponds to a diameter range that is between about 0.4 μm and 30 μm. If the orifice is substantially square, each side of the square is between about 0.35 μm and 26.5 μm. In an aspect, the system provides the capability of printing features, such as single ion and/or quantum dot (e.g., having a size as small as about 5 nm).

In an embodiment, any of the systems are further described in terms of a printing resolution. The printing resolution is high-resolution, e.g., a resolution that is not possible with conventional inkjet printing known in the art without substantial pre-processing steps. In an embodiment, the resolution is better than 20 μm, better than 10 μm, better than 5 μm, better than 1 μm, between about 5 nm and 10 μm, between 100 nm and 10 μm or between 300 nm and 5 μm. In an embodiment, the orifice area and/or stand-off distance are selected to provide nanometer resolution, including resolution as fine as 5 nm for printing single ion or quantum dots having a printed size of about 5 nm, such as an orifice size that is smaller than 0.15 $\mu m^2$. In an embodiment, the system compensates for changes in stand-off distance, such as occurs for substrate irregularities, substrate tilt, and general noise or other unwanted movement of the nozzle tip relative to the substrate, such that good printing characteristics are continuously achieved.

The smaller nozzle ejection orifice diameters facilitate the systems and methods of the present invention to have smaller stand-off distances (e.g., the distance between the nozzle and the substrate surface) which lead to higher accuracy of droplet placement for nozzle-based solution printing systems such as inkjet printing and e-jet printing. However, an ink meniscus at a nozzle tip that directly bridges onto a substrate or a drop volume that is simultaneously too close to both the nozzle and substrate can provide a short-circuit path of the applied electric charge between the nozzle and substrate. These liquid bridge phenomena can occur when the stand-off-distance becomes smaller than two times of the orifice diameter. Accordingly, in an aspect the stand-off distance is selected from the range larger than two times the average orifice diameter. In another aspect, the stand-off distance has a maximum separation distance of 100 μm The nozzle is made of any material that is compatible with the systems and methods provided herein. For example, the nozzle is preferably a substantially non-conducting material so that the electric field is confined in the orifice region. In addition, the material should be capable of being formed into a nozzle geometry having a small dimension ejection orifice. In an embodiment, the nozzle is tapered toward the ejection orifice. One example of a compatible nozzle material is microcapillary glass. Another example is a nozzle-shaped passage within a solid substrate, whose surface is coated with a membrane, such as silicon nitride or silicon dioxide.

Irrespective of the nozzle material, a means for establishing an electric charge to the printing fluid within the nozzle, such as fluid at the nozzle orifice or a drop extending there-from, is required. In an embodiment, a voltage source is in electrical contact with a conducting material that at least partially coats the nozzle. The conducting material may be a conducting metal, e.g., gold, that has been sputter-coated around the ejection orifice. Alternatively, the conductor may be a non-conducting material doped with a conductor, such as an electroconductive polymer (e.g., metal-doped polymer), or a conductive plastic. In another aspect, electric charge to the printing fluid is provided by an electrode having an end that is in electrical communication with the printing fluid in the nozzle.

In another embodiment, the substrate having a surface to-be-printed rests on a support. Additional electrodes may be electrically connected to the support to provide further localized control of the electric field generated by supplying a charge to the nozzle, such as for example a plurality of independently addressable electrodes in electrical communication with the substrate surface. The support may be electrically conductive, and the voltage source provided in electrical contact with the support, so that a uniform and highly-confined electric field is established between the nozzle and the substrate surface. In an aspect, the electric potential provided to the support is less than the electric potential of the printing fluid. In an aspect, the support is electrically grounded.

The voltage source provides a means for controlling the electric field, and therefore, control of printing parameters such as droplet size and rate of printing fluid application. In an embodiment, the electric field is established intermittently by intermittently supplying an electric charge to the nozzle. In an aspect of this embodiment, the intermittent electric field has a frequency that is selected from a range that is between 4 kHz and 60 kHz. Furthermore, the system optionally provides spatial oscillation of the electric field. In this manner, the amount of printing fluid can be varied depending on the surface position of the nozzle. The electric field (and frequency thereof) may be configured to generate any number or printing modes, such as stable jet or pulsating mode printing. For example, the electric field may have a field strength selected from a range that is between 8 V/μm and 10 V/μm, wherein the ejection orifice and the substrate surface are separated by a separation distance selected from a range that is between about 10 μm and 100 μm.

Conventional e-jet printers deposit printed ink having a charge on a substrate. This charge can be problematic in a number of applications due to the charge having an unwanted influence on the physical properties (e.g., electrical, mechanical) of the structures or devices that are printed or later made on the substrate. In addition, the printed inks can affect the deposition of subsequently printed droplets due to electrostatic repulsion or attraction. This can be particularly problematic in high-resolution printing applications. To minimize charged droplet deposition, the potential or biasing of the system is optionally rapidly reversed such as, for example, changing the voltage applied to the nozzle from positive to negative during printing so that the net charge of printed material is zero or substantially less than the charge of a printed droplet printed without this reversal. Alternatively, any the systems, devices and processes provided herein may be used to controllably pattern charge over a substrate surface, as provided in U.S. Pat. App. No. 61/293,258 (filed Jan. 8, 2010), which is hereby incorporated by reference.

Any of the devices and methods described herein optionally provides a printing speed. In an embodiment, the nozzle is stationary and the substrate moves. In an embodiment, the substrate is stationary and the nozzle moves. Alternatively, both the substrate and nozzle are capable of independent movement including, but not limited to, the substrate moving in one direction and the nozzle moving in a second direction that is orthogonal to the substrate. In an embodiment the support is operationally connected to a movable stage, so that movement of the stage provides a corresponding movement to the support and substrate. In an aspect, the stage is capable of translating, such as at a printing velocity selected from a range that is between 10 μm/s and 1000 μm/s.

In an embodiment, the substrate comprises a plurality of layers. For example, a layer of $SiO_2$ and a layer of Si. In an embodiment, the surface to be printed comprises a functional device layer. In this embodiment, a resist layer may be patterned by the e-jet printing system on the device layer or a metal layer that coats the device layer, thereby protecting the underlying patterned layer from subsequent etching steps. Subsequent etching or processing provides a pattern of functional features (e.g., interconnects, electrodes, contact pads, etc.) on a device layer substrate. Alternatively, in an embodiment, Si wafers without an $SiO_2$ layer, or a variety of metals are the substrates, where these substrates also function as the bottom conducting support. Any dielectric material may be used as the substrate, such as a variety of plastics, glasses, etc., as those dielectrics may be positioned on the top surface of a conducting support (e.g., a metal-coated layer).

Different classes of printing fluids are compatible with the devices and systems disclosed herein. For example, the printing fluid may comprise insulating and conducting polymers, a solution suspension of micro and/or nanoscale particles (e.g., microparticles, nanoparticles), rods, or single walled carbon nanotubes, conducting carbon, sacrificial ink, organic functional ink, or inorganic functional ink. The printing fluid, in an embodiment, has an electrical conductivity selected from a range that is between $10^{-13}$ S/m and $10^{-3}$ S/m. In an embodiment, the functional ink comprises a suspension of Si nanoparticles, single crystal Si rods in 1-octanol or ferritin nanoparticles. The functional ink may alternatively comprise a polymerizable precursor comprising a solution of a conducting polymer and a photocurable prepolymer such as a solution of PEDOT/PSS (poly(3,4-ethylenedioxythiophene) and poly(styrenesulfonate)) and polyurethane. Examples of useful printing fluids are those that either contain, or are capable of transforming into upon surface deposition, a feature. In an aspect the feature is selected from the group consisting of a nanostructure, a microstructure, an electrode, a circuit, a biological material, a resist material and an electric device component. In an embodiment, the biologic material is one or more of a cell, protein, enzyme, DNA, RNA, etc. Controlled patterning of such materials are useful in any of a number of devices such as DNA, RNA or protein chips, lateral flow assays or other assays for detecting an analyte of interest. Any of the devices or methods disclosed herein may use a printing fluid containing any combination of the fluids and inks disclosed herein.

Further printing resolution and reliability is provided by a hydrophobic coating that at least partially coats the nozzle. Changing selected surface properties of the nozzle, such as generating an island of hydrophilicity by providing a hydrophobic coating around the exterior of the ejection orifice, prevents wicking of fluid around the nozzle orifice exterior.

In an embodiment, any of the systems may have a plurality of nozzles. In one aspect, the plurality of nozzles is at least partially disposed in a substrate, such as for an ejection orifice that at least partially protrudes from the substrate. A nozzle disposed in a substrate includes a hole that traverses from one substrate face to the opposing substrate face. This nozzle hole can be coated with a silicon dioxide or silicon nitride material to facilitate controlled printing. Each of the nozzles is optionally individually addressable. In an embodiment, each of the nozzle has access to a separate reservoir of printing fluid, so that different printing fluids may be printed simultaneously, such as by a microfluidic channel that transports the printing fluid from the reservoir to the nozzle. The microfluidic channel may be disposed within a polymeric material, and connected to the fluid reservoir at a fluid supply inlet port. The nozzle may be operationally combined with the polymeric-containing microfluidic channel in an integrated printhead.

In another embodiment of the invention, an electrohydrodynamic ink jet head having a plurality of physically spaced nozzles is provided. An electrically nonconductive substrate having an ink entry surface and an ink exit surface with a plurality of physically spaced nozzle holes extending through the ink exit surface. A voltage generating power supply is electrically connected with the nozzle. The nozzle holes have an ejection orifice to provide high-resolution printing. Such as orifices with an ejection area range selected from between 0.12 $\mu m^2$ and 700 $\mu m^2$, or a dimension between about 100 nm and 30 μm. An electrical conductor at least partially coats the nozzle to provide means for generating an electric charge at the ejection orifice. Any number of nozzles, having a nozzle density, may be provided. In an embodiment, the ink jet head has nozzle array with any number of nozzles, for example a total number of nozzles selected from between 100 and 1,000 nozzles. In an embodiment, the nozzles have a center to center separation distance selected from between 300 μm and 700 μm. In an embodiment, the nozzles are in a substrate having an ink exit surface area that is about 1 $inch^2$. Any of the multiple nozzle arrays optionally have a print resolution better than 20 μm, 10 or 100 nm. Any of the print resolutions are optionally defined by a lower print resolution such as 1 nm, 10 nm or 100 nm. In an embodiment, the print resolution selected from a range that is between 10 nm and 10 μm, 100 nm and 10 μm, or 250 nm and 10 μm.

In an embodiment, provided are various methods including methods related to the devices of disclosed herein. In an embodiment, any of the systems disclosed herein are used to deposit a feature onto a substrate surface by providing printing fluid to the nozzle and applying an electrical charge to the printing fluid in the nozzle. This charge generates an electrostatic force in the fluid that is capable of ejecting the printing fluid from said nozzle onto the surface to generate a feature (or a feature-precursor) on the substrate. A "feature precursor" refers to a printed substance that is subject to subsequent processing to obtain the desired functionality (e.g., a prepolymer that polymerizes under applied ultraviolet irradiation).

In another embodiment, the invention provides a method of depositing a printing fluid onto a substrate surface by providing a nozzle containing printing fluid. Optionally, the nozzle has an ejection orifice area selected from a range that is less than 700 $\mu m^2$, between 0.07 $\mu m^2$ and 500 $\mu m^2$, or between 0.1 $\mu m^2$ and 700 $\mu m^2$. Optionally, the nozzle has a characteristic dimension that is less than 20 μm, less than 10 μm, less than 1 μm, or between 100 nm and 20 μm. A substrate surface to be printed is provided, placed in fluid communication with the nozzle and separated from each other by a separation distance. Fluid communication refers to that when an electric charge is applied to dispense fluid out of the nozzle orifice, the fluid subsequently contacts the substrate surface in a controlled manner. Optionally, the electric charge is applied intermittently. In an embodiment the electric charge is applied to provide a selected printing mode, such as a printing mode that is a pre-jet mode.

To provide improved printing capability, in an embodiment, a surfactant is added to the printing fluid to decrease evaporation when the fluid is electrostatically-expelled from the orifice. In another embodiment, at least a portion of the ejection orifice outer edge is coated with a hydrophobic material to prevent wicking of printing material to the nozzle outer surface. In an aspect, any of the devices disclosed herein may have a print resolution that is selected from a range that is between 100 nm and 10 μm. Any of the printed fluid on the substrate may be used in a device, such as an electronic or biological device.

In another embodiment, improved printing capability is achieved by providing a substrate assist feature on the surface to be printed, thereby improving placement accuracy and fidelity. Generally, substrate assist feature refers to any process or material connected to the substrate surface that affects printing fluid placement. The assist feature accordingly can itself be a feature, such as a channel that physically restricts location of a printed fluid, or a property, such as surface regions having a changed physical parameter (e.g., hydrophobicity, hydrophilicity). Alternatively, assist feature may itself not be directly connected to the surface to-be-printed, but may involve a change in an underlying physical parameter, such as electrodes connected to a support that in turn provides surface charge pattern on the substrate surface to be printed. Pattern of charge may optionally be provided by injected charge in a dielectric or semiconductor, etc. material in electrical communication with the surface to-be-printed. In an embodiment, any of these assist features are provided in a pattern on the substrate surface to printed, corresponding to at least a portion of the desired printed fluid pattern.

An alternative embodiment of this invention relates to an integrated-electrode nozzle where both an electrode and counter-electrode are connected to the nozzle. In this configuration, a separate electrode to the substrate or substrate support is not required. Normal electrojet systems require a conducting substrate which is problematic as it is often desired to print on dielectrics. Accordingly, it would be advantageous to integrate all electrode elements into a single print head. Such electrode-integrated nozzles provide a mechanism to address individual nozzles and an opportunity for fine control of deposition position not available in conventional systems. In an aspect, the integrated-electrode nozzle is made on a substrate wafer, such as a wafer that is silicon {100}. The nozzle may have a first electrode as described herein. The counter-electrode may be provided on a nozzle surface opposite (e.g., the outer surface that faces the substrate) the nozzle surface on which the first electrode is coated (e.g., inner surface that faces the printing fluid volume). In an embodiment the counter-electrode is a single electrode in a ring configuration through which printing fluid is ejected. Alternatively, the counter-electrode comprises a plurality of individually addressable electrodes capable of controlling the direction of the ejected fluid, thereby providing additional feature placement control. In an embodiment, the plurality of counter-electrodes together form a ring structure. In an embodiment, the number of counter electrodes is between 2 to 10, or is 2, 3, 4, or 5.

An alternative embodiment of the invention is a method of making an electrohydrodynamic ink jet having a plurality of ink jet nozzles in a substrate wafer, such as a wafer that is silicon {100}. The wafer may be coated with a coating layer, such as a silicon nitride layer, and further coated with a resist layer. Pre-etching the nozzle substrate wafer exposes the crystal plane orientation to provide improved nozzle placement. A mask having a nozzle array pattern is aligned with crystal plane orientation and the underlying wafer exposed in a pattern corresponding to the nozzle array pattern. This pattern is etched to generate an array relief features in the wafer corresponding to the desired nozzle array. The relief features are coated with a membrane, such as a silicon nitride or silicon dioxide layer, thereby forming a nozzle having a membrane coating. The side of the wafer opposite to the etched relief features is exposed and etched to expose a plurality of nozzle ejection orifices.

Providing a membrane coating with a lower etch rate than the wafer etch rate, provides the capability of generating ejection orifice that protrude from the substrate wafer. Any number of nozzles or nozzle density may be generated in this method. In an embodiment, the number of nozzles is between 100 and 1000. This procedure provides an ability to manufacture nozzles having very small ejection orifices, such as an ejection orifice with a dimension selected from between 100 nm and 10 μm.

The devices and methods disclosed herein provide the capacity of printing features, including nanofeatures or microfeatures, by e-jet printing with an extremely high placement accuracy, such as in the sub-micron range, without the need for surface pre-treatment processing.

Without wishing to be bound by any particular theory, there can be discussion herein of beliefs or understandings of underlying principles or mechanisms relating to embodiments of the invention. It is recognized that regardless of the ultimate correctness of any explanation or hypothesis, an embodiment of the invention can nonetheless be operative and useful.

BRIEF DESCRIPTION OF THE DRAWINGS

FIG. 30A: Printed pattern using NOA 73 from a 5 μm micro capillary, with on-the-fly droplet diameter control by changing pulse width $T_p$. FIG. 30B: Detail of pattern showing controlled transition from 3.9 μm to 8.1 μm droplet size. The droplet size is controlled independent of droplet spacing (16 μm). FIG. 30C: Pulse width control to generate droplets of varying size.

DETAILED DESCRIPTION OF THE INVENTION

Figure 1:
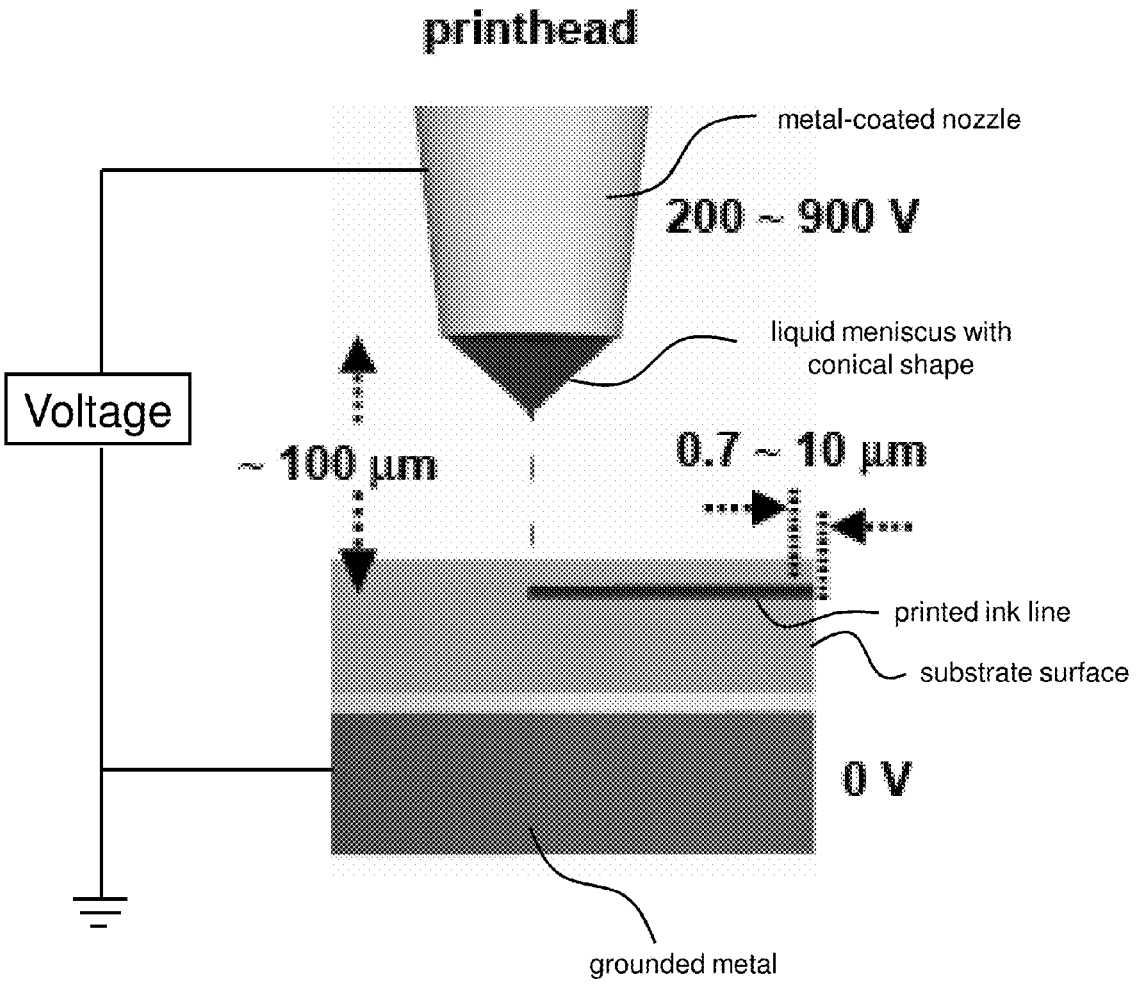
FIG. 1 is a schematic illustration of a nozzle and substrate configuration for printing. Ink ejects from the apex of the conical ink meniscus that forms at the tip of the nozzle due to the action of a voltage applied between the tip and ink, and the underlying substrate. These droplets eject onto a moving substrate to produce printed patterns. For this illustration, the substrate motion is to the right. Printed lines with widths as small as 200 nm can be achieved in this fashion.

"Electrohydrodynamic" refers to printing systems that eject printing fluid under an electric potential applied between the orifice region of the printing nozzle and the substrate. When the electrostatic force is sufficiently large to overcome the surface tension of the printing fluid at the nozzle, printing fluid is ejected from the nozzle, thereby printing a droplet of material onto a surface.

"Ejection orifice" refers to the region of the nozzle from which the ink is capable of being ejected under an electric charge. The "ejection area" of the ejection orifice refers to the effective area of the nozzle facing the substrate surface to be printed and from which ink is ejected. In an embodiment, the ejection area corresponds to a circle, so that the diameter of the ejection orifice (D) is calculated from the ejection area (A) by: $D=(4A/\pi)^{1/2}$. A "substantially circular" orifice refers to an orifice having a generally smooth-shaped circumference (e.g., no distinct, sharp corners), where the minimum length across the orifice is at least 80% of the corresponding maximum length across the orifice (such as an ellipse whose major and minor diameters are within 20% of each other). "Average diameter" is calculated as the average of the minimum and maximum dimension. Similarly, other shapes are characterized as substantially shaped, such as a square, rectangle, triangle, where the corners may be curved and the lines may be substantially straight. In an aspect, substantially straight refers to a line having a maximum deflection position that is less than 10% of the line length.

"Printable fluid" is used herein interchangeably with "printing fluid" or "ink", and each is used broadly to refer to a material that is ejected from the printing nozzle and having at least one feature or feature precursor that is to be printed on a surface. Different types of printable fluid may be used, including liquid ink, hot-melt ink, ink comprising a suspension of a material in a volatile fluid. The printable fluid may be an organic printable fluid or an inorganic printable fluid. An organic printable fluid includes, for example, biological material suspended in a fluid, such as DNA, RNA, protein, peptides or fragments thereof, antibodies, and cells, or non-biological material such as carbon nanotube suspensions, conducting carbon (see, e.g., SPI Supplies® Conductive Carbon Paint, Structure Probe, Inc., West Chester, Pa.), or conducting polymers such as PEDOT/PSS. Inorganic printable fluid, in contrast, refers to suspensions of inorganic materials such as fine particulates comprising metals, plastics, or adhesives, or solution suspensions of micro or nanoscale solid objects. A "functional printable fluid" refers to a printable fluid that when printed provides functionality to the surface. Functionality is used broadly herein that is compatible with any one or more of a wide range of applications including surface activation, surface inactivation, surface properties such as electrical conductivity or insulation, surface masking, surface etching, etc. For printable fluids having a volatile fluid component, the volatile fluid assists in conveying material suspended in the fluid to the substrate surface, but the volatile fluid evaporates during flight from the nozzle to the substrate surface or soon thereafter.

The particular printable fluid and composition thereof used in a system depends on certain system parameters. For example, depending on the substrate surface that is printed, e.g., whether the substrate is a dielectric or itself is a charged or a conducting material, influences the optimum electric properties of the fluid. Of course, the printing application restrains the type of printable fluid system, for example, in biological or organic printing, the bulk fluid must be compatible with the biologic or organic component. Similarly, the printing speed and evaporation rate of the printable fluid is another factor in selecting appropriate inks and fluids. Other hydrodynamic considerations involve typical flow parameters such as flow-rate, effective nozzle cross-sectional areas, viscosity, and pressure drop. For example, the effective viscosity of the printable fluid cannot be so high that prohibitively high pressures are required to drive the flow.

Printable fluids optionally are doped with an additive, such as an additive that is a surfactant. These surfactants assist in preventing evaporation to decrease clogging. Especially in systems with relatively small nozzle size, high volatility is associated with clogging. Surfactants assist in lowering overall volatility.

One important printable fluid property is that the printable fluid must be electrically conductive. For example, the printable fluid should be of high-conductivity (e.g., between $10^{-13}$ and $10^{-3}$ S/m). Examples of suitable ink properties for continuous jetting are provided in U.S. Pat. No. 5,838,349 (e.g., electric resistivity between $10^{6}$-$10^{11}$ Ωcm; dielectric constant between 2-3; surface tension between 24-40 dyne/cm; viscosity between 0.4-15 cP; specific density between 0.65-1.2). Similarly, any of the inks described in WO 2009/011709 may be used as a printable fluid.

"Controllably ejecting" refers to deposition of printing fluid in a pattern that is controlled by the user with well-defined placement accuracy. For example, the pattern may be a spatial-pattern and/or a magnitude pattern having a placement accuracy that is at least about 1 μm, or in the sub-micron range.

"Electric potential difference" refers to the voltage supply generated potential difference between the printing fluid within the nozzle (e.g., the fluid in the vicinity of the ejection orifice) and the substrate surface, and can provide an electric charge to the printable fluid contained in the nozzle. This electric potential difference may be generated by providing a bias or electric potential to one electrode compared to a counter electrode. The resultant electric field results in controllable printing on a substrate surface. In an aspect, the electric potential difference is applied intermittently at a frequency. In an embodiment, the electric potential difference is applied continuously, but has a magnitude that is time varying, such as a "pulsed electric potential". The pulsed voltage or electric charge may be a square wave, sawtooth, sinusoidal, or combinations thereof, and can be further described by various physical parameters including pulse width and pulse spacing. Dot-size modulation is provided by varying one or more of the intensity of the electric field, duration of the pulse, or pulse frequency/spacing. As known in the art, the various system parameters are adjusted to ensure the desired printing mode as well as to avoid short-circuiting between the nozzle and substrate. The various printing modes include drop-on-demand printing, continuous jet mode printing, stable jet, pulsating mode, and pre-jet. Different printing modes are accessed by different applied electric field. If there is an imbalance between the electric-driven output flow and pressure-driven input flow, the printing mode is pulsating jet. If those two forces are balanced, the printing mode is by continuously ejected stable jet. In an embodiment, either of the pulsating or the stable jet modes are used in printing. In an embodiment, the printing is by pulsating jet mode as the stable jet mode may be difficult to precisely control to obtain higher printing resolutions, as small variations in applied field can cause a significant effect on printing (e.g., too high causes "spraying", too low causes pulsation). In an embodiment, the electric field is pulsed, such as by using pulsed on/off voltage signals, thereby controlling the ejection period of droplets and obtaining drop-on-demand printing capability. In an embodiment, these pulses oscillate rapidly from positive to negative during printing in a manner that provides a zero net charge of printed material. In addition, in the embodiment where there is a plurality of counter-electrodes, the electric field may oscillate by applying electric charge to different electrodes in the plurality of electrodes along the direction of printing in a spatial and/or time-dependent manner. In a similar fashion, current into the system may be pulsed, thereby generating a pulsed electric field, as voltage and current are related "electrical parameters" (including, for example, by Ohm's law).

"Current output during printing" refers to the electric current spikes associated with the ejection of printable fluid droplets from the nozzle. Methods and devices provided herein recognize that monitoring, such as by real-time measurement and/or off-line analysis (e.g., post-printing), provides useful information about a printing condition for particular experimental process parameters. For example, a process parameter that is the potential difference, stand-off height between nozzle tip and substrate, printable fluid pressure, printable fluid composition, temperature, humidity can affect a printing condition. The printing condition, however, can be determined from monitoring the current output with the frequency of spikes providing the printing frequency and the peak of the spikes, as well as area under the spike curve, providing information about printed droplet volume or size.

"Printing condition" refers to a useful characteristic of printing including, but not limited to, print frequency, print droplet volume or size, print speed, print resolution, print precision, or droplet behavior including coalescing of multiple distinct droplets.

"Process parameter" refers to a physical variable that affects a printing condition. Particularly relevant process parameters are those that can be readily monitored and/or controlled to maintain or generate a printing condition. Examples of process parameters include, electrical parameters such potential difference or electric current, stand-off height between nozzle tip and substrate, printable fluid pressure, printable fluid composition, temperature, humidity, substrate composition, substrate topography. Each of those process parameters can significantly affect E-jet printing and may be independently controlled as desired. Furthermore, the effect of process parameters on printing can be tested and process maps that relate various process parameters to printing condition developed.

"Process map" refers to the relation between a process parameter and a printing condition. Process maps may be developed and used by any of the methods provided herein to provide additional guidance or assistance in controlling a process parameter during printing to obtain or maintain a desired printing condition (e.g., print frequency, size, speed, etc.).

"Feed-forward control" refers to control of a process parameter, such as voltage, current, stand-off distance to compensate for systemic variations in the system, thereby maintaining good printing characteristics including high-resolution, high-precision, high-speed, and/or high-fidelity. Feed-forward control processes may be obtained from models and repeated experiments, including from a process map. Feed-forward control may be further described as iterative learning, wherein repeated printing under specified conditions can provide information about selecting a process parameter, including an electrical parameter, to obtain a desired printing condition.

"Feedback control" refers to control of a process parameter to compensate for unforeseen variations that cannot be predicted a priori (in contrast to the systemic variations addressed by feed-forward control). Feedback control can be based on real-time sensor-feedback information of output current during printing to rapidly provide corrective control to a process parameter, such as an electrical parameter that affects the electric potential difference, including voltage, current, and/or stand-off distance, thereby maintaining desired printing condition. In an aspect, the control systems ensure that the desired printing condition deviates by less than 10%, less than 5% or less than 1% from the desired value, throughout printing.

"Resolution" refers to the ability to print a droplet of a specific size and may be defined in a number of ways. The methods described herein relate to "high-resolution" printing. In an aspect, high-resolution refers to the resolution achieved by the methods described herein that are not achieved by comparable methods that do not employ the sensing and control steps described herein. Alternatively, resolution may be quantified, such as by a characteristic of the printed material or a statistical parameter thereof. In one embodiment, high-resolution refers to printed material having a printed dimension on the substrate, such as diameter, wherein the standard deviation of the diameter is less than or equal to 10% of the diameter. In another embodiment, high-resolution refers to a standard deviation of a characteristic size of an ejected droplet (e.g., diameter), having an average value that is selected from a range that is greater than or equal to 100 nm and less than or equal to 1 μm and a standard deviation that is selected from a range that is greater than or equal 10 nm and less than or equal to 100 nm, including for a relatively high jet frequency (e.g., on the order of kHz and higher, such as about 30 kHz printing speeds). In an aspect, the high-resolution printing is for printing speeds that are an order of magnitude or higher than E-jet printing not using one or more of the control and sensing systems described herein, including at least about 30 times faster for pulsed jetting printers as described herein.

"Printing resolution" refers to the smallest printed size or printed spacing that can be reliably reproduced. For example, resolution may refer to the distance between printed features such as lines, the dimension of a feature such as droplet diameter or a line width, or a statistic description of the variation thereof (e.g., standard deviation or standard error of the mean).

"Precision" refers to the ability to place an ejected droplet in a desired location. Accordingly, the higher the precision, the more reliably a droplet is placed in that location. High precision is important for precise printing applications, including micro- and nano-scale printing of micro- and nano-features, such as in the electronics, chemical and biological industries, for example. High precision is also important for reliable overwriting applications, where a substrate is repeatedly printed to build up a pattern of printed features.

"Speed" refers generally to the speed at which material is printed or the time it takes to complete a print. As used herein, the term "high" is used in a relative sense and refers to any of the relevant resolution, precision and speed that are improved compared to conventional E-jet systems that do not employ the corresponding monitoring and control features, or the input pulsing. Alternatively, "high" is used quantitatively, and as described herein for various embodiments.

"Stand-off distance" or "stand-off height" refers to the minimum distance between the nozzle and the substrate surface.

"Modulating" refers to changing current or voltage such as by changing the magnitude or introducing pulsing which has a number of controllable parameters including pulse shape, frequency, spacing, maximum value, minimum value.

"Fidelity" refers to a measure of how well a selected pattern of elements, such as a printed pattern of droplets, is printed to a receiving surface of a substrate. "High print fidelity" refers to printing of a selected pattern of droplets, wherein the relative position and size of individual droplets are preserved during printing, for example wherein spatial deviations of individual droplets from their positions in the selected pattern are less than or equal to 200 nanometers, less than or equal to 50 nanometers, or less than or equal to 10 nanometers. "High print fidelity" can also be characterized statistically, such as a maximum deviation in spacing or size that is less than or equal to 20%, 10%, 5% or 1% from an average value or a desired value.

"Electrical contact" refers to one element that is capable of affecting change in the electric potential of a second element. Accordingly, an electrode connected to a voltage source by a conducting material is said to be in electrical contact with the voltage source. "Electrical communication" refers to one element that is capable of affecting a physical force on a second element. For example, a charged electrode in electrical communication with a printing fluid that is electrically conductive exerts an electrostatic force on that portion of the fluid that is in electrical communication. This force may be sufficient to overcome surface tension within the fluid that is at the ejection orifice, thereby ejecting fluid from the nozzle. Similarly, an electrode in electrical contact with a support is itself in electrical communication with a substrate surface not contacting the electrode when the electrode is capable of affecting a change in printed droplet position.

A substrate surface with a "controllable electric charge distribution" refers to a printing system that is capable of undergoing controllable spatial variation in the electric field strength on the surface of the substrate surface. Such control is a means of further improving charged droplet deposition. This distribution can be by controlling a plurality of independently-chargeable electrodes that are in electrical contact with the conductive support or electrical communication with the substrate surface.

In addition to the electric field or electric charge oscillating in a time-dependent manner, the electric field or charge may oscillate in a spatial-dependent manner. "Spatial oscillation" refers to the frequency of the field changing in a manner that is dependent on the geographical location of the printhead nozzle ejection orifice over the substrate surface. For example, in certain substrate locations it may be desirable to print larger-sized features, whereas in other locations it may be desirable to have smaller or no features. For example, the field may be oscillated spatially in the axis of patterning. Alternatively, or in combination, the printing speed may be manipulated to change the amount of fluid printed to a surface region.

The electrohydrodynamic printing systems are capable of printing features onto a substrate surface. As used herein, "feature" is used broadly to refer to a structure on, or an integral part of, a substrate surface. "Feature" also refers to the pattern generated on a substrate surface, wherein the geometry of the pattern of features is influenced by the deposition of the printing fluid. The term feature encompasses a material that is itself capable of subsequently undergoing a physical change, or causing a change to the substrate when combined with subsequent processing steps. For example, the patterned feature may be a mask useful in subsequent surface processing steps. Alternatively, the patterned feature may be an adhesive, or adhesive precursor useful in subsequent manufacturing processes. Patterned features may also be useful in patterning regions to generate relatively active and/or inactive surface areas. In addition, functional features (e.g. biologics, materials useful in electronics) may be patterned in a useful manner to provide the basis for devices such as sensors or electronics. Some features useful in the present invention are micro-sized structures (e.g., "microfeature" ranging from the order of microns to about a millimeter) or nano-sized structures (e.g., "nanostructure" ranging from on the order of nanometers to about a micron). The term feature, as used herein, also refers to a pattern or an array of structures, and encompasses patterns of nanostructures, patterns of microstructures or a pattern of microstructures and nanostructures. In an embodiment, a feature comprises a functional device component or functional device. Useful formation of patterns include patterns of functional materials such as relief structures, adhesives, electrodes, biological arrays (e.g., DNA, RNA, protein chips). The structure can be a three-dimensional pattern, having a pattern on a surface with a depth and/or height to the pattern. Accordingly, the term structure encompasses geometrical features including, but not limited to, any two-dimensional pattern or shape (circle, triangle, rectangle, square), three-dimensional volume (any two-dimensional pattern or shape having a height/depth), as well as systems of interconnected etched "channels" or deposited "walls." In an embodiment, the structures formed are "nanostructures." As used herein, "nanostructures" refer to structures having at least one dimension that is on the order of nanometers to about a micron. Similarly, "microstructure" refers to structures having at least one dimension that is on the order of microns, such as between 1 μm and 100 μm, between 1 μm and 20 μm, or between 1 μm and 10 μm. The systems provide printing resolutions and/or "placement accuracy" not currently practicable with existing systems without extensive additional surface pre-processing procedures. For example, the width of the line can be on the order of 100's of nm and the length can be on the order of microns to 1000's of microns. In an embodiment the nanostructure has one or more features that range from an order of hundreds of nm.

"Hydrophobic coating" refers to a material that coats a nozzle to change the surface-wetting properties of the nozzle, thereby decreasing wicking of printing fluid to the outer nozzle surface. For example, coating the outer surface of the ejection orifice provides an island of hydrophobicity that surrounds the pre-jetted droplet and decreases the meniscus size of the droplet by restricting liquid to an inner annular rim space. Accordingly, the printed droplet can be further reduced in size, thereby increasing printer resolution. Further optimization of the on/off rate of the electric field can provide droplets in the 100 nm diameter range, or in the 10's of nm range (e.g., ranging from between about 10 nm and 100 nm).

In systems having a plurality of nozzles, one or more, or each of the nozzles may be "individually addressable." "Individually addressable" refers to the electric charge to a nozzle that is independently controllable, thereby providing independent printing capability for the nozzle compared to other nozzles. Each of the nozzles may be connected to a source of printing fluid by a microfluidic channel. "Microfluidic channel" refers to a passage having at least one micron-sized cross-section dimension.

"Printing direction" refers to the path the printing fluid makes between the nozzle and the substrate on which the printing fluid is deposited. In an embodiment, direction is controlled by manipulating the electric field, such as by varying the potential to the counter-electrode. Good directional printing is achieved by employing a plurality of individually-addressable counter-electrodes, such as a plurality of electrodes arranged to provide a boundary shape, with the ejected printing fluid transiting through an inner region defined by the boundary. Energizing selected regions of the boundary provides a capability to precisely control the printing direction.

A substrate in "fluid communication" with a nozzle refers to the printing fluid within the nozzle being capable of being controllably transferred from the nozzle to the substrate surface under an applied electric charge to the region of the nozzle ejection orifice.

The invention may be further understood by the following non-limiting examples. All references cited herein are hereby incorporated by reference to the extent not inconsistent with the disclosure herewith. Although the description herein contains many specificities, these should not be construed as limiting the scope of the invention but as merely providing illustrations of some of the presently preferred embodiments of the invention. For example, thus the scope of the invention should be determined by the appended claims and their equivalents, rather than by the examples given.

Example 1

Control of High-Resolution E-Jet Printing

This example discusses a sensing and feedback-feedforward control system for Electrohydrodynamic jet (E-jet) printing (see also Barton et al., "High Resolution Sensing and Control of Electrohydrodynamic Jet Printing," to appear in Control Engineering Practice, 2010). E-jet printing is a nano-manufacturing process that uses electric field induced fluid jet printing through nano-scale nozzles. The printing process is controlled by changing the voltage potential between the nozzle and the substrate. However, it is difficult to maintain constant operating conditions such as stand-off height during a run of the printing process. The change in operating conditions results in fluctuating jet frequency and droplet diameter. For stabilizing the jetting frequency across a single run, a two degree of freedom (2-DOF) control algorithm is implemented. The feedforward voltage signal is used to compensate for repeatable changes in the operating conditions ("run-to-run control") and is obtained using an Iterative Learning Control (ILC) algorithm. The feedback controller compensates for uncertainty in jetting operating conditions. The jetting frequency is determined in real-time by recording electric current pulses when ink droplets are released from the nozzle. This frequency measurement is then used to control the voltage profile across a run to compensate for changing operating conditions. Experimental results validate the control method.

As the demand for micro- and nano-scale devices in electronics, biotechnology and microelectromechanical systems has increased, efforts have been made to adapt current graphic art printing techniques to address this need. Traditional graphic art approaches such as ink-jet printing include applying heat to induce a vapor bubble to form and eject a droplet of ink through a nozzle, and piezoelectric printers which use a glass capillary squeezed by a surrounding cylinder of piezoelectric ceramic to drive the fluid deposition [1]. The minimum printing resolution that can be created reliably for these methods ranges from 20-30 μm. This coarse resolution is due to a combination of nozzle sizes and droplet placement. Smaller nozzle sizes may become clogged due to ink viscosity, while the vibrations caused by the piezoelectric actuators often lead to variations in the droplet placement [2]. Due to these size and accuracy limitations, these traditional graphic art approaches cannot be used for high-resolution manufacturing.

Electrohydrodynamic jet (E-jet) printing is a technique that uses electric fields to create fluid flow necessary to deliver ink to a substrate for high resolution (<1 μm) patterning applications [3]. E-jet has been gaining momentum in the past few years as a viable printing technique, especially in the micro- and nano-scale range [4, 5, 6]. While the applications of E-jet printing are varied, the process is typically run open-loop (i.e. no feedback or feedforward control). As the advantages of E-jet printing become more apparent (e.g. the potential for purely additive operations, the ability to directly pattern biological materials for biosensors, drop-on-demand functionality for chemical mixing and sensor fabrication, and high-resolution printing for printed electronics), the necessity for enhanced process control increases.

Online monitoring of E-jet is critical to establishing a reliable process. To facilitate this, we present a novel current sensing system to detect droplet deposition. This current measurement can then be used to determine the rate of droplet deposition, which may be used for real-time feedback and feedforward control. This example presents the first real-time sensing system for feedback control of the E-jet process.

A key challenge in control of the E-jet process is the lack of accurate process models and varying operating conditions across the run of a process. In order to address this issue, a 2-DOF (degree of freedom) control law is designed: feedback and feedforward control. The feedback control law is designed to stabilize the printing process by compensating for stochastic disturbances in the system, while the feedforward control law removes repetitive variations in the jetting caused by process variations that are consistent from each run to the next (e.g., "run-to-run control algorithms).

The feedback scheme incorporates a simple integral control law, leading to an improved steady-state printing performance. For designing feedforward control signals for E-jet, we use run-to-run control [7] algorithms such as Iterative Learning Control (ILC), which can provide substantial performance improvement if the operating conditions vary repetitively in every run of the process.

ILC is loosely derived from the paradigm of human learning. In a repetitive process, information from earlier iterations of the process can be used to improve performance in the current iteration. The early rigorous formulations of ILC were developed by [8] and [9]. [8] used a P-type ILC scheme for control of robotic manipulators. Since then, ILC has been implemented in several applications for control of repetitive processes because of its simplicity of design, analysis, and implementation. In particular, it has been successfully implemented in several industries including industrial robots [10], rapid thermal processing [11], semiconductor manufacturing [12], and micro-scale robotic deposition [13]. Detailed surveys of applications and theoretical advances in ILC can be found in [14, 15]. In this example, we use a simple P-type ILC law to regulate the frequency of the jetting process.

This example presents a novel technique for monitoring and controlling the E-jet process via current sensing and voltage modulation. Using current based detection to monitor the printing performance and optimize the input voltage both along the trial and from run-to-run, we can regulate printing speed and resolution of the E-jet process. Controlling the voltage input to the system provides more reliable printing results which in turn leads to a more viable manufacturing process. The use of current detection facilitates fast, real-time analysis, while many other traditional sensing and monitoring techniques (e.g. image processing) require extensive off-line data analysis. Along with current detection, process maps are used to determine appropriate control laws which result in the desired printing conditions.

One objective of this example is to present a novel approach for improving the performance of the E-jet printing process. More specifically, the contributions of this example include: (1) the development of an electronic sensing technique for real-time detection of E-jet printing; and (2) a control algorithm which determines optimized voltage profiles through process maps and measured current. The remainder of the example is as follows. Section 2 provides a description of the E-jet process. Sections 3 and 4 introduce current based droplet detection and process modeling, including the development of process maps used to determine appropriate printing conditions for a desired jetting frequency. Feedback control, feedforward control, and the combined control algorithm applied in this work are presented in Section 5. Experimental results validating the performance improvements from implementing the combined feedback and feedforward controller is given in Section 6. Section 7 provides a summary.

Section 2. ELECTROHYDRODYNAMIC JET PRINTING: E-jet printing uses electric field induced fluid flows through micro-capillary nozzles to create devices in the micro- and nano-scale range [3]. E-jet printing is described in U.S. Pat. No. 5,838,349 (by D. H. Choi and I. R. Smith). The printer and printing process detailed in that patent were designed to dispense different colored ink droplets into uniform patterns on a substrate. While that method easily surpassed the 2-D printing capabilities of ink jet printers at that time, droplet resolution, ink variations, and potential applications for E-jet printing were not fully addressed. PCT Pat. Pub. No. WO2009/011709 describes high-resolution E-jet printing for manufacturing systems. That patent application focuses on using the E-jet process to print high-resolution patterns or functional devices (e.g. electrical or biological sensors) in the sub-micron range. The patterning of wide ranging classes of inks in diverse geometries, as well as printed examples of functional circuits and sensors demonstrating the diverse applications of E-jet printing are provided in [3].

Figure 2A:
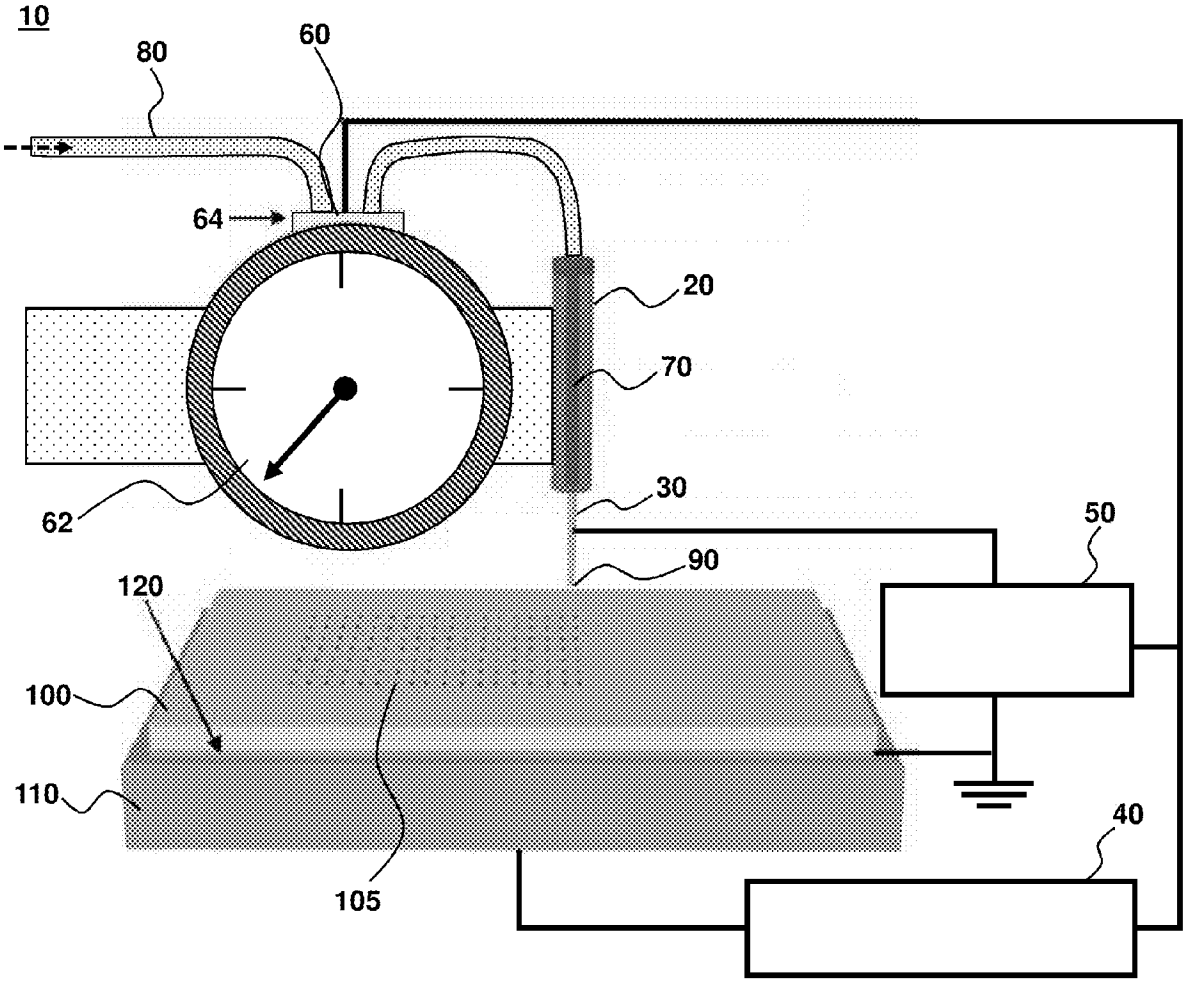
FIG. 2A: Schematic of an E-jet printing process set-up including: nozzle and ink chamber, air supply for back pressure, conducting substrate, and translation and tilting stage (adapted from Park et al. Nature Materials 6:782-789 (2007)).

FIG. 1 (adapted from WO2009/011709) is a schematic overview of e-jet printing. FIG. 2A presents a schematic of the E-jet printing process. The main elements for E-jet printing device 10 include an ink or printable fluid chamber 20, nozzle 30, metal-coated glass nozzle tip 90, computer control 40, power supply 50, pressure regulator 60, comprising a pressure gauge 62, pneumatic regulator 64, and air line 80, substrate 100, and positioning system 110 for translating and/or tilting the stage. In this embodiment, a conducting support 120 is electrically connected to the substrate 100. Printable fluid is ejected from the nozzle tip 90 and deposited on the substrate receiving surface, as indicated by the printed features 105. Controllable printing process parameters include the back pressure (pneumatic 60) applied to the ink chamber, the offset height between the nozzle 90 and substrate 100, and the applied voltage potential between a conducting nozzle tip and substrate, such as by power supply 50 which may control the potential difference or current. Note that the nozzle tip and substrate are generally coated with metal to ensure conductivity. In an aspect, the nozzle has a tip diameter selected from a range that is greater than about 0.3 μm and less than about 30 μm. Any number of variables or process parameters may be under computer control 40, including print position (e.g., relative position between substrate and nozzle tip), potential difference, current, electrical pulse shape, back-pressure, offset height. The printing conditions are controlled through the back pressure (air applied to the nozzle), the stand-off height, and the applied voltage potential between a conducting nozzle tip and substrate. In addition, variations in environmental conditions can be monitored for and controlled, including temperature, humidity, atmospheric pressure.

Figure 2B:
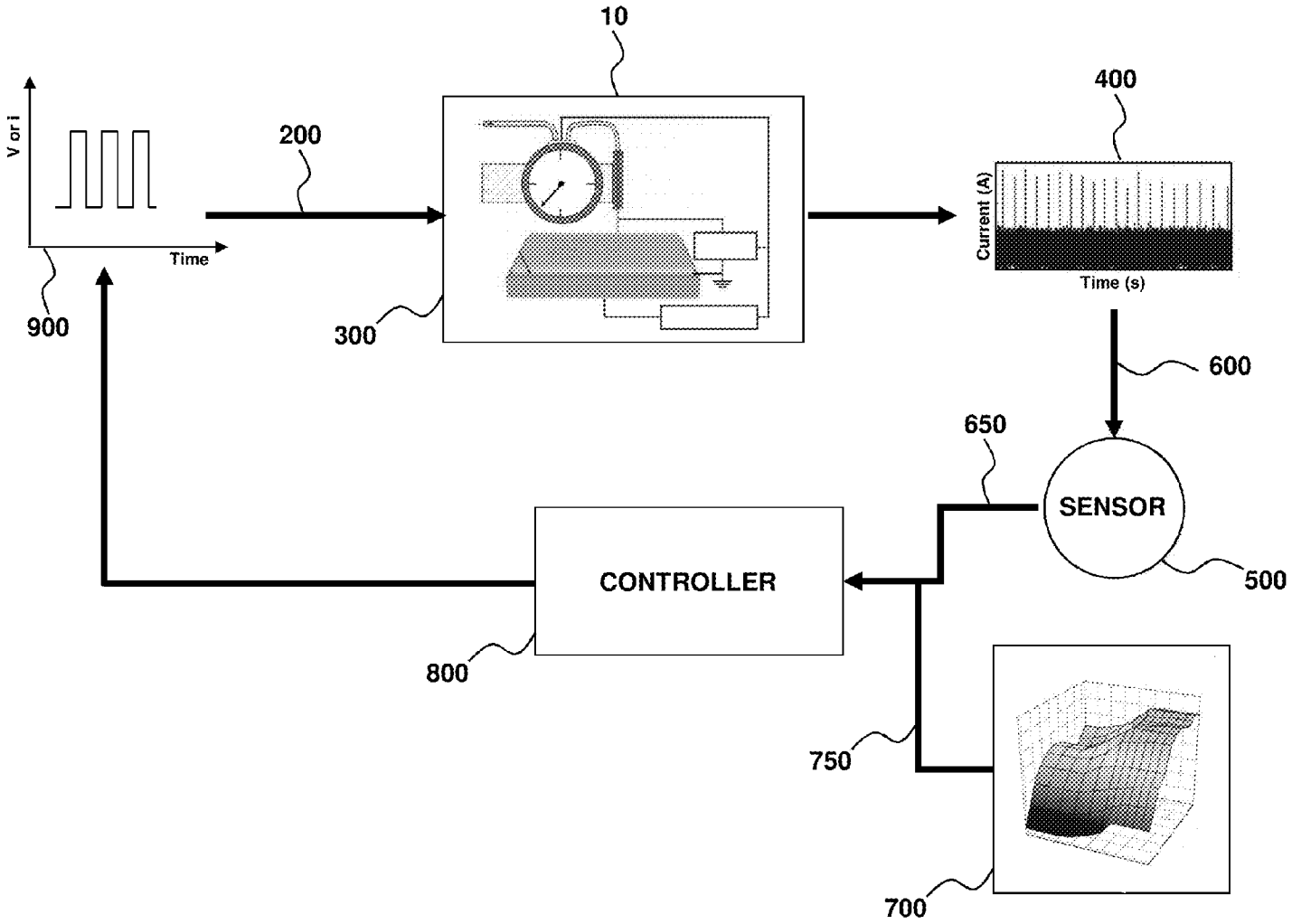
FIG. 2B is a schematic of a sensing and control process applied to the E-jet process of FIG. 2A to achieve high-resolution and precision printing.

FIG. 2B illustrates one embodiment of sensing and control to provide better control and print characteristics for E-jet printing. Input 200 of a process parameter that affects a printing condition is introduced to the process. This introduction can be, for example, to maintain or achieve a desired printing condition (e.g., print frequency, droplet size). In this example, the input is a pulsed voltage or current to the nozzle tip (or, alternatively, the substrate opposed to and facing the nozzle top), thereby controlling printing of the E-jet process 300 (e.g., corresponding to the device of FIG. 2A). Output current during printing 400 is monitored. A current sensor 500 is used to quantify the output current 600 during printing for use in real-time feedback 650. Optionally, a process map 700 that provides information about a printing condition based on one or more process parameters can be used to provide additional control (e.g., "feedforward control" 750). A controller 800 receives information from the sensor and/or process map to control a parameter 900 that affects a printing condition, such as an electrical parameter (voltage or current) input 200 to the E-jet process 300.

Figure 8:
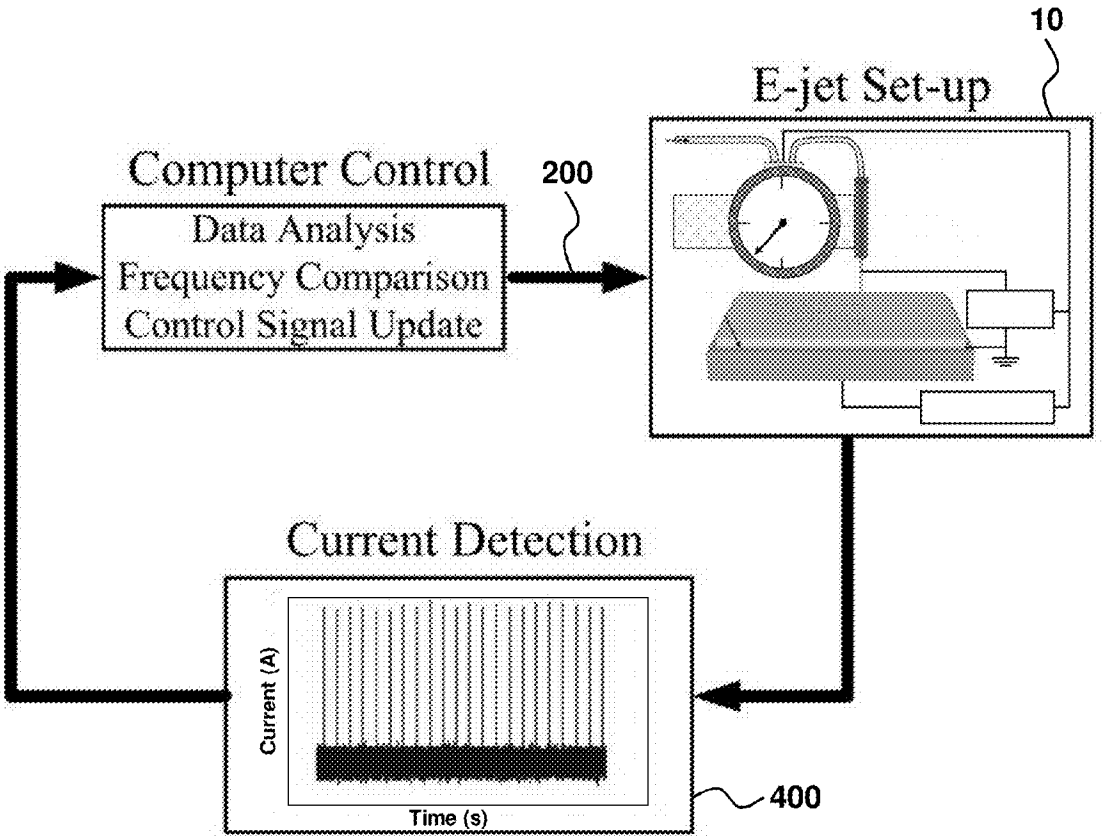
FIG. 8: Schematic of the E-jet printing process with current detection and voltage control.

A simplified schematic is provided in FIG. 8, where current output during printing 400 is monitored and used to guide selection and control of an input control signal (e.g., a process parameter) 200 to the E-jet printing 10 to maintain or achieve desired printing condition. Such monitoring and control processes provide E-jet printing resolution, precision or speed that would not otherwise be achieved without unduly adversely affecting one or more print conditions.

Figure 3:
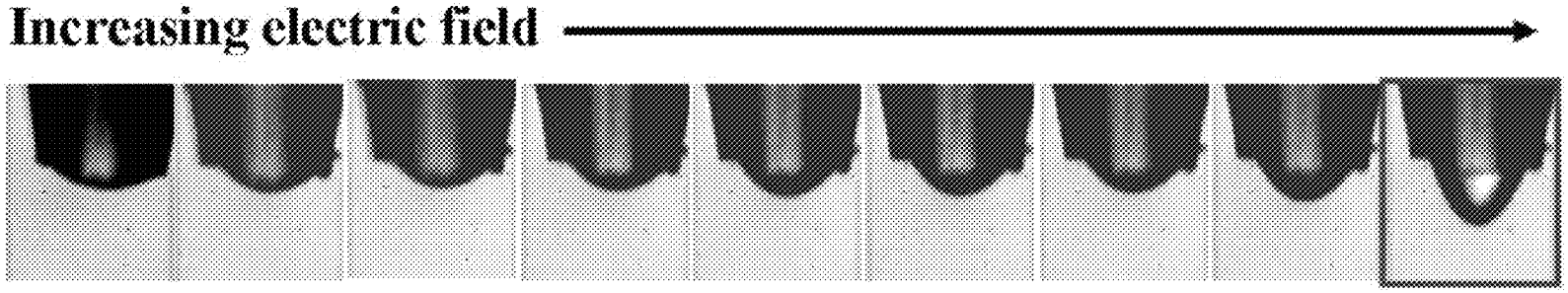
FIG. 3: Illustration of the change in the meniscus of the fluid due to an increase in voltage potential between the nozzle tip and the substrate.

For E-jet printing, a voltage potential is applied between a conducting nozzle and substrate. Note that the nozzle tip and substrate are generally coated with metal to ensure conductivity. Additionally, if the surface of the desired substrate is nonconductive, one can use a conductive layer under a nonconductive substrate provided that the thickness of the nonconductive substrate is within a certain range. A voltage applied to the nozzle tip causes mobile ions in the ink to accumulate near the surface at the tip of the nozzle. The mutual Coulombic repulsion between the ions introduces a tangential stress on the liquid surface that, along with the electrostatic attraction to the substrate, deforms the meniscus into a conical shape (called the Taylor cone after Sir Geoffrey Ingram Taylor who first reported it in 1964) as described in [3]. At some point, the electrostatic stress overpowers the surface tension between the liquid and the interior surface of the nozzle tip and droplets eject from the cone. FIG. 3 illustrates the change in the apex of the ink or printable fluid meniscus due to an increase in voltage.

Changes in back pressure, stand-off height, and applied voltage, affect the size and frequency of the droplets. These changes result in different jetting modes (e.g. pulsating, stable jet, e-spray) which can be used to achieve various printing requirements. The sensitivity of these jetting modes to variations in the printing conditions requires high-resolution sensing and control in order to achieve the desired results.

3. CURRENT DETECTION: Traditionally, the E-jet process has been monitored primarily through imaging, both online and offline. A camera is used to view the emission of the droplet from the nozzle onto the substrate. However, there are some significant disadvantages to this monitoring method. Firstly, image processing is time consuming and is unsuitable for feedback control of the process with low computation power. Further, without advanced image processing algorithms, this monitoring method necessitates the presence of a human operator for supervision. In order to address both these issues, this example uses a current detection system for sensing process operating conditions for E-jet printing (see, e.g., FIGS. 2B and 8). This current detection system is better suited for online monitoring and automated control of the E-jet process since the measurement and data analysis are simple and can be done at the same time-scale as the process (up to 1 kHz).

Figure 4:
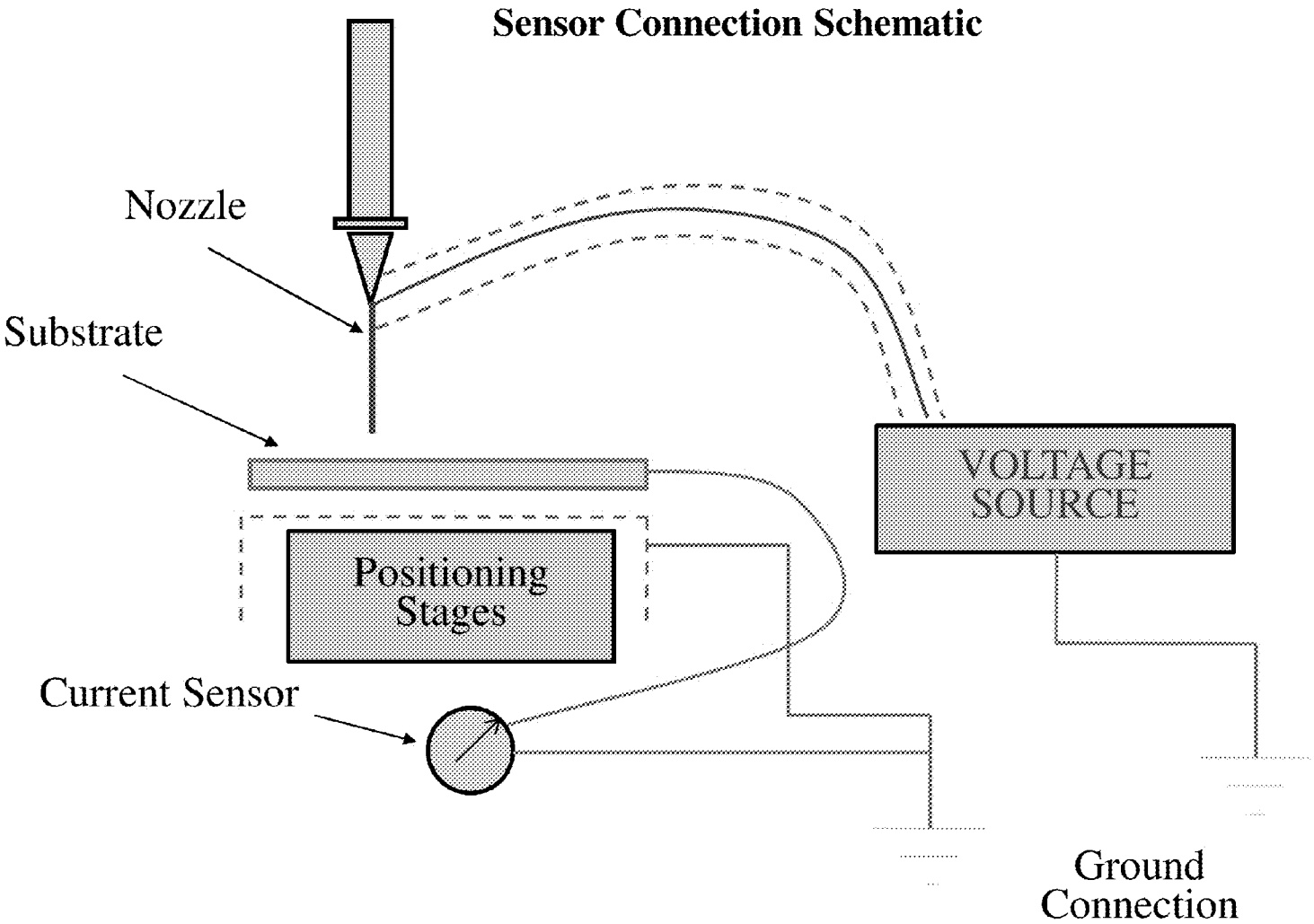
FIG. 4: Schematic of the substrate-side current measurement setup for the E-jet process. Note that the substrate-side setup is used during experimental testing.

Current-detection based process characterization of the process is based on the following fundamental physical phenomenon during E-jet. When a charged droplet is released from the nozzle, the voltage source generates a small current to neutralize the imbalance in charge in the fluid inside the nozzle. By detecting this current, the time of droplet release can be determined. This measurement scheme is termed Nozzle-side measurement. An alternate scheme measures the current discharged through the substrate. When a charged droplet from the nozzle hits the conductive substrate, the charge is dissipated through to the ground. This current can be measured by connecting a current sensor to the substrate-ground connection. This measurement scheme is termed Substrate-side measurement. FIG. 4 shows a schematic of the substrate-side current measurement setup used in this example. The high voltage source is connected to the nozzle side, while a current sensor is connected to the substrate side. The free end of the current sensor drains to ground.

Figure 5:
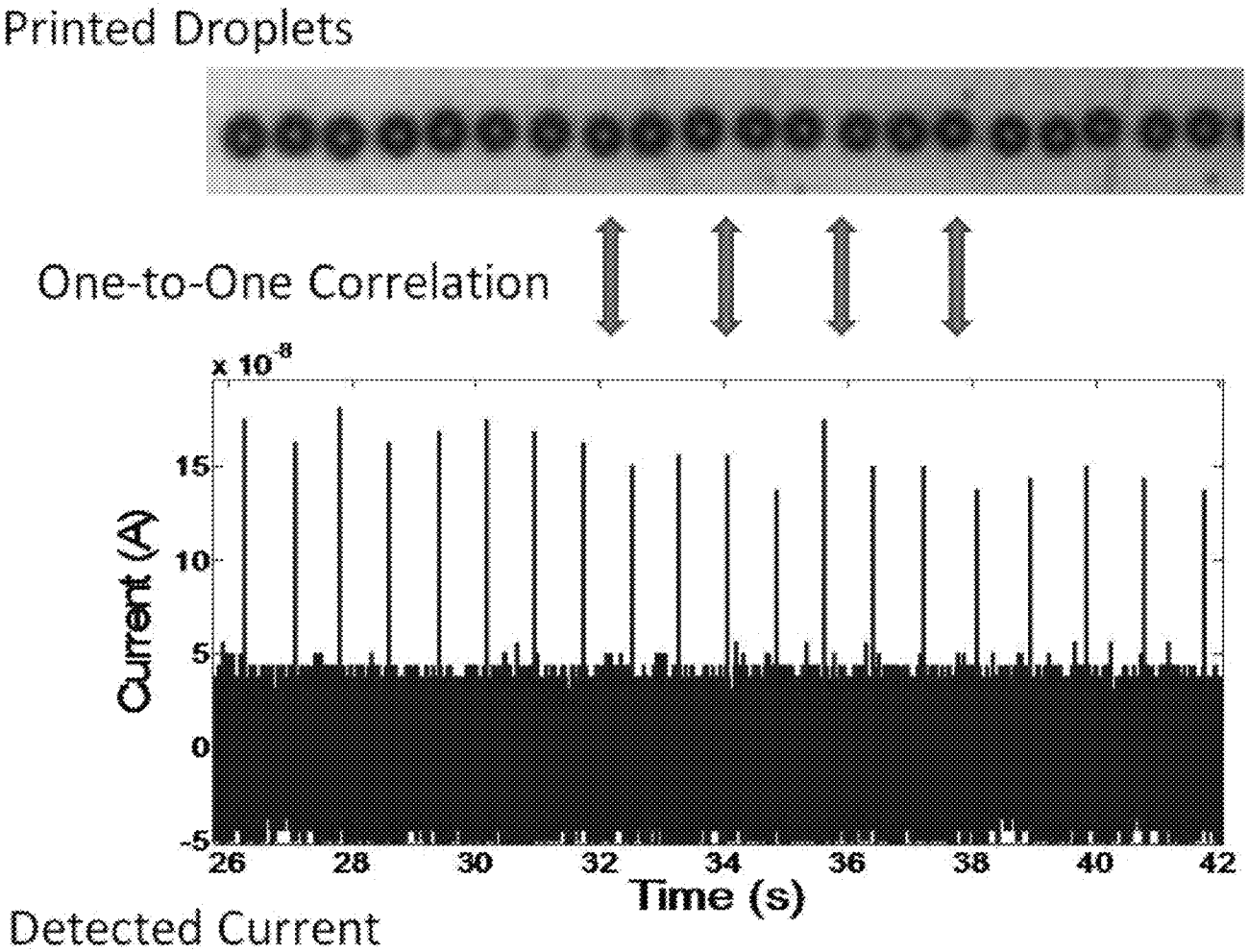
FIG. 5: Illustration of the one-to-one correlation between the printed droplets and the measured current peaks.

The frequency of jetting can be determined by measuring the time elapsed between two successive jets. Each peak in the current signal corresponds to a single jet. This is illustrated in FIG. 5. This signal can then be used in the control algorithm for regulation of frequency about a set point.

Figure 6:
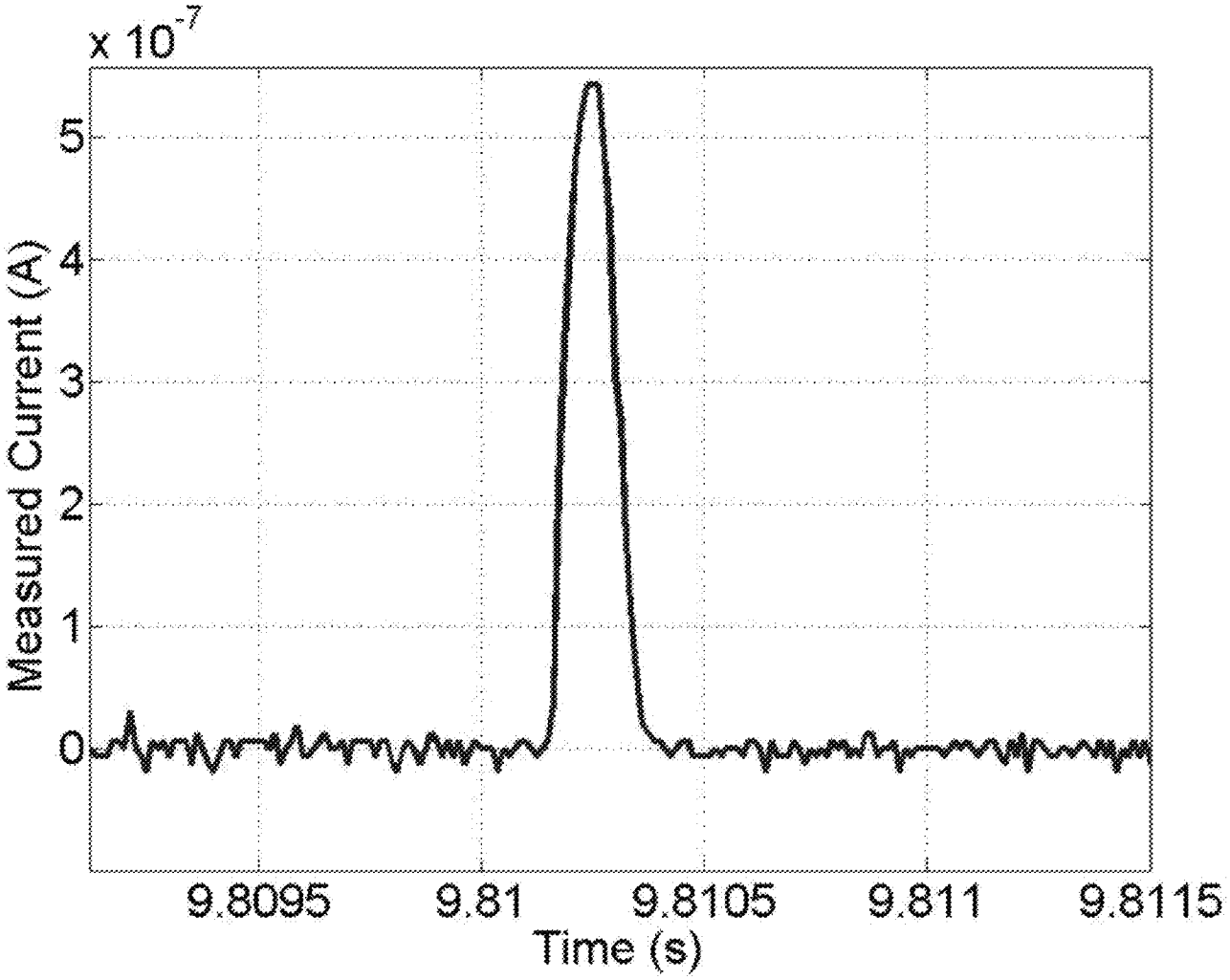
FIG. 6: Detailed image of a current peak corresponding to a single released droplet. The current peak has an amplitude of 520 nA and a duration of 30 μs.

The detailed plot of the current peak when a single droplet is released is shown in FIG. 6. The peak current is proportional to the size of the droplet (dependent on the applied voltage and back pressure). This makes intuitive sense since a larger droplet carries more charge. The duration of the jet is also directly proportional to the size of the droplet. The peak current is typically of the order of 10-100's of nanoamperes (in this case: 520 nA). These small currents necessitate very high quality shielding and noise suppression. The signal to noise ratios are typically of the order of 5-10. Further, the duration of the jet is generally less than 50 μs (in this case: 30 μs).

Figure 7:
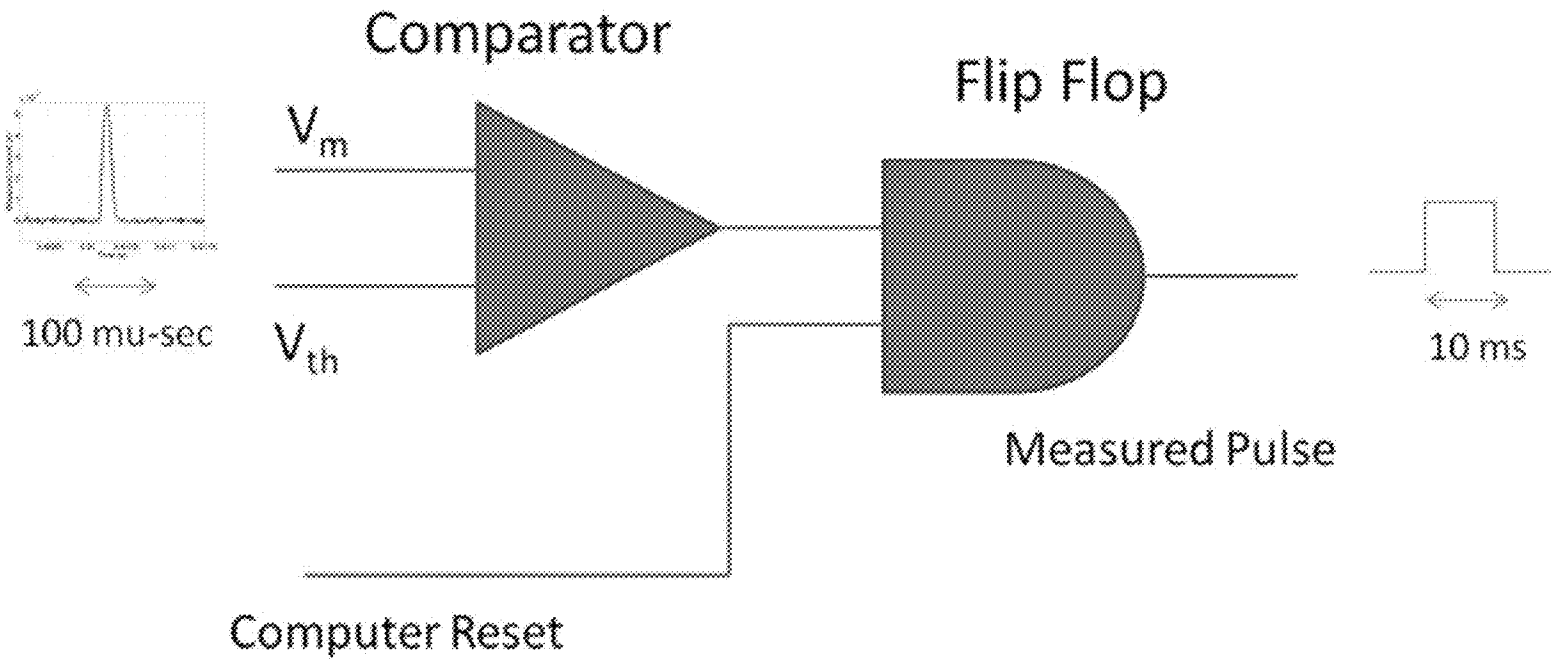
FIG. 7: Peak Detector circuit for determining time between successive current peaks.

Since the current peaks are of such short duration, a relatively simple peak detector circuit shown in FIG. 7 is designed. This peak detector circuit only records the time between peaks and not the amplitude. This measurement can be used in real-time for feedback and feedforward control of the jetting frequency. The schematic of the overall control system is shown in FIG. 8. Optionally, output current magnitude and/or area under the curve of a spike (FIG. 6) are determined to provide additional information related to printed droplet size. These calculations are provided in addition to visual inspection and measurement of the printed droplet size using an optical microscope off-line.

Figure 9:
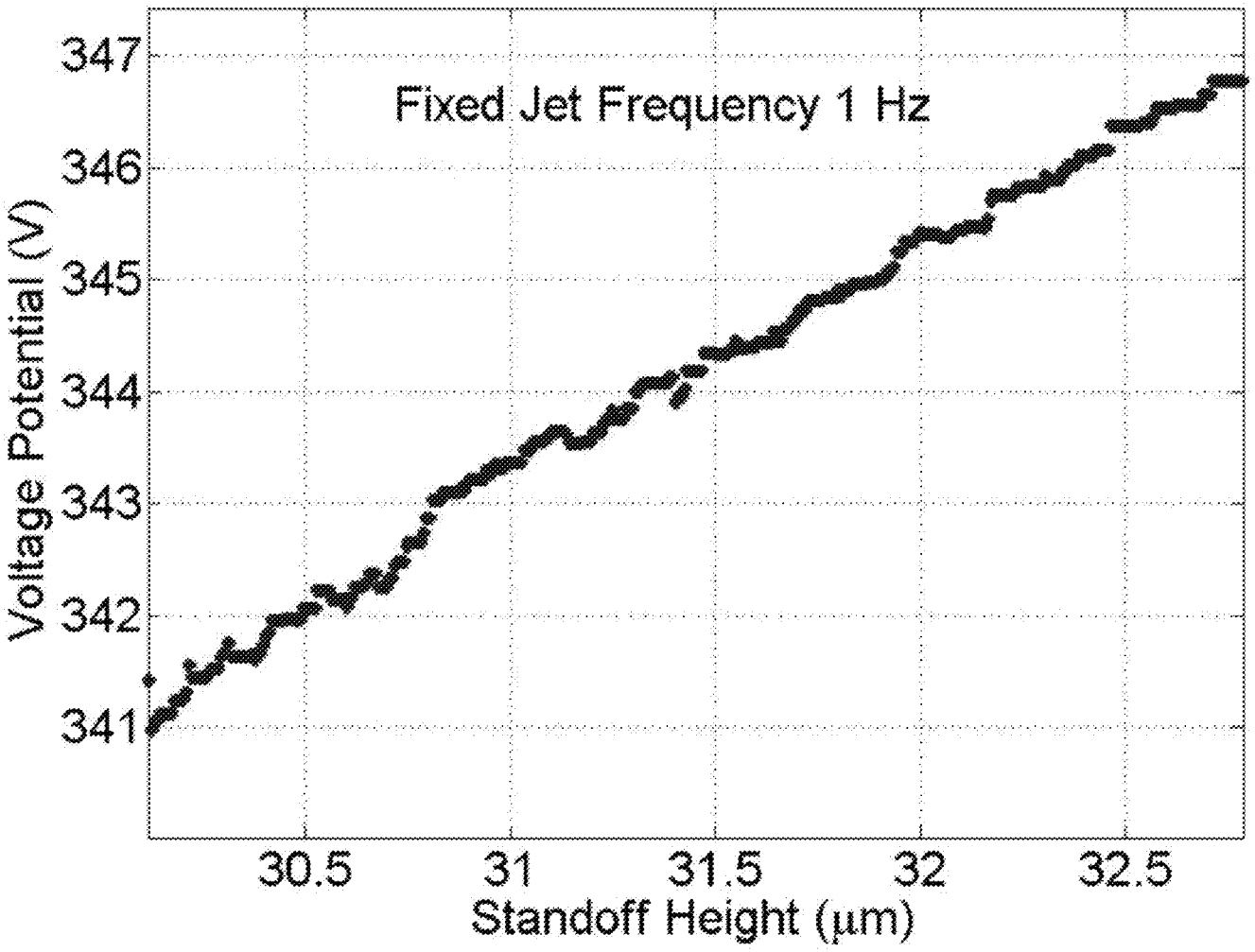
FIG. 9: Voltage potential versus stand-off height for a fixed jetting frequency. Note the linear relationship between the two variables resulting in a slope of 2 Wpm.

4. PROCESS MODELING: Choi et al. [16] proposed the following relationship for frequency of jetting f with the voltage potential V and stand-off height h:

$$f = K\left(\frac{V}{h}\right)^{\frac{3}{2}} \tag{1}$$

where K is a scaling constant dependent on the viscosity of the ink, the nozzle diameter, applied back pressure, and permittivity of free space. For a detailed derivation of this relationship, see [16]. This relationship between applied voltage V and the jetting frequency f can then be used for determining a suitable ILC proportional gain, explained in Section 5. FIG. 9 shows a plot of voltage against stand-off height for a given jet frequency of 1 Hz. A linear relationship is observed between these with a slope of 2 V/μm. The jetting operating conditions for these process maps are shown in Table 1. Note that these operating conditions vary depending on the nozzle diameter, substrate preparation, ink, and e-jet system.

Figure 10:
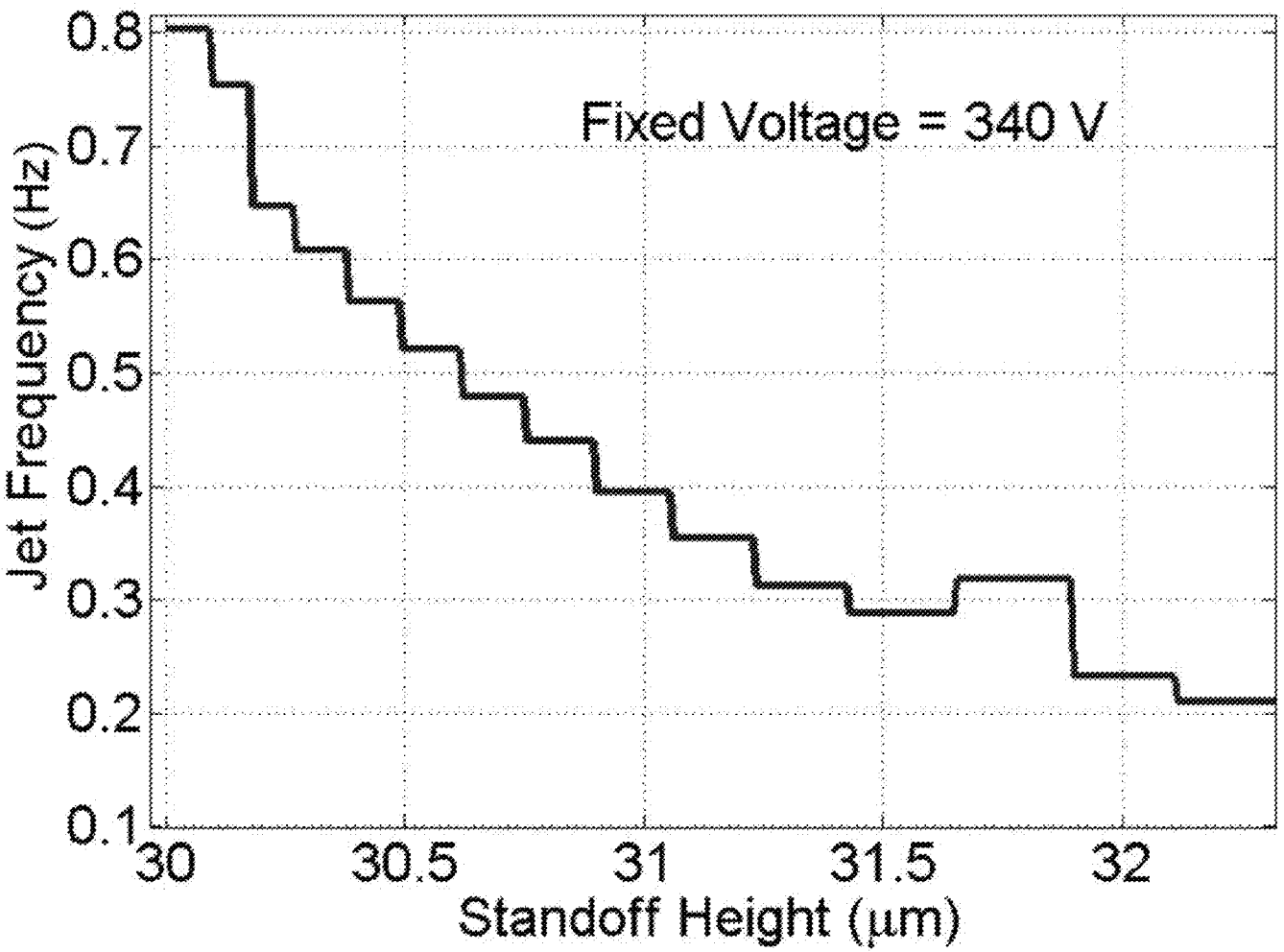
FIG. 10: Jet frequency versus stand-off height for a fixed voltage. Note that a relatively small change in stand-off height (2 μm) can result in a large frequency change (75% reduction in jetting frequency).

FIG. 10 shows a plot of jet frequency against stand-off height. A significant variation (a change of 2 μm can result in a reduction of jet frequency by 75%) in jetting frequency can be observed with changes in stand-off height, for a fixed voltage difference across the tip and substrate. This arises because the electric field is substantially weakened as the tip and substrate move farther away from each other.

Figure 11:
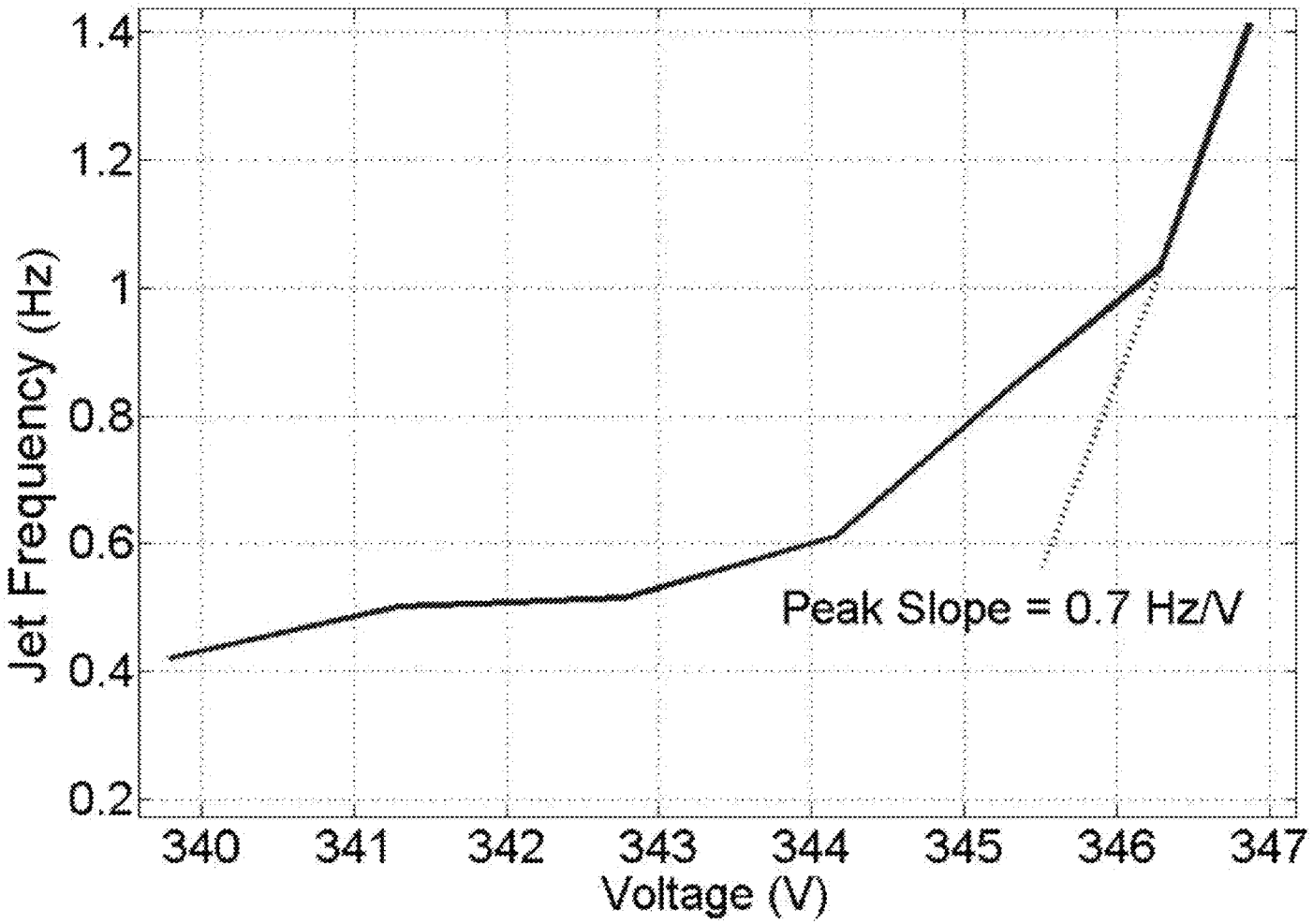
FIG. 11: Jet frequency versus voltage for a fixed stand-off height of 30 μm and back pressure of 1.6 psi.

Finally, FIG. 11 illustrates a plot of jet frequency against voltage for a fixed stand-off height of 30 μm and back pressure of 1.6 psi. The peak slope of this curve is 0.7 Hz/V. These static process maps, while specific to the e-jet setup used during experimental testing, enable us to determine the feedback and ILC gains for stability for a given e-jet system.

5. CONTROL OF THE E-JET PROCESS: The consistency of droplet deposition, i.e. the jetting frequency, is a key metric for evaluation of the E-jet printing process. The controllable input signal is the applied voltage difference between the nozzle and the substrate. In open-loop operation of the process, a fixed voltage difference is applied to the nozzle and the substrate based on the frequency-voltage maps described in the previous section. However, this strategy results in substantial variation of jetting frequency because process parameters such as stand-off height and wetting properties of the nozzle are subject to variation during the course of the printing process. In order to overcome this, we use a 2-DOF feedback and feedforward control algorithm to regulate the jetting frequency.

Figure 12:
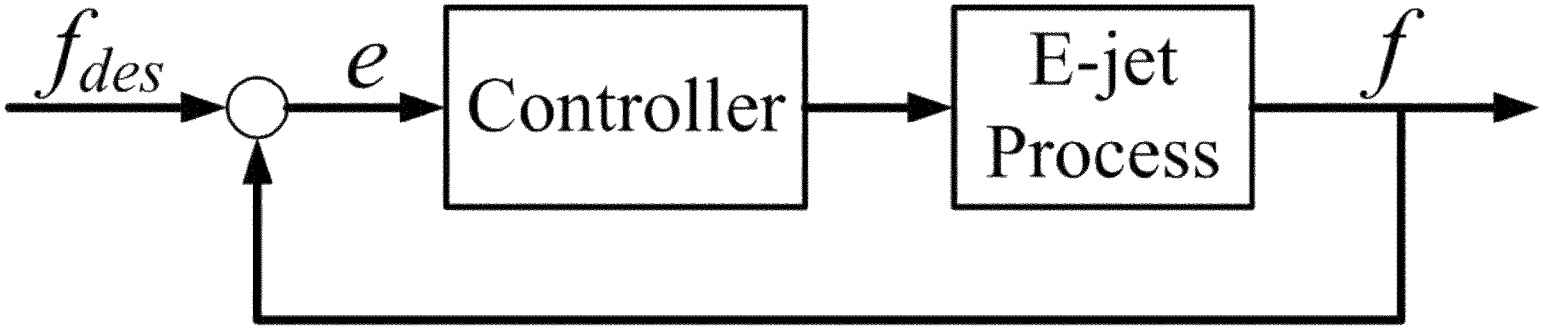
FIG. 12: Block diagram of the E-jet process with feedback control. The controller is an integral control law for this case.

5.1. Single DOF Feedback Control: FIG. 12 shows the block diagram of a feedback control system for E-jet. The controller is an integral control law of the form $$V_{fb}(k+1)=V_{fb}(k)+K_i(f_{des}-f(k)) \quad (2)$$

where $K_i$ is the integral control gain, $f_{des}$ is the desired frequency, and f(k) is the measured jetting frequency. Notice that the index k refers to the sample instant; however, f(k) is not updated at every sample instant. f(k) is updated only when a jet is detected.

Figure 13:
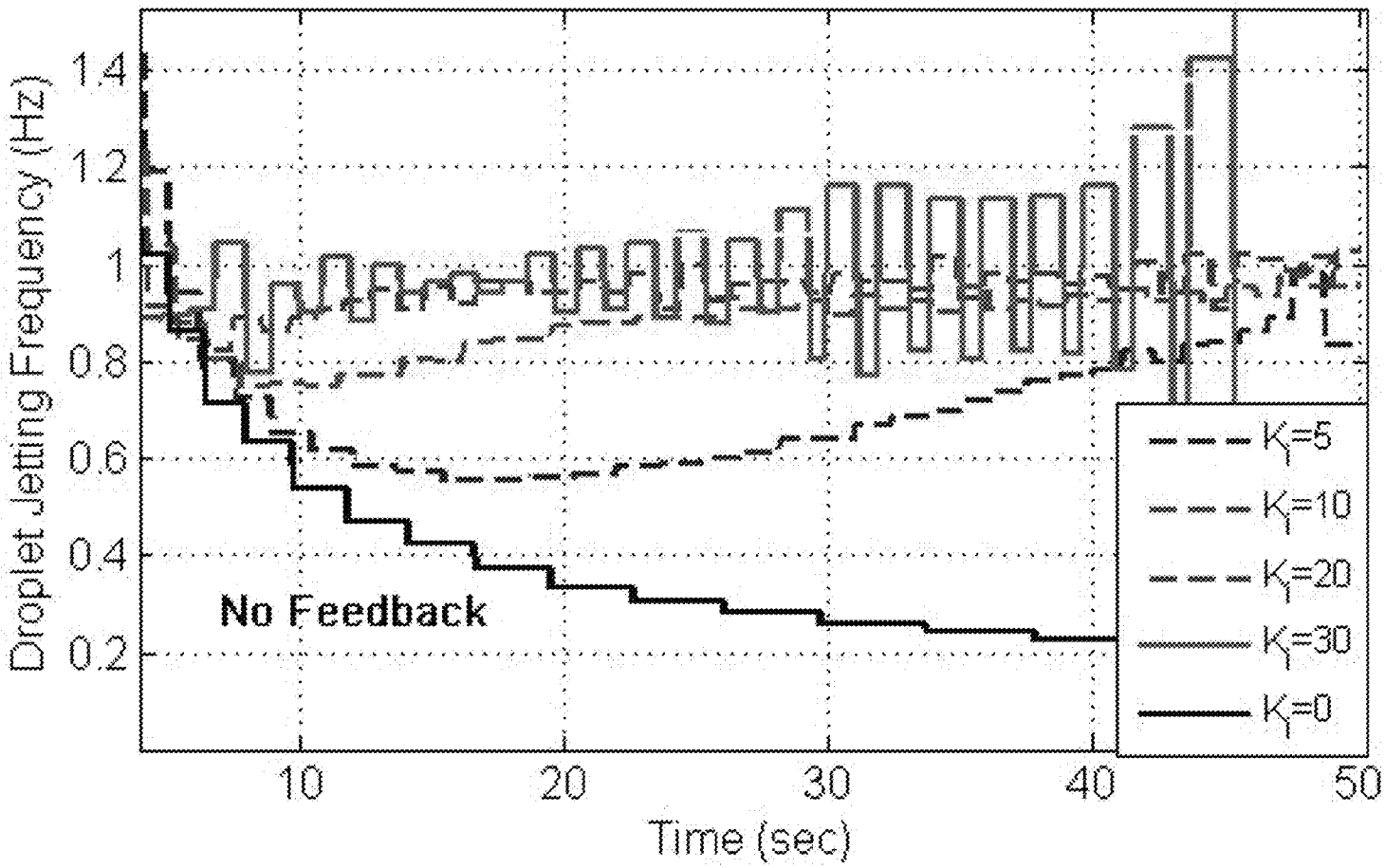
FIG. 13: Output frequency profiles for E-jet with an integral feedback controller, with varying integral gains ($K_i \in [0; 30]$ V/Hz).
Figure 14:
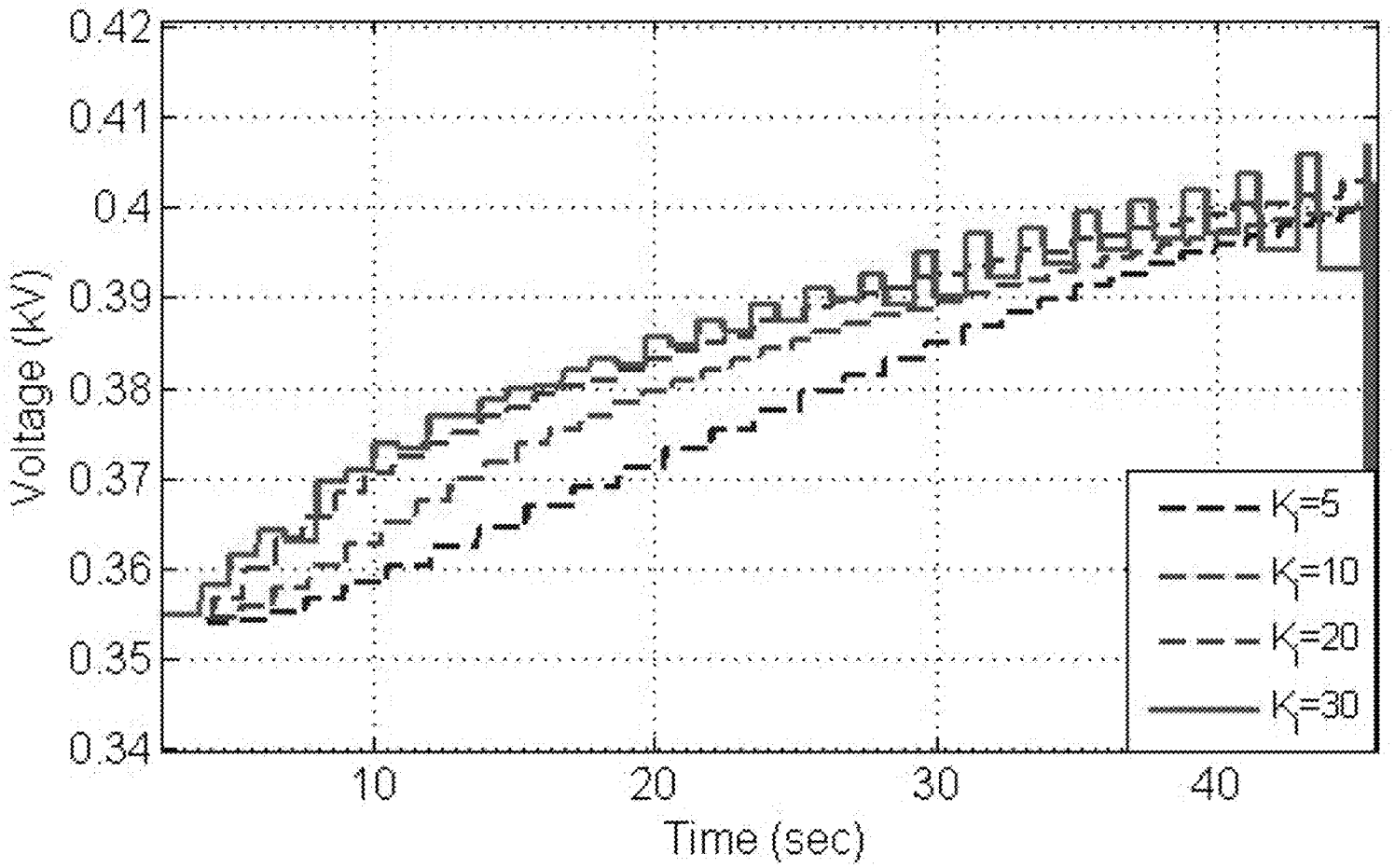
FIG. 14: Input voltage profiles for E-jet with an integral feedback controller, with varying integral gains ($K_i \in [0; 30]$ V/Hz).

Since a good model of the E-jet process is unavailable, the feedback integral control gain $K_i$ is tuned based on a series of experiments. The desired frequency $f_{des}$ is set at 1 Hz for these experiments. FIGS. 13 and 14 show the voltage and frequency profiles with varying control gain. For smaller values of $K_i$ ($K_i$=5 V/Hz), the convergence to the desired frequency is observed to be slow, while for larger $K_i$ faster convergence is obtained. However, there are increasing oscillations in the control input and finally for $K_i$=30 V/Hz the closed-loop system becomes unstable. Therefore, there exists a tradeoff between convergence speed and stability in the design of the integral control gain.

On closer examination of the voltage profile in FIG. 14, we see a trend of voltage increase over the time interval. Using the relationships from the process modeling from Section 4, this increase can be correlated to an increase in stand-off height (FIG. 9). This can be pre-compensated by using a feedforward control signal in addition to the feedback control signal, i.e. using a 2-DOF control system described in the following subsection. The advantage of using a feedforward signal is that there is no need for a large feedback control gain, resulting in fewer oscillations and a more stable system, while assuring good regulation of the jetting frequency.

5.2. Two-DOF Feedforward and Feedback Control: The variation of jetting frequency is primarily caused by two factors 1) change in stand-off height because of substrate tilt, and 2) changes in local jetting conditions. The frequency error due to substrate tilt is a large repeatable component that is present in every run of the jetting process. The error due to local jetting conditions is smaller but does not repeat from one run to the next. In a 2-DOF controller, the feedforward control signal is aimed at compensating the former, while the feedback component of the control system is designed to deal with the latter.

5.2.1. Iterative Learning Control: In order to find the ideal feedforward voltage profile to pre-compensate for change in substrate stand-off height, we implement an ILC algorithm for updating the feedforward voltage signal based on jetting frequency estimates from the previous runs of the process. An underlying assumption is that the operating conditions vary across a run but not from run-to-run. This may not always be true. However, when the primary source of frequency error is the tilt of the substrate, this assumption holds good. The optimal feedforward control signal is learned by running the jetting process in open-loop and iteratively refining the feedforward signal to get a small residual frequency error.

The frequency profile over a single run (j) is collected and stacked into a vector $f_j$. The frequency error for the $j^{th}$ run is defined as $e_{f,j}=f_{des}-f_j$. The feedforward voltage profile over the entire run is defined as $V_{ff,j}$ as shown below.

$$f_j=[f_j(1)f_j(2)f_j(3):::f_j(N)]^T \quad (3)$$

$$V_{ff,j}=[V_{ff,j}(1)V_{ff,j}(2)V_{ff,j}(3):::V_{ff,j}(N)]^T \quad (4)$$

A proportional-type ILC update law is used to update the voltage profile for the next iteration of the printing process, as shown in (5).

$$V_{ff,j+1}=V_{ff,j}+\gamma(f_{des}-f_j) \quad (5)$$

The choice of γ determines the convergence rate and stability of the ILC scheme. With a larger γ, we get faster convergence. However, when γ is too large the ILC algorithm may go unstable. For stability of the scheme, it is sufficient if $$0<\gamma<\frac{1}{\max_V\left(\frac{\partial f}{\partial V}\right)}. \quad (6)$$

The maximum value of df/dV can be determined from either substituting the physical parameters based on (1) or through experimental identification of the peak slope of the frequency-voltage curve shown in FIG. 11. The optimized feedforward control signal profile $V_{ff}$ is therefore obtained by running the learning algorithm to convergence within a bound.

5.2.2. Feedback and Feedforward Control: The 2-DOF controller combines the feedback control law of (2) with the optimized feedforward control signal found using the ILC algorithm defined in (5). As stated in the previous subsection, ILC is used to determine the pre-compensated voltage profile to minimize performance errors resulting from repetitive disturbances such as substrate tilt. Once the optimized feedforward signal has been identified, it can be included in the total voltage input signal along with feedback control. This 2-DOF control law is given by $$V_{tot}(k)=V_{ff}(k)+V_{fb}(k): \quad (7)$$

Figure 15:
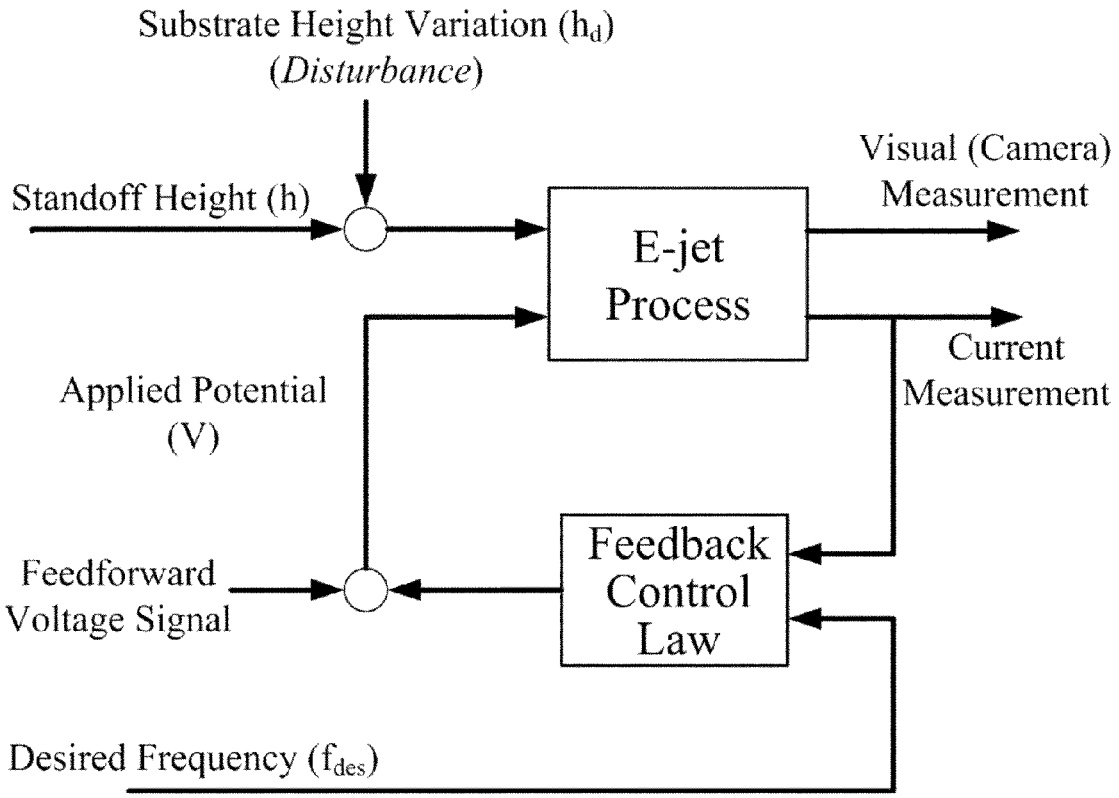
FIG. 15: Schematic of the E-jet printing process with current detection and run-to-run feedforward and feedback voltage control

The feedforward signal acts as the baseline voltage profile, while the feed-back signal acts as supplemental control to minimize short-term stochastic process variations. The addition of the feedforward signal decreases the feed-back gain required to optimize the jetting frequency since the large voltage increases due to the stand-off height are taken care of by the feedforward signal. FIG. 15 shows the schematic of the plant and 2-DOF control system.

6. RESULTS: The design objective in this example is to synchronize repetitive 1.5 mm movements in the negative Y-direction at a velocity of 30 μm/sec with a stable 1 Hz jetting mode. Using the process maps from Section 4, the idealized case of constant stand-off height and constant voltage potential should result in a constant jetting frequency. However, in practical applications, slight variations in the stand-off height as well as operating conditions result in changes to the jetting frequency and poor printing consistency. In an effort to improve the printing performance, the voltage difference between the tip and substrate is modulated via the 2-DOF control law described in the earlier sections to compensate for variations in the stand-off height and other printing conditions.

To validate the feasibility of controlling the E-jet printing process through current sensing and voltage modulation, the 2-DOF control scheme described in Section 5 is implemented on an experimental testbed. The motion control system comprises 5 physically connected axes (X,Y,Z,U,A), a substrate mount, a nozzle mount, and a camera for nozzle alignment and jetting visualization. While this system has motorized Z-axis and tilt stages U and A, one of the goals of the advanced sensing and control system is to remove the need for these expensive motorized stages. In order to simulate this situation, these three axes were locked at fixed values.

The electrical connection to the nozzle and substrate, along with the substrate-side measurement scheme, follows the set-up illustrated in FIG. 4. The measured current signal for a given run is detected online for feedback control, and processed off-line to determine jetting frequency information across the run for learning feedforward control. The jetting operating conditions are shown in Table 2.

The first step in the development of the control law is learning the optimal feedforward control signal for pre-compensating the effects of changing stand-off height. The learning law for the feedforward signal is implemented in open-loop operation. The ILC algorithm (5) uses the measured frequency error signal and the corresponding input voltage profile across an entire run to update the voltage signal for the subsequent run.

Figure 16:
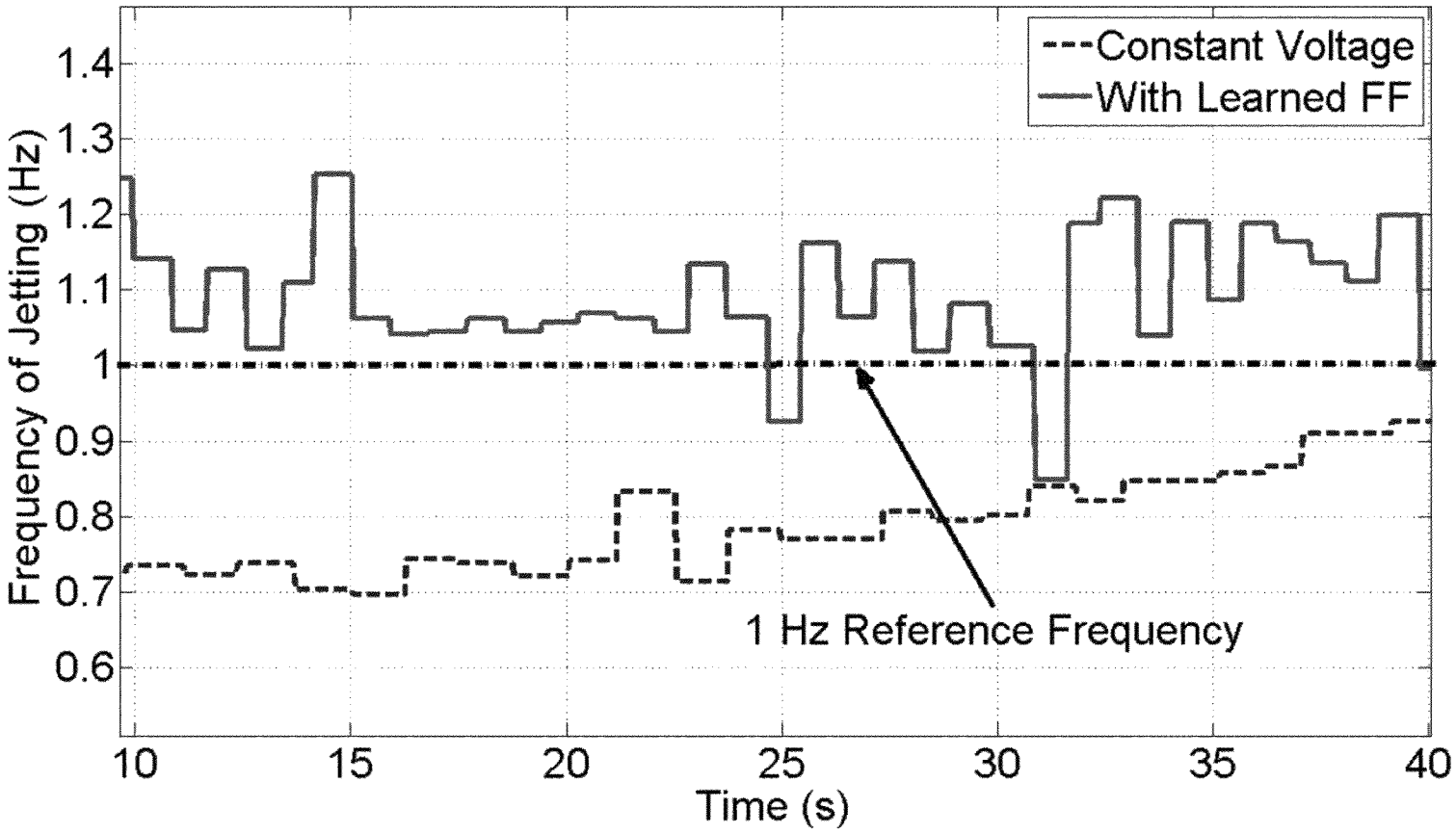
FIG. 16: Frequency of jetting versus time plots for constant voltage and learned feedforward voltage profiles.

The initial guess for the voltage profile is chosen to be a fixed voltage (394 V), which results in a jetting frequency of about 0.7 Hz at the beginning of the run and 0:92 Hz at the end of the run. FIG. 16 illustrates the performance improvement obtained from implementing the ILC update law for voltage modulation of the E-jet process.

Figure 17:
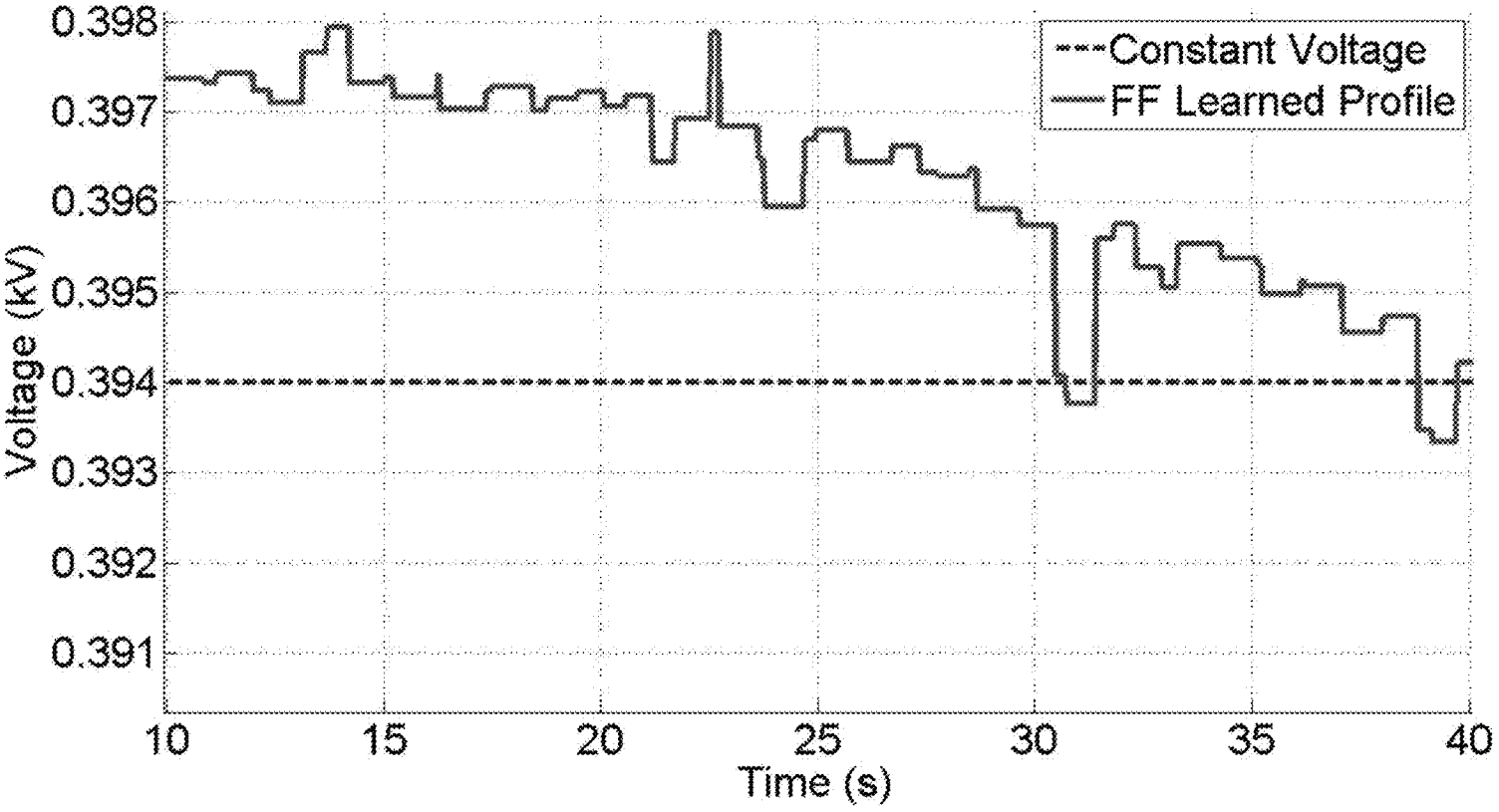
FIG. 17: Input voltage versus time plots for constant voltage and learned feedforward voltage profiles.

FIGS. 16 and 17 show the jetting frequency and input voltage versus time for the constant voltage and the learned profile cases. The initial iteration with a constant voltage input shows substantial variation in jetting frequency (FIG. 16) due to changes in the stand-off height and printing conditions. Using the ILC algorithm from (5) with a heuristically tuned control gain ($\gamma$=8) to ensure satisfaction of (6) and convergence over a reasonable number of iterations, the frequency error is minimized, as shown in FIG. 16. The corresponding learned feedforward voltage signal is illustrated in FIG. 17. The voltage profile is observed to be shaped so as to cancel the effect of the variation of substrate height (possibly due to tilts in the substrate).

Figure 18:
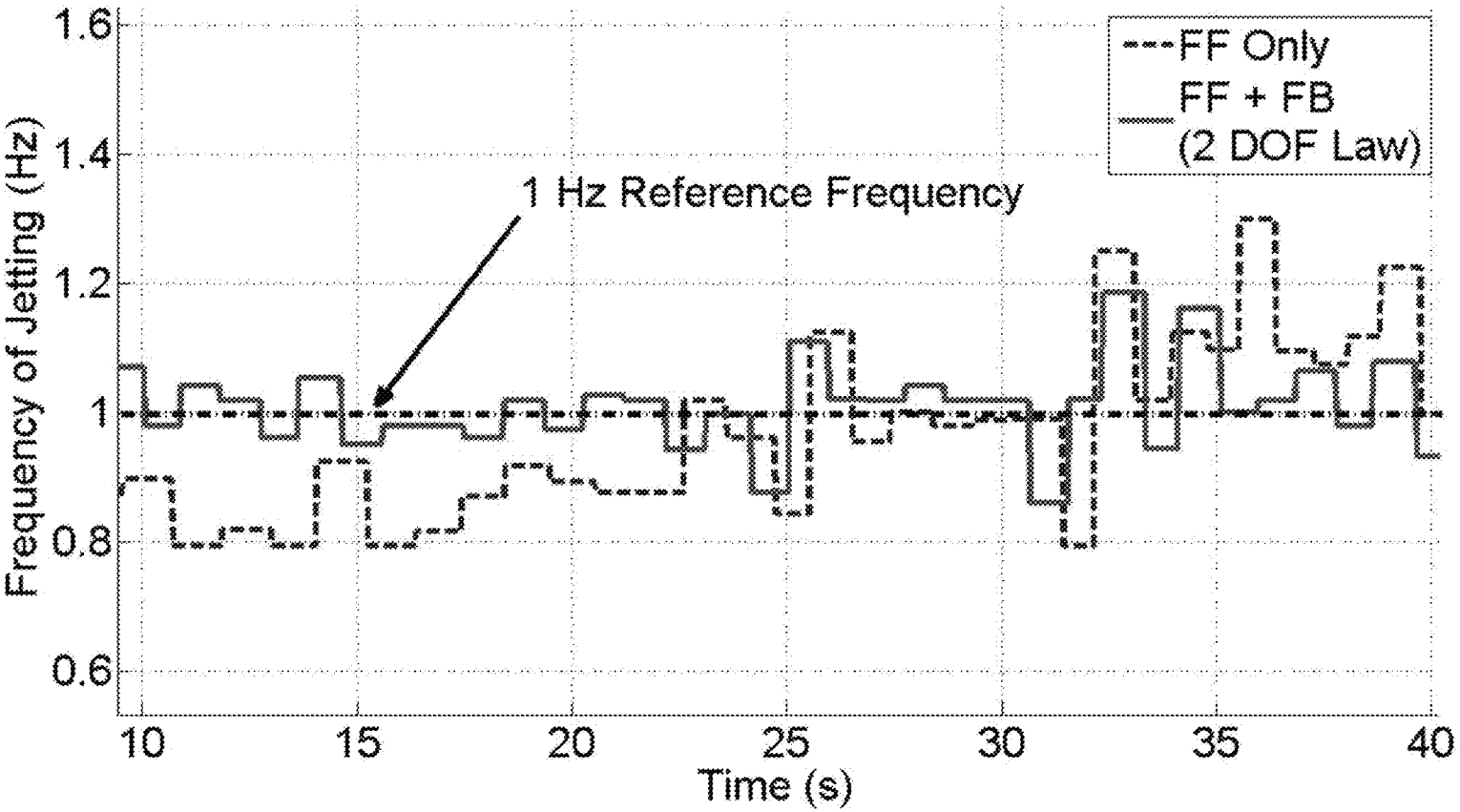
FIG. 18: Frequency profile versus time for feedforward and 2-DOF feedback-feedforward control laws.

While the learned feedforward control signal is able to remove repeatable changes in frequency from one run to the next, on using the same feedforward signal at a different starting location on the substrate, the performance is significantly degraded, as shown in FIG. 18. This is because of the non-repeatable variability in operating conditions from run to run. Therefore, the feedback control law described in (2) is implemented with an integral gain of 1 V/Hz in addition to the feedforward signal. The integral gain is chosen heuristically to ensure fast convergence, while maintaining system stability. Note that the addition of the feedforward signal results in the use a smaller integral gain for feedback control as compared to the gains used in FIGS. 13 and 14. This is due to a reduction in the error signal as a result of the removal of the repetitive errors.

Figure 19:
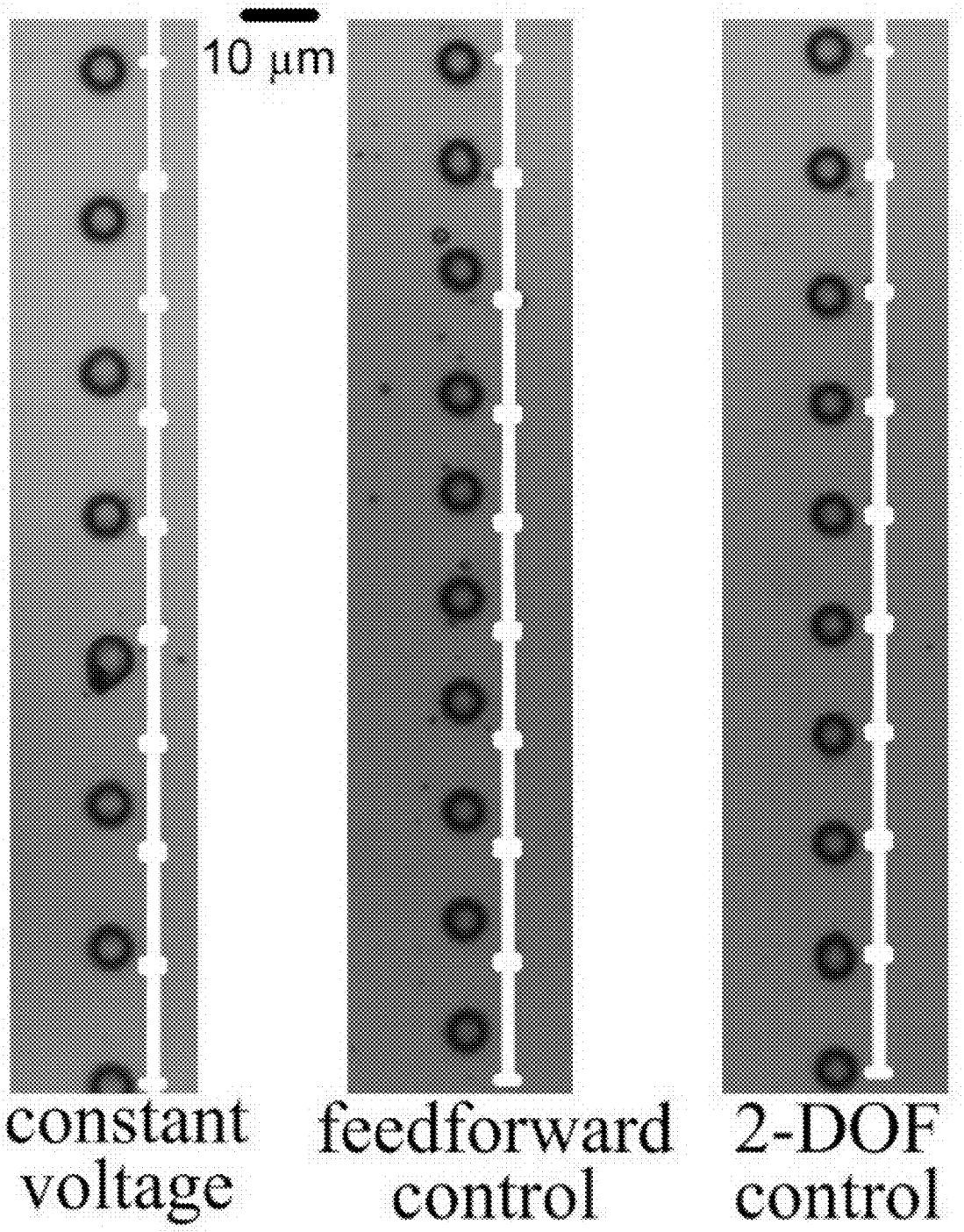
FIG. 19: Optical image of printed droplets for constant voltage, feedforward control and feedforward-feedback control. The white line on each image shows the optimized droplet placement for a 1 Hz printing frequency with the jetting parameters given in Table 1.

FIG. 18 shows the comparative performance of the open-loop feedforward controller versus that of the 2-DOF feedback-feedforward controller. Better printing consistency is obtained by using the feedback and feedforward controllers in conjunction (FIG. 18). FIG. 19 shows an optical image of the printed droplets for constant voltage, optimized feedforward control, and feedback-feedforward control. The white measuring template provided next to each line of droplets indicates the desired droplet placement for a 1 Hz printing frequency given the jetting parameters provided in Table 2. Using this measuring tool, FIG. 19 shows better placement and therefore better consistency with a 1 Hz jetting frequency for the 2-DOF control case. Table 3 shows a quantitative comparison of the three modes of operation: open-loop, feedforward, and 2-DOF control. We see that both the 2-Norm (root mean squared) and peak frequency errors are smallest for the 2-DOF case.

Figure 20:
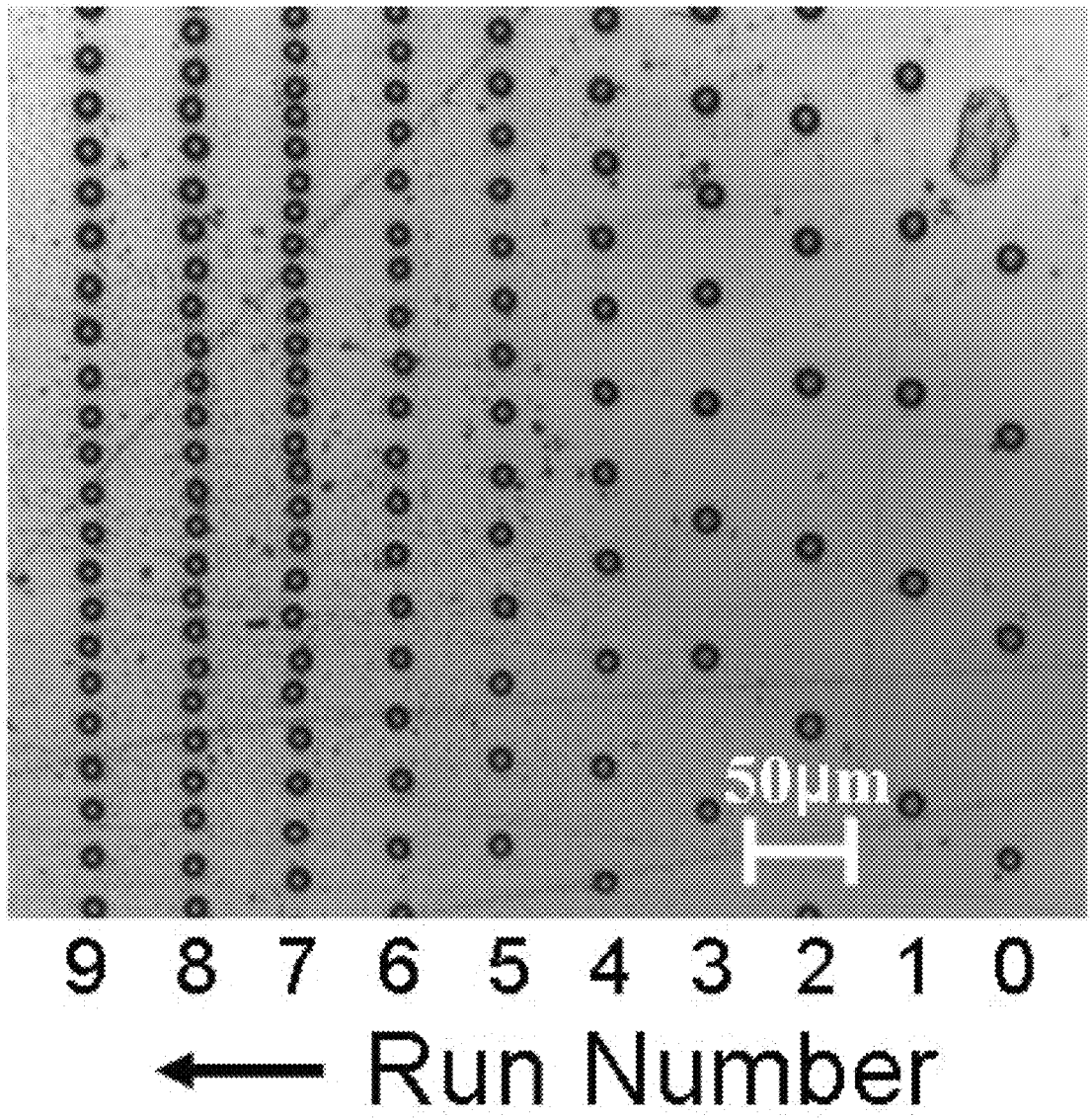
FIG. 20: Experimental printing results. Note the improvement in the jetting frequency from run 0 to run 9. The desired jetting frequency is 1 Hz.

FIG. 20 shows the improvement in the jetting frequency and consistency of the printed lines from each pass. The monotonic convergence behavior of the system can be visually verified in FIG. 20 from the noticeable increase in jetting frequency from run to run. Note that the printing performance in the last three runs appears to be very similar.

Sensing and control of nanomanufacturing processes is critical towards the integration of these processes into mainstream manufacturing systems. A major challenge in these systems is the inconsistency of operating conditions, leading to poor yield. E-jet printing is an emerging manufacturing technology that has potential in widespread applications. This example presents a sensing and control methodology for maintaining consistent jetting frequency for E-jet printing. In order to monitor the process, a novel current detection system with nanoampere resolution is designed. So far in literature, the E-jet process is monitored through vision-based systems, which are typically unable to provide real-time feedback without significant computation capability.

The system provided herein is used for online detection and stabilization of jetting frequency through a feedback-feedforward 2-DOF control system. The feedforward signal is obtained by using an ILC algorithm that used batch processing of the collected frequency profile from a run of the E-jet process to adjust the voltage profile in the next iteration. The feedback controller is an integral-type control law. Experimental results show that the variation in the jetting process can be substantially reduced by using the proposed 2-DOF control law. Since the primary source of this variation is variation in stand-off height, the disclosed method is able to obviate the need for motorized stages for controlling tilt and Z-axis stages that may have been necessary to ensure consistent stand-off height. As a result, we anticipate much better robustness of the E-jet process through feedback control without the need for expensive hardware systems.

References for Example 1

[1] P. Calvert, Inkjet printing for materials and devices, Chem. Mater. 13 (10) (2001) 3299-3305.

[2] J. Szczech, C. Megaridis, D. Gamota, J. Zhang, Fine-line conductor manufacturing using drop-on-demand pzt printing technology, IEEE Transactions on Electronics Packaging Manufacturing 25 (1) (2002) 26-33.

[3] J.-U. Park, M. Hardy, S. J. Kang, K. Barton, K. Adair, D. Mukhopadhyay, C. Y. Lee, M. S. Strano, A. G. Alleyne, J. G. Georgiadis, P. M. Ferreira, J. A. Rogers, High-resolution Electrohydrodynamic jet printing, Nature Materials 6 (2007) 782-789.

[4] S. Jayasinghe, Q. Qureshi, P. Eagles, Electrohydrodynamic jet processing: An advanced electric field-driven jetting phenomenon for processing living cells, Small 2 (2006) 216-219.

[5] D. Youn, S. Kim, Y. Yang, S. Lim, S. Kim, S. Ahn, H. Sim, S. Ryu, D. Shin, J. Yoo, Electrohydrodynamic micropatterning of silver ink using near field electrohydrodynamic jet printing with tilted-outlet nozzle, Applied Physics A 96 (2009) 933-938.

[6] K. Wang, M. Paine, J. Stark, Fully voltage-controlled electrohydrodynamic jet printing of conductive silver tracks with a sub 100 μm linewidth, Journal of Applied Physics 106 (2009) 0249071-0249074.

[7] E. D. Castillo, A. M. Hurwitz, Run-to-run process control: Literature review and extensions, Journal of Quality Technology 29 (2) (1997) 184-196.

[8] S. Arimoto, S. Kawamura, F. Miyazaki, Bettering operation of robots by learning, J. of Robotic Systems 1 (2) (1984) 123-140.

[9] M. Uchiyama, Formulation of high-speed motion pattern of a mechanical arm by trial, Trans. SICE (Soc. Instrum. Contr. Eng.) 14 (6) (1978) 706-712 (in Japanese).

[10] K. Moore, M. Dahleh, S. Bhattacharyya, Learning control for robotics, in: Proceedings of 1988 International Conference on Communications and Control, Baton Rouge, La., 1988, pp. 976-987.

[11] Y. Chen, J.-X. Xu, T. H. Lee, S. Yamamoto, An iterative learning control in rapid thermal processing, in: Proc. the IASTED Int. Conf. on Modeling, Simulation and Optimization (MSO'97), Singapore, 1997, pp. 189-92.

[12] S. Mishra, M. Tomizuka, Precision positioning of wafer scanners: An application of segmented iterative learning control, Control Systems Magazine 27 (4) (2007) 20-25.

[13] D. Bristow, A. Alleyne, A high precision motion control system with application to microscale robotic deposition, IEEE Trans. on Control Systems Technology 26 (3) (2006) 96-114.

[14] H.-S. Ahn, Y. Chen, K. Moore, Iterative learning control: Brief survey and categorization, Systems, Man, and Cybernetics, Part C: Applications and Reviews, IEEE Transactions on 37 (6) (2007) 1099-1121. doi:10.1109/TSMCC.2007.905759.

[15] D. Bristow, M. Tharayil, A. Alleyne, A survey of iterative learning control, Control Systems Magazine, IEEE 26 (3) (2006) 96-114. doi:10.1109/MCS.2006.1636313.

[16] H. K. Choi, J.-U. Park, O. O. Park, P. M. Ferreira, J. G. Georgiadis, J. A. Rogers, Scaling laws for jet pulsations associated with high-resolution electrohydrodynamic printing, Applied Physics Letters 92 (12) (2008) 123109. doi:10.1063/1.2903700. URL http://link.aip.org/link/?APL/92/123109/1

Example 2

High Speed Drop-On-Demand E-Jet Printing

We present a pulsed DC voltage printing regime for high-speed, high-resolution, and high-precision Electrohydrodynamic jet (E-jet) printing (see also Mishra et al., "High Speed Drop-on-Demand Printing with a Pulsed Electrohydrodynamic Jet." J. of Micromechanics and Microengineering 20, Aug. 2010, Pages 095026:1-8). The voltage pulse peak induces a very fast E-jetting mode from the nozzle for a short duration, while a baseline DC voltage is selected to ensure that the meniscus is always deformed to nearly a conical shape but not in a jetting mode. The duration of the pulse determines the volume of the droplet and therefore the feature size on the substrate. The droplet deposition rate is controlled by the time interval between two successive pulses. Through a suitable choice of the pulse width and frequency, a jet-printing regime with specified droplet size and droplet spacing is obtained. Further, by properly coordinating the pulsing with positioning commands, high spatial resolution is achieved. We demonstrate high-speed printing capabilities at 1 kHz with drop-on-demand and registration capabilities with 3-5 μm droplet size for an aqueous ink and 1-2 μm for a photo-curable polymer ink.

Jet printing-based manufacturing processes at the nano- and micro-scales have been the target of much research because of the ability to generate very small-scale droplets. Examples of jet printing include the now ubiquitous ink-jet printing using thermal and piezo-excitation, and E-jet printing. Among these, E-jet printing has demonstrated superior resolution, printing of micron and sub-micron scale droplets using a wide variety of inks [1, 2, 3, 4]. However, the speed of the process and its ability to produce uniform printing quality have been cited as impediments, as pointed out in a review on E-jet [5].

Because of the ability to print high resolution droplets and lines with a range of inks, E-jet printing has shown tremendous promise for applications such as printing metallic (Ag) interconnects for printed electronics [2], bio-sensors [1, 4]. As the advantages of E-jet printing become more apparent (e.g. the potential for purely additive operations, the ability to directly print biological materials, maskless lithography), additional features like drop-on-demand functionality and the ability to precisely control droplet sizes become necessary. Further, enhanced process controls to independently regulate process outputs such as droplet size and delivery frequency become critical. Finally, as with any manufacturing process, throughput rates (in this case, printing speeds) and process robustness are key decision parameters in the adoption of the process. Therefore, to fully realize the capability of the E-jet printing process, this example demonstrates how to exploit input voltage modulation to enhance droplet deposition rates, obtain consistent droplet volume, and accurate spatial placement of droplets.

E-jet printing uses electric-field induced fluid flows through fine micro capillary nozzles to create devices in the micro- and nano-scale range[1]. Typically, these electric fields are created by establishing a constant voltage difference between the nozzle carrying the ink (the print head) and the print substrate. The electric field attracts ions in the fluid towards the substrate, deforming the meniscus to a conical shape and eventually leading to instability that results in droplet release from the apex of the cone [1, 6]. Electrohydrodynamic discharge from a nozzle results naturally in a pulsed flow. This was exploited by Chen [9] to accurately place drops. Juraschek and Rollgen [7] reported that this pulsing persists in the spray regime reporting both low-frequency 10 Hz and high-frequency 1 kHz pulsations in an electrohydrodynamic spray. To exploit this natural pulsation, Chen et al [9] and Choi et al [8] have developed scaling laws for characterizing E-jet. Until now, high-resolution Ejet printing has used this natural pulsation and is therefore limited by the natural pulsating frequency of the aforementioned discharge, which has substantial variability. To overcome this limitation, Kim et al [10] suggested the use of a piezoelectric excitation of the nozzle tip (hybrid jet printing) along with electric field induced jetting. AC pulsing has been demonstrated for E-jet by Nyugen et al [11]. AC modulation showed advantages over DC voltage in terms of fabrication of nozzles, droplet repulsion, and drop on demand capabilities based on the frequency of sinusoidal voltage applied. Kim et al [12] used a square wave (DC) for E-jet printing and used the amplitude of the voltage to control droplet size. Stachewicz et al [13] demonstrated single-event pulsed droplet generation for E-jet, as well as a study of relaxation times for drop on demand Electrospraying [14].

In all the above, the droplet diameters and pulse frequencies have been limited to larger than 50 μm and printing frequencies of 25 Hz. Further, to the best of our knowledge, no systematically controlled high-speed printing regimes have been developed for delivering precise droplet volumes with high fidelity spatial and temporal resolution. This example presents a manufacturing oriented approach to pulsed input voltage E-jet printing including: 1) high speed printing, 2) high resolution printing, and 3) a well-documented recipe for shaping the pulse signal.

In this example, we present an E-jet printing mode capable of high speeds and independent control of droplet size and printing frequency. Specifically, this mode demonstrates capability for printing speeds of 1000 droplets per second (e.g., 1 kHz printing speed), while producing consistent and controllable droplet sizes of 3-6 μm. This mode uses a pulsed voltage signal to generate Electrohydrodynamic flow from the nozzle. The pulse peak is chosen so as to induce a very fast E-jetting mode from the nozzle, while the baseline voltage is picked to ensure that a near conical shaped meniscus is always present, but not discharging any fluid. The duration of the pulse determines the volume of the droplet and therefore the feature size on the substrate. On the other hand, the droplet deposition rate is controlled by varying the time interval between two successive pulses. Through suitable choice of the pulse width and frequency, a jet-printing regime with specified feature size and deposition rate can be created.

The rest of the example is organized as follows. Section 2 provides an introduction to the E-jet printing process. Section 3 then discusses a novel voltage modulation scheme for delivering high-speed high-resolution E-jet printing capabilities. A design recipe for determining the parameters for this scheme is described in Section 4. Section 5 describes the experimental E-jet printing testbed. Sections 6 and 7 demonstrate high-speed printing and drop-on-demand printing capabilities of the voltage modulated printing regime. Finally, in Section 8 the contribution of this paper is summarized.

2. Electrohydrodynamic Jet Printing: FIG. 2A presents a schematic of the E-jet printing process. FIG. 2B illustrates the various sensing and control features used with the E-jet printing process of FIG. 2A.

A voltage applied to the nozzle tip causes mobile ions in the ink (e.g., printable fluid) to accumulate near the surface at the tip of the nozzle. The mutual Coulomb repulsion between the ions introduces a tangential stress on the liquid surface, thereby deforming the meniscus into a conical shape [1]. At some point, the electrostatic stress overcomes the surface tension of the meniscus and droplets eject from the cone. FIG. 3 illustrates the change in the ink meniscus due to an increase in voltage. Depending on the fluid properties, as the applied field is increased this discharge begins as a pulsed or intermittent jet (pre-jet modes) transitioning into a stable single jet, multiple unstable jets, and finally becoming a spray for very large electric field strengths. Each of the different jetting modes (e.g. pulsating, stable jet, E-spray [15]) can be used to achieve various printing/spraying applications. Pre-jet modes are typically used for printing because of better controllability at high speeds.

Changes in back pressure, stand-off height, and applied voltage or current affect the size and frequency of the droplets. This sensitivity of the process output to variations in the printing conditions requires high-resolution sensing and control in order to achieve stable and predictable printing results.

3. Voltage Modulation in E-jet Printing: Typically, the jet frequency and droplet diameter are controlled by changing the applied voltage difference across the tip and the substrate. From a process development point of view, this has significant disadvantages. First, for a given nozzle diameter, printing ink and stand-off height (distance of the nozzle tip from the substrate), the droplet diameter on the surface (D) and jetting frequency (f) are coupled. Scaling laws from Choi et al [8] capture this dependence with the following equations:

$$f = \frac{E^{\frac{3}{2}}}{d_N} \text{ and } d = \frac{\sqrt{E}}{d_N} \tag{1}$$

$$D = dF(\theta) \tag{2}$$

where $d_N$ is the anchoring radius of the meniscus, d is the droplet diameter of the ejected droplet, E is the electric field because of the applied potential, and e is the contact angle at the surface; $F(\theta)$ is a function of the contact angle $\theta$. As can be seen from the above equations, one can set a voltage level to either obtain a desired droplet diameter or a printing speed (droplets/sec), but not both. The second disadvantage associated with printing by setting a constant voltage different between the tip and substrate accrues from the fact that minute changes in the stand-off height (for example, because of small misalignments or errors associated with the motion stage) can cause significant changes in the jetting frequency and droplet diameters.

With a sufficiently high potential difference, very fast jetting frequencies of several kHz can be achieved. However, at the resulting strong electric field, the system becomes more sensitive to variations in operating conditions such as stand-off height, meniscus wetting properties, etc. and the jetting frequency may vary substantially during printing, leading to inconsistent droplet spacing. Therefore, constant high-voltage E-jetting is unsuitable for printing large droplet arrays with regular droplet diameters and consistent droplet spacing (as might be required in a DNA microarray, for example). At the same time, low-voltage E-jetting results in slow printing speeds (with droplet deposition rates of 1-5 drops per second).

Figure 21:
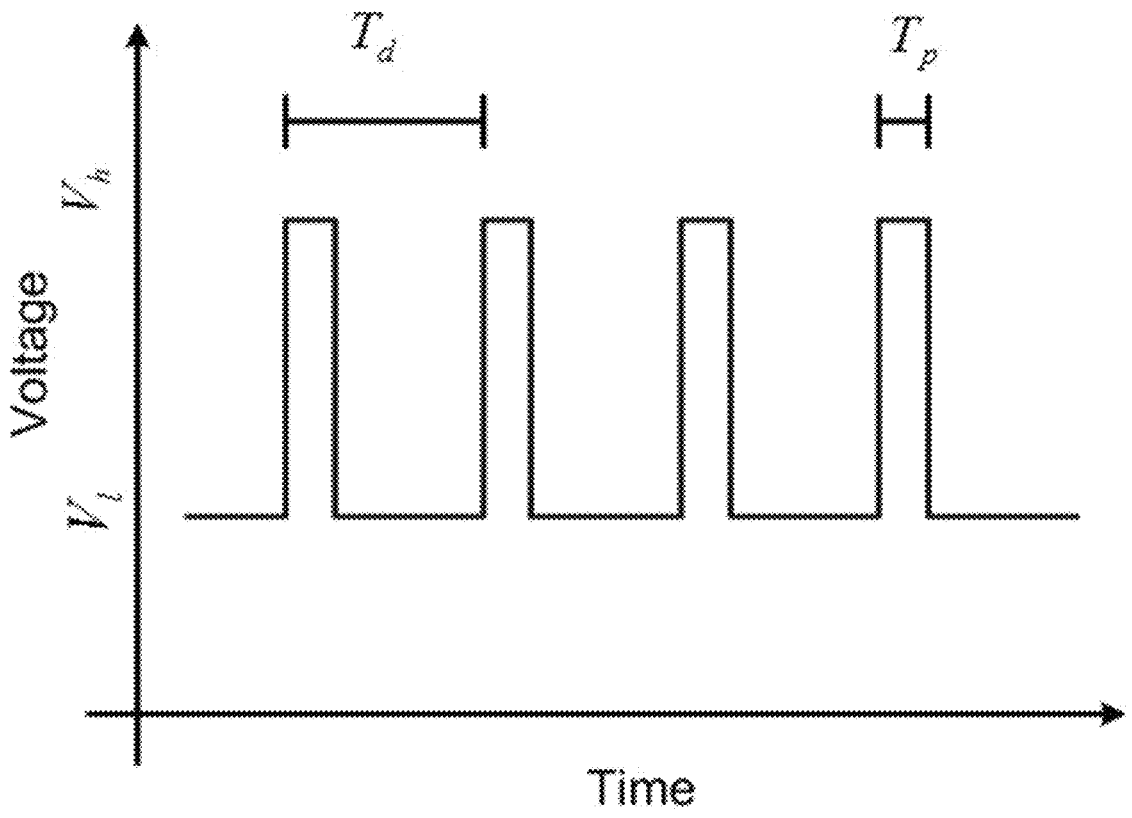
FIG. 21: Schematic time plot of voltage profile for pulsed E-jet. $T_d$ denotes the time between successive pulses while $T_p$ denotes the pulse width. $V_h$ and $V_l$ are the high and low voltages respectively.
Figure 38:
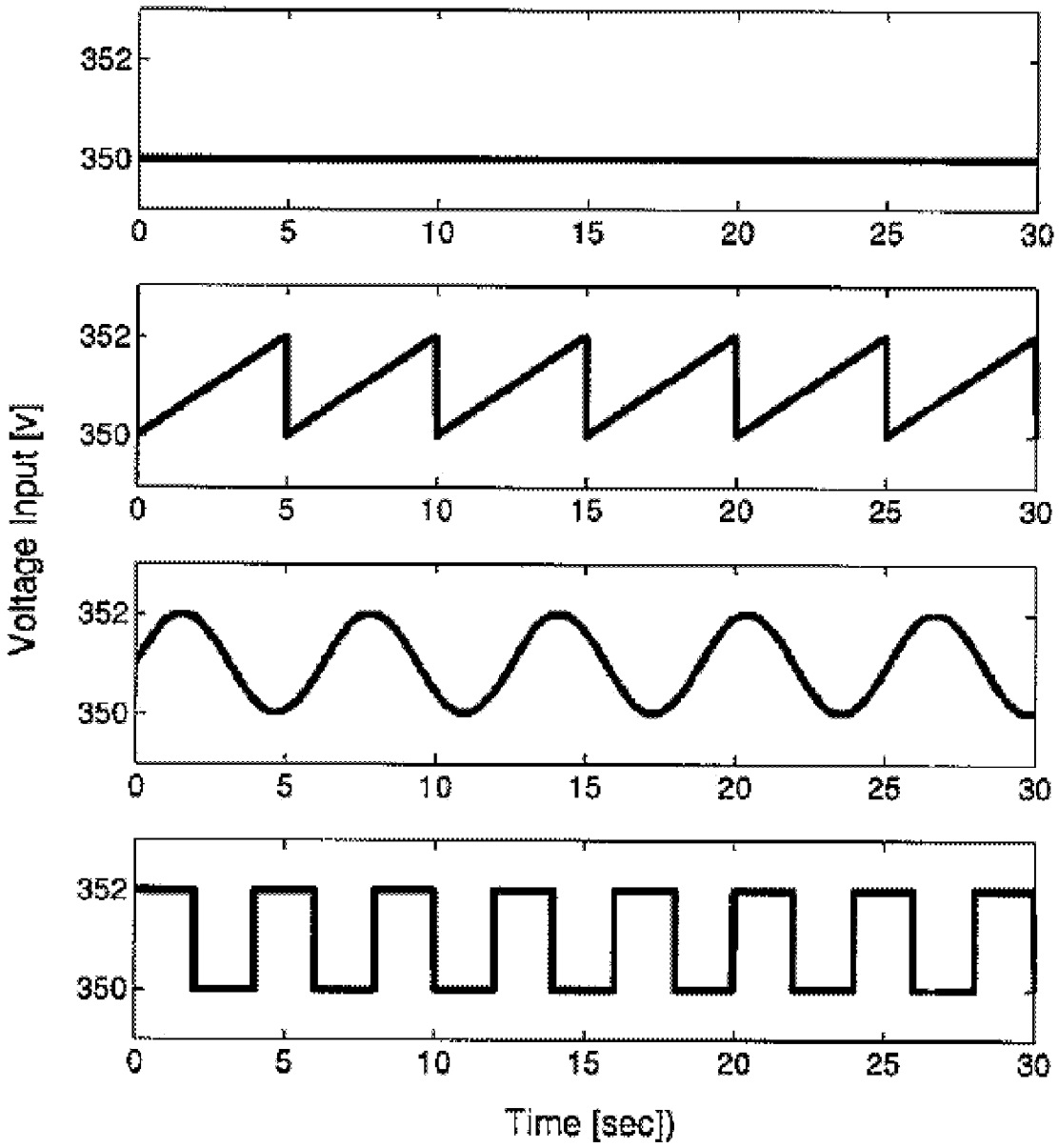
FIG. 38 illustrates exemplary shaped pulse embodiments of an electrical parameter such as current or voltage input to the E-jet printing system.

To overcome these limitations, we use a short-time high voltage pulse superimposed over a lower baseline constant voltage. The short high-voltage pulse releases a droplet (or a finite number of droplets) from the nozzle, while the lower constant voltage holds the charge in the meniscus. FIG. 21 shows the time plot of a typical pulse. Exemplary pulse shapes are illustrated in FIG. 38. The duration of the pulse controls the number of droplets released. These droplets coalesce and form a larger droplet on the substrate surface. Hence the volume of fluid deposited on the substrate is controlled by the number of droplets released per high voltage pulse and consequently, the duration of this pulse. On the other hand, the time between two pulses (pulse spacing or pulse frequency) determines the time or (for constant velocity motion of the stage) distance(s) between successive droplets on the substrate.

The baseline voltage must be chosen such that there is no jetting at that voltage; however it must be large enough to ensure that the Taylor Cone [16] is formed and maintained at the tip of the micro capillary nozzle. On the other hand, the pulse peak voltage $V_h$ is chosen such that it results in a very fast natural jetting mode with a frequency of jetting given by $f_h$. By adjusting the pulse peak voltage to a large enough value, it is possible to get $f_h$ of the order of 10-50 kHz for most printable fluids/inks [1, 9].

3.1. Pulse Spacing $T_d$: The pulse spacing $T_d$ directly controls the droplet spacing on the substrate. This is because the distance between droplets can be changed by adjusting the time between successive pulses and the speed of movement ($w_{st}$) of the substrate with respect to the nozzle tip. The droplet spacing is given by $s_d = w_{st}T_d$.

Figure 22:
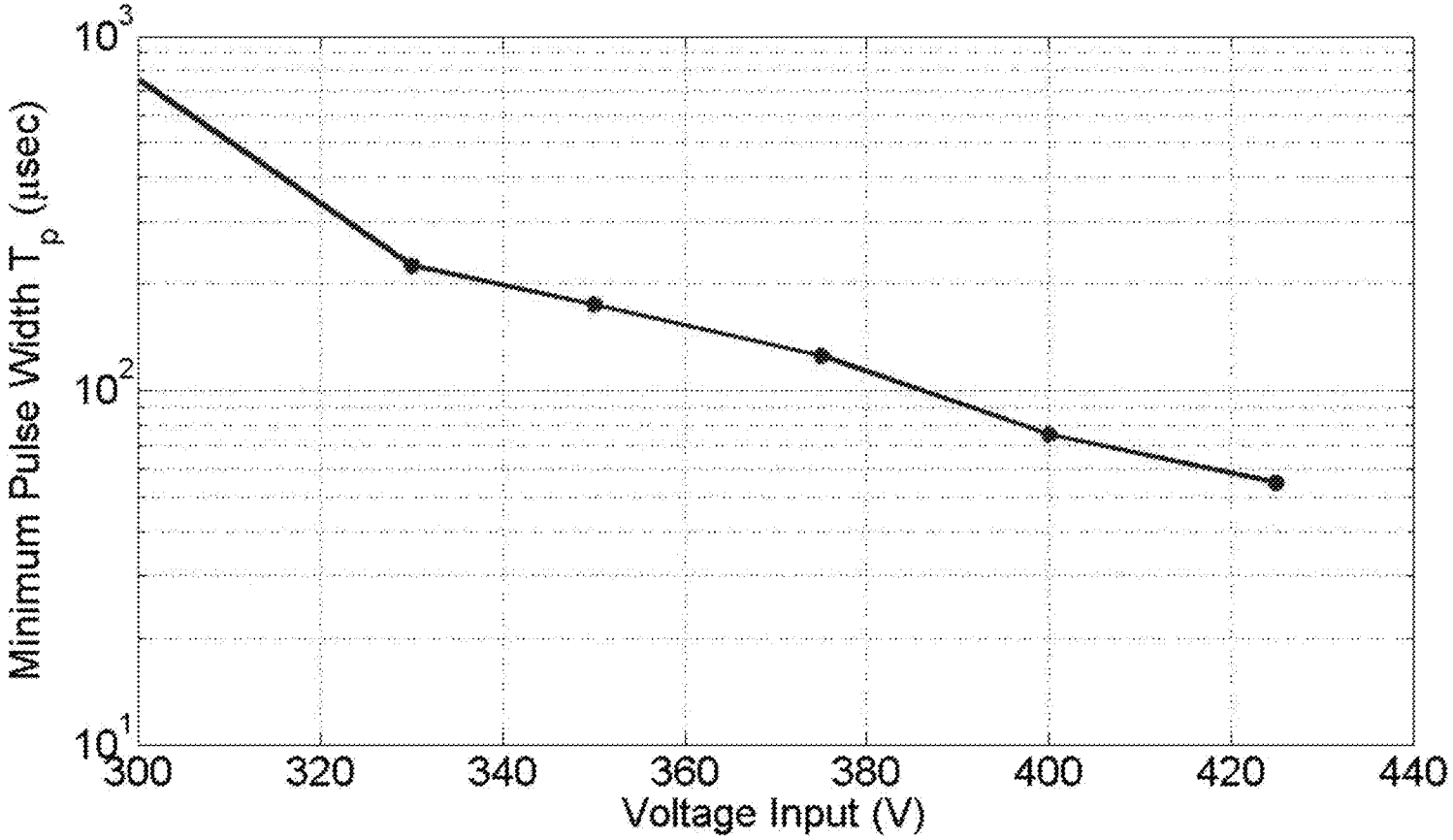
FIG. 22: Plot of minimum pulse width $T_p$ against input voltage $V_h$ for a polyurethane polymer ink. For larger voltages, we can obtain droplet ejection for smaller pulse widths. For $V_h$=425 V, we obtain $f_h$>18 kHz.

3.2. Pulse Width $T_p$: Assuming a hemispherical droplet of D on the surface of the substrate, we have (for $f_h T_p > 2$)

$$f_h v_h T_p = \frac{\pi}{12} D^3 \quad (3)$$

where $V_h$ is the volume of a single droplet released from the nozzle and $T_p$ is the pulse width. Given a fixed $V_h$ (pulse peak), $f_h$ and $v_h$ are fixed. Therefore we can control the diameter of the deposited droplets by changing the pulse width $T_p$. Further, the size of these 'aggregated' droplets is more uniform than each individual discharged droplet because of the averaging effect. For a small enough pulse width, there may be no droplet released from the tip because of the time delay in formation of the meniscus and ejection of the droplet. This minimum possible $T_p$ is dependent on the choice of $V_h$ (See FIG. 28 for an example of a recorded input voltage pulse and the resulting current signal). FIG. 22 shows a plot of this relationship for a photo-curable polyurethane polymer (Norland Optical Adhesive NOA 73).

Therefore, by adjusting Tp and Td we can fix the desired droplet diameter and spacing independently.

4. Design Recipe: In this section, we algorithmically describe how the input parameters, specifically the pulse modulation parameters $V_h$; $V_l$; $T_p$, and $T_d$ are determined, based on output requirements of the printing process, such as droplet spacing and droplet (feature) size.

(i) Set process parameters: Ink type, substrate type, back pressure (psi), and nozzle diameter. Typically, the nozzle diameter is chosen to be between 2-5 times the desired droplet diameter, while the back pressure is chosen so that it holds a spherical meniscus at the nozzle tip.

(ii) Set $V_l$ to be 5-10 volts less than initial voltage required to release a single droplet. (This voltage to release a droplet can be arrived at by gradually raising the voltage until the first drop is released from the nozzle).

(iii) Determine substrate velocity (fastest possible, subject to motion stage hardware constraints) $w_{st}$.

(iv) Determine time between pulses as $T_d = S_d / w_{st}$, where $s_d$ is the desired spacing between droplets.

(v) Evaluate potential $V_h$ range so that: (a) $V_h$ is significantly less than spraying, unstable jetting or arcing voltage; (b) $V_h$ is greater than voltage that results in a jetting frequency of $f_{h;min}$ which satisfies $f_{h;min} T_d > 2$.

(vi) Choose $V_h$ to be as large as possible without violating (a) above. Determine pulse width $T_p$ to ensure desired droplet diameter D, based on Eq. (2).

5. System Description: To validate the feasibility of both the high-speed and drop-on-demand E-jet printing process, the design scheme described in the previous section is implemented on an experimental E-jet printing testbed. Table 4 describes the hardware components of the system.

The motion control system comprises 5 physically connected axes (X,Y,Z,U,A), a substrate mount, a nozzle mount, and a camera for nozzle alignment and jetting visualization. The translational motion of the substrate is controlled through the X,Y axes, while the pitch and yaw are fixed through the U,A axes. The electrical connection to the nozzle and substrate, along with the substrate-side measurement scheme, follows the set-up illustrated in FIG. 4. The measured current signal is detected online and processed off-line to determine jetting information. The printing is performed on a glass slide substrate coated with Au for conductivity. No other post-processing of the substrate is performed. The stand-off height for printing is set at 30 μm along the Z axis. The effect of the stand-off height is further addressed in [8]. The power supply is bipolar; however, for this example, we use positive polarity of the nozzle for demonstrating printing.

Printing results are provided for (a) High speed printing, and (b) Drop-on-demand printing in the following sections.

Figure 23:
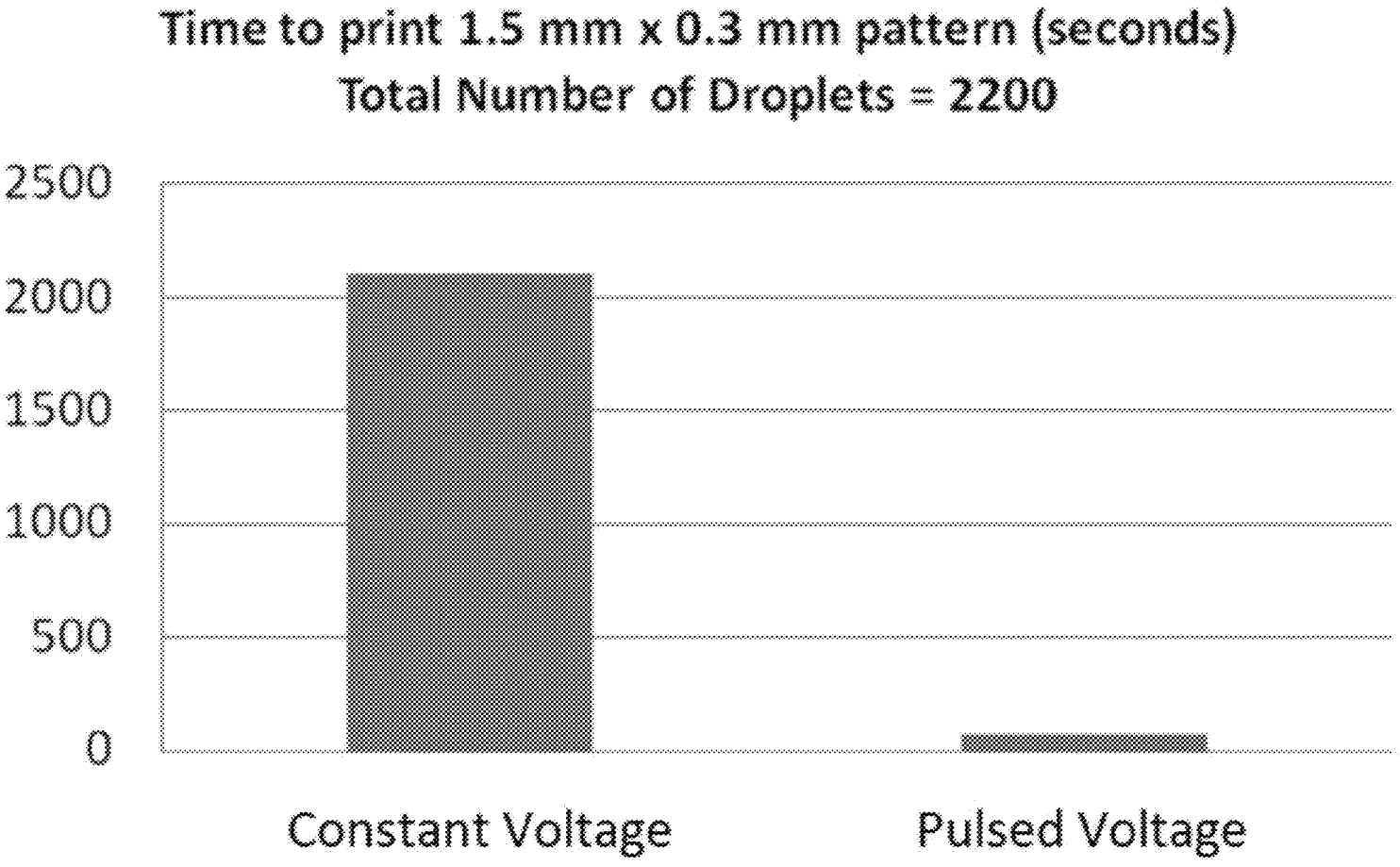
FIG. 23: Chart showing printing times for 1.5 mm by 0.3 mm pattern using constant voltage jet printing mode and pulsed voltage printing jet mode. Pulsed voltage printing requires 70 seconds, while constant voltage jet printing requires 2200 seconds.
Figure 24A:
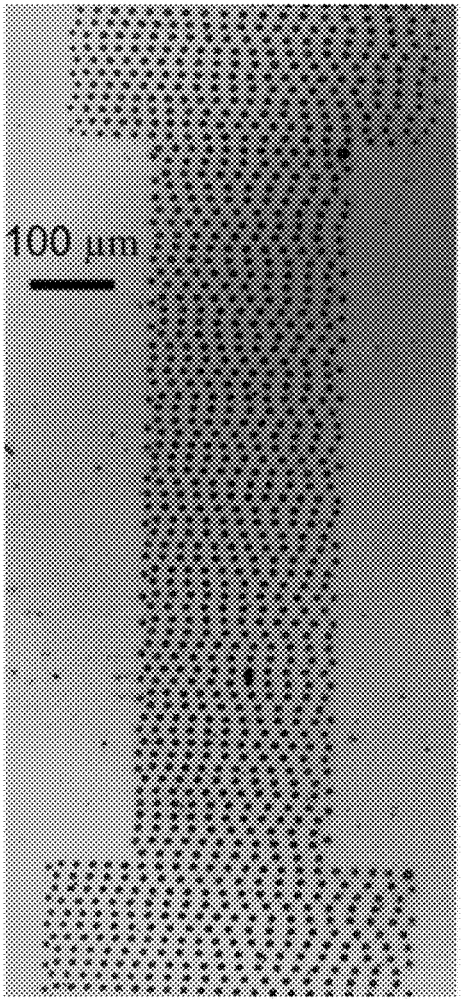
FIG. 24A Printed pattern using constant voltage jetting (5 μm capillary, phosphate buffer solution with 10% Glycerol (vol.)). Total area=0.3 mm×1.5 mm.
Figure 24B:
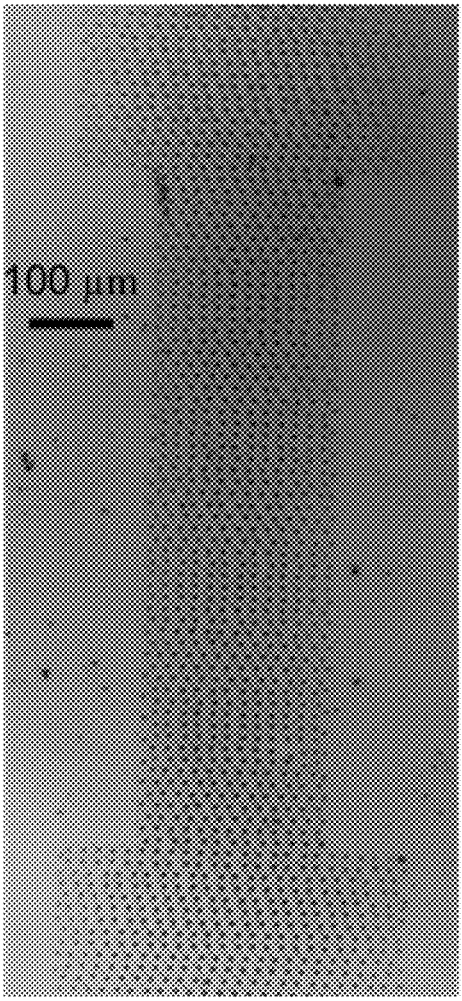
FIG. 24B Printed pattern using pulsed voltage jetting (5 μm capillary, phosphate buffer solution with 10% Glycerol (vol.)). 0.3 mm×1.5 mm. Printing with constant jetting results in irregular droplet spacing and size and requires 2200 seconds. Printing with pulsed jetting results in regular droplet spacing, consistent droplet sizes and is completed in 70 seconds (see, e.g., FIG. 23). Typical droplet diameter is 3 μm.

6. High Speed Printing Results: Pulsed E-jet printing can significantly enhance printing speeds (droplet deposition rate). Typically in constant jet mode printing applications, jetting frequencies are around 1-5 droplets per second [1]. A graphics art rendered pattern 1.5 mm by 0.3 mm is used as a basis for comparison of printing speeds for constant voltage and pulsed voltage E-jet printing. The constant voltage printing is executed at 1 droplet per second jetting frequency and requires≈2200 seconds for printing. On the other hand, pulsed jetting at 60 droplets per second prints the pattern in 70 seconds (FIG. 23). FIG. 24 shows optical micrographs of the printed patterns obtained from the two printing methods. The printing time is cut down by a factor of 30 using the pulsed mode operation. The droplet placement accuracy using the pulsed mode operation is critically dependent on the synchronization of the stage movement and the voltage pulsing. This is the source of the irregular droplet alignment from one raster to the next in FIG. 24.

Figure 25:
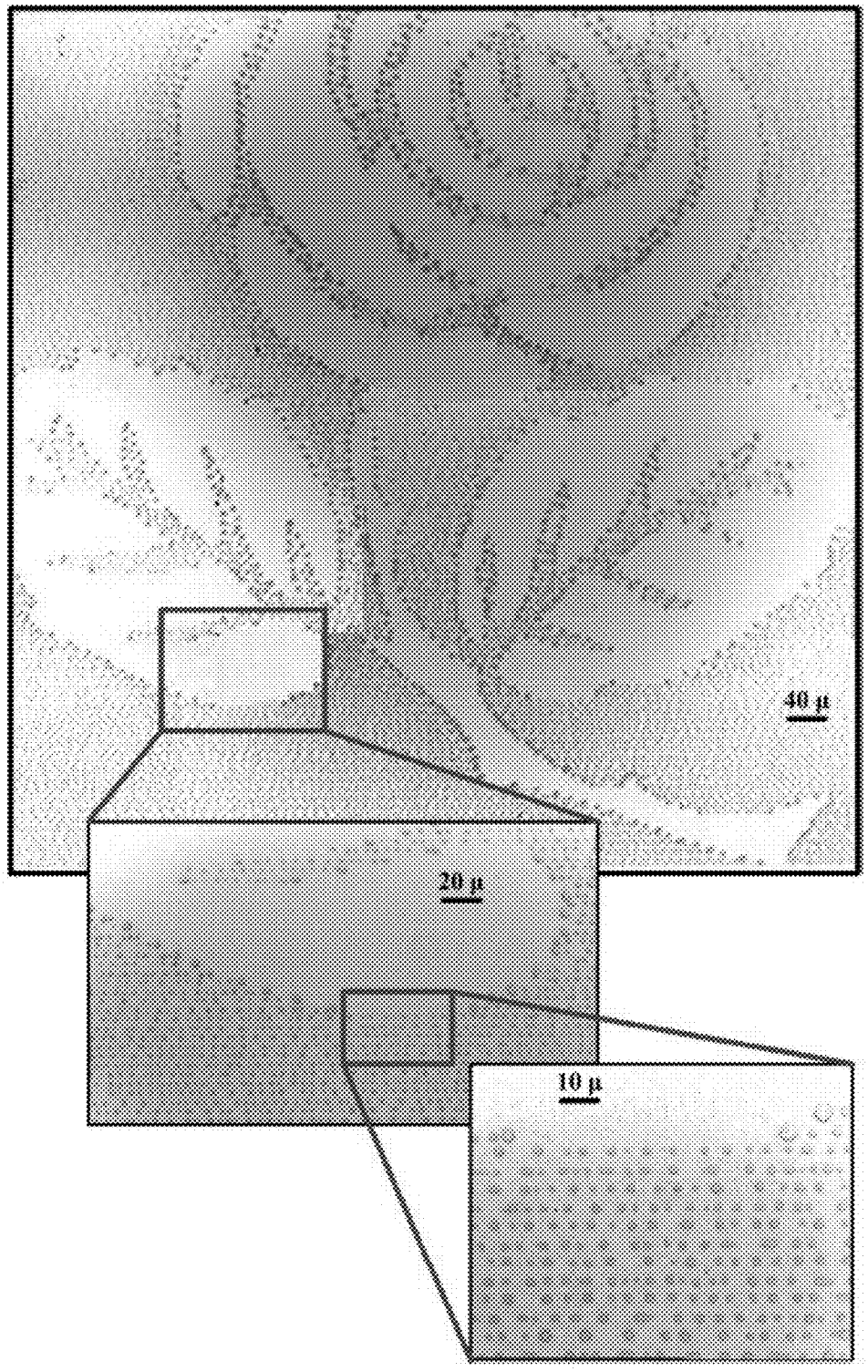
FIG. 25: Printed Pattern using NOA 73 (Photocurable Polyurethane Polymer) at 1 kHz printing frequency using a 2 μm ID capillary nozzle. The droplet diameter varies from 1-2 μm.
Figure 26:
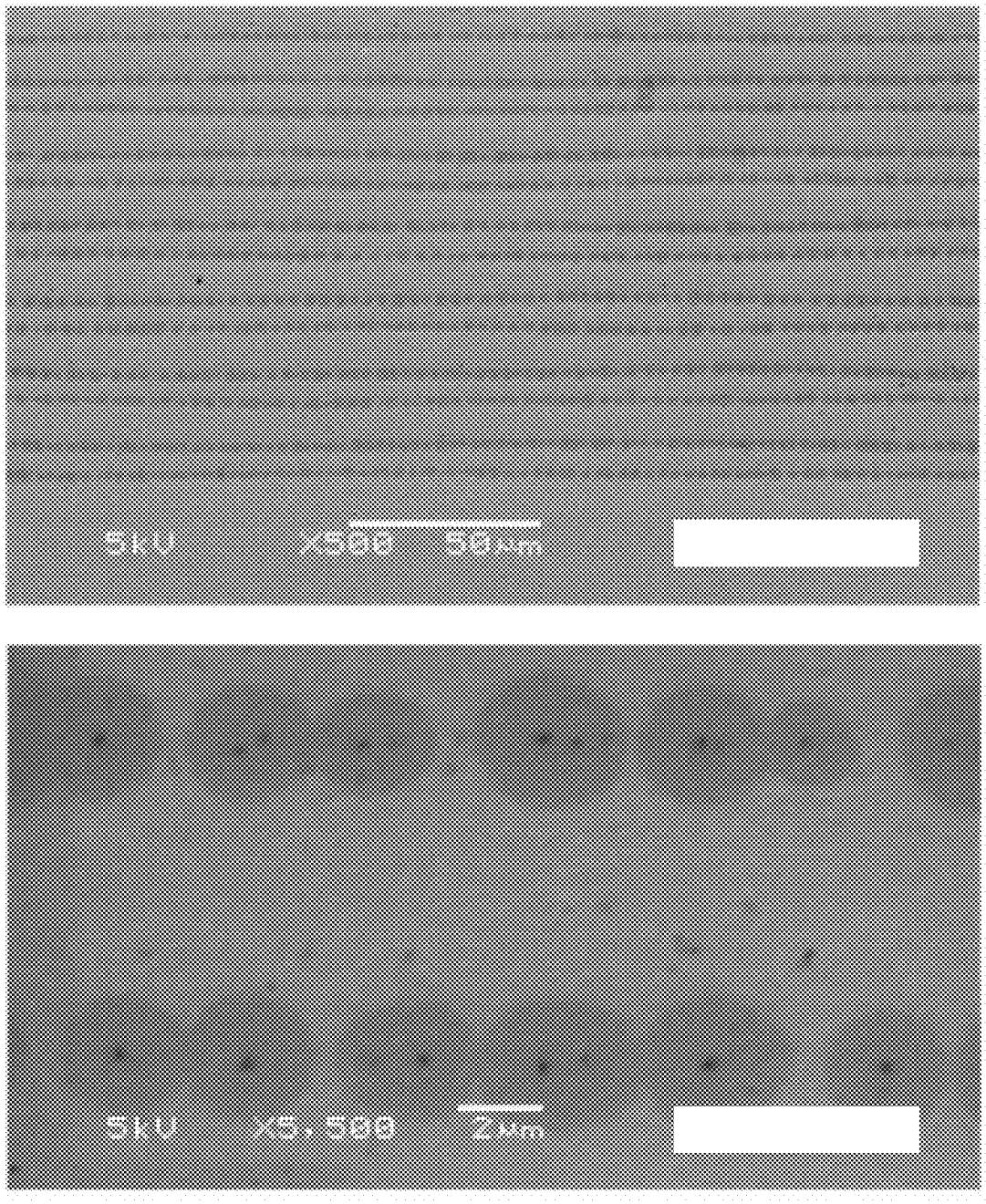
FIG. 26: SEM images of printed lines using NOA 73 (Photocurable Polyurethane Polymer) at 10 kHz printing frequency using a 2 μm ID capillary nozzle. The zoomed-in detail in the bottom panel shows the spreading of the droplets after printing.

Further, pulsed E-jetting shows tremendous potential for establishing printing speeds well into several kHz that will transform this technology into a viable nano-manufacturing process. FIG. 25 illustrates an image printed at 1 kHz with droplet sizes ranging from 1-2 μm. Printed lines can be laid down on a substrate in the many kHz range. For example, a printing speed of about 10 kHz is shown in FIG. 26. The printing consistency for the pulsed voltage mode is robust, having a diameter standard deviation of 0.53 μm and spacing standard deviation of 0.86 μm. Under constant voltage printing conditions, the diameter standard deviation is 1.31 μm and the spacing standard deviation is 2.10 μm.

7. Drop on Demand Printing: 7.1. Current Detection: Monitoring the E-jet process optically becomes very challenging especially with printing at single micron resolutions and speeds approaching 1000 droplets per second. Therefore, a scheme based on current monitoring is developed for the process. Essentially, the E-jet process involves combined mass and charge transfer between the nozzle and substrate, i.e., each droplet released from the nozzle carries a net positive or negative charge [3], depending on the direction of the applied field. With the release of each charged droplet from the nozzle, a small current is drawn to neutralize the resulting charge imbalance in the fluid at the meniscus. By detecting this current, the time of droplet release can be determined. This measurement scheme is termed nozzle-side measurement. An alternate scheme measures the current dissipated through the substrate to ground when a charged droplet from the nozzle arrives at a conductive substrate. This current can be measured by introducing a current sensor in the substrate-ground connection. This measurement scheme is termed substrate-side measurement. FIG. 4 shows a schematic of substrate-side current measurement setup. The high voltage source is connected to the nozzle side, while a current sensor is connected to the substrate side. The free end of the current sensor drains to ground. While both schemes work well for process monitoring, in this example we use the substrate-side configuration.

The frequency of jetting can be determined by measuring the time elapsed between two successive jets. Each peak in the current signal corresponds to a single jet. This is illustrated in FIG. 5. For the resolution range (<5 μm) in which we operate, the typical measured current associated with each droplet is found to be in the range of 10 to 100 nA. Thus, the jet current detection capability, while not necessary for pulsed mode E-jetting, is useful for determining the number of droplets released per pulse. This information can then be used for establishing voltage pulse modulation parameters described in Sections 3 and 4.

Figure 27:
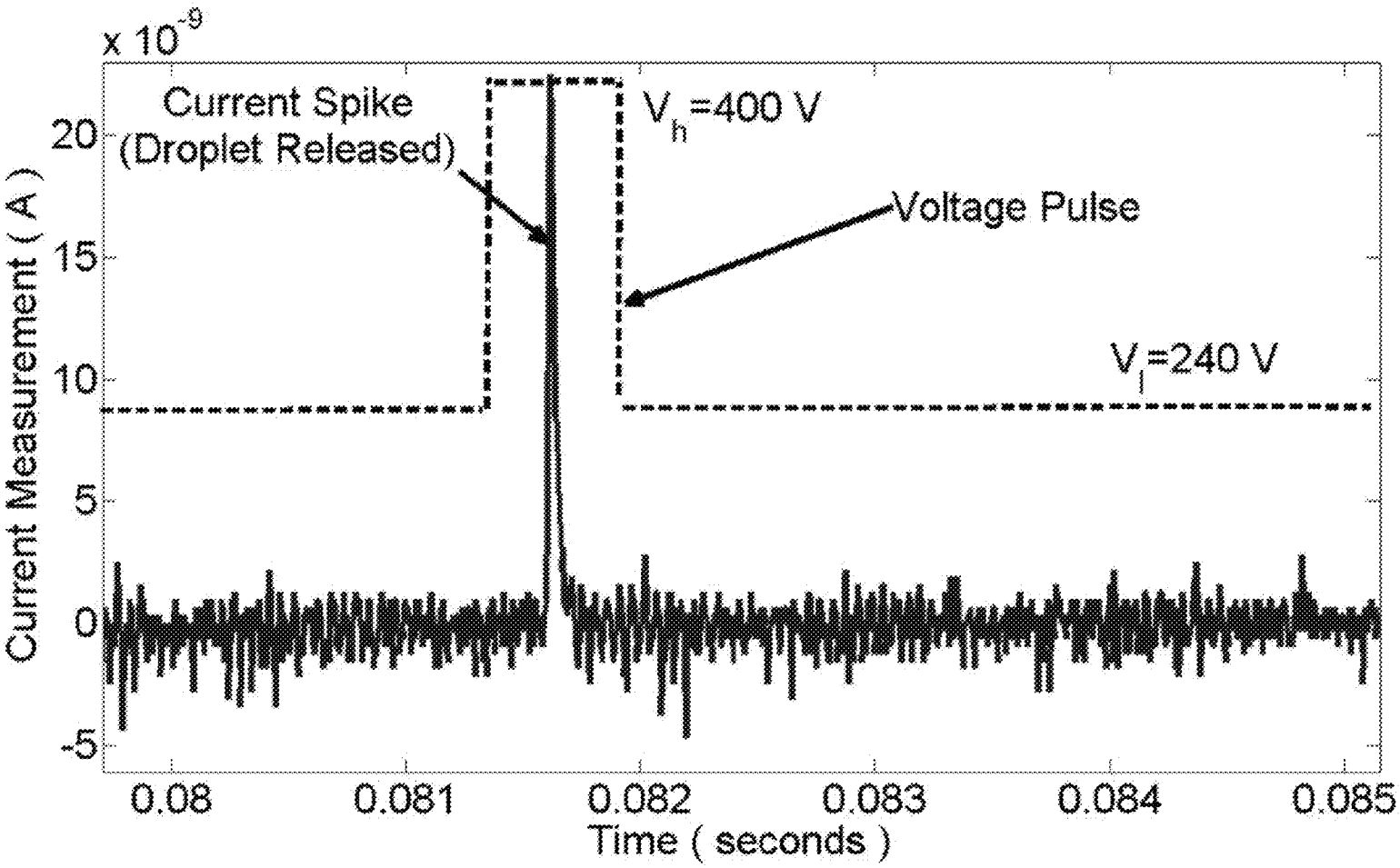
FIG. 27: Plot of current measurement showing a voltage pulse and the corresponding peak of a single droplet.

7.2. Printing Results: We demonstrate additional capabilities of the high-speed pulsed E-jet printing regime through the following. FIG. 27 shows a time-plot of current measurement on the substrate side superimposed on a time plot of the voltage pulse. The ink is a 10 mM aqueous phosphate buffer solution with 10% (by vol.) glycerol. We observe release of a single droplet from the micro capillary within the pulse time. This capability directly translates into a drop-on-demand regime for E-jet, which will substantially enhance the applicability of E-jet for printing bio-sensors, among other applications.

Figure 28:
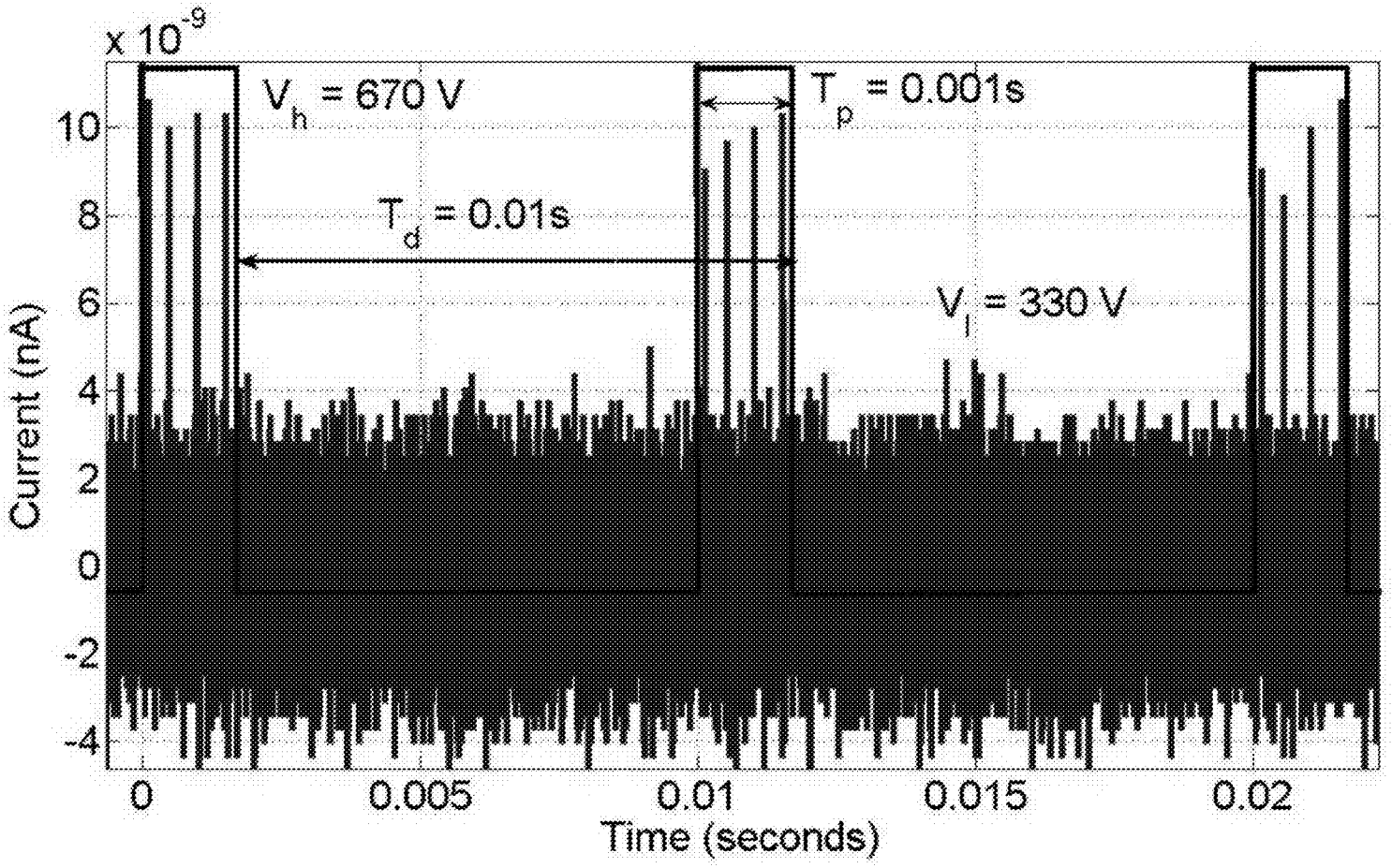
FIG. 28: Plot of current measurement showing a voltage pulse train with multiple droplets released per pulse.

FIG. 28 shows the measured current plot for a train of voltage pulses and the corresponding droplet ejections. Multiple droplets (in this case, four) are ejected within each pulse period. By changing the pulse time ($T_p$), the number of droplets ejected per pulse is controlled.

Figure 29:
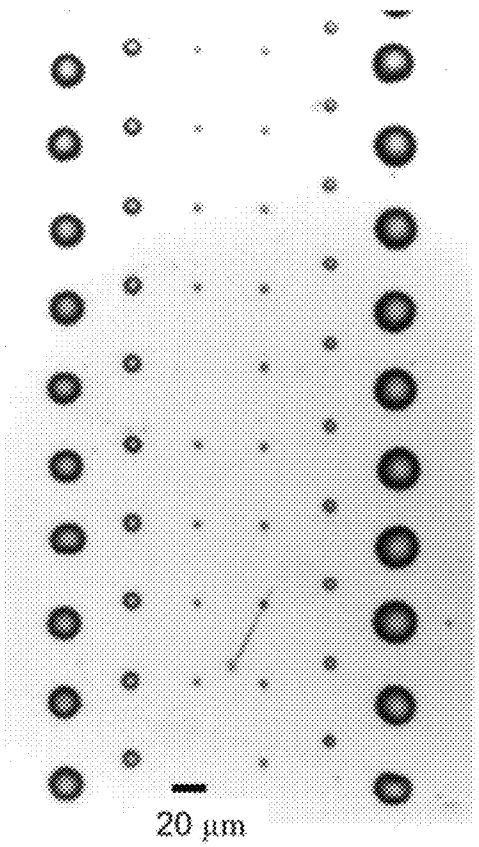
FIG. 29: Plot of droplet diameter on the surface (D) against pulse width $T_p$. The predicted slope of 0.33 is plotted as a dashed line. We see good correlation between the prediction and the measurement values.
Figure 29:
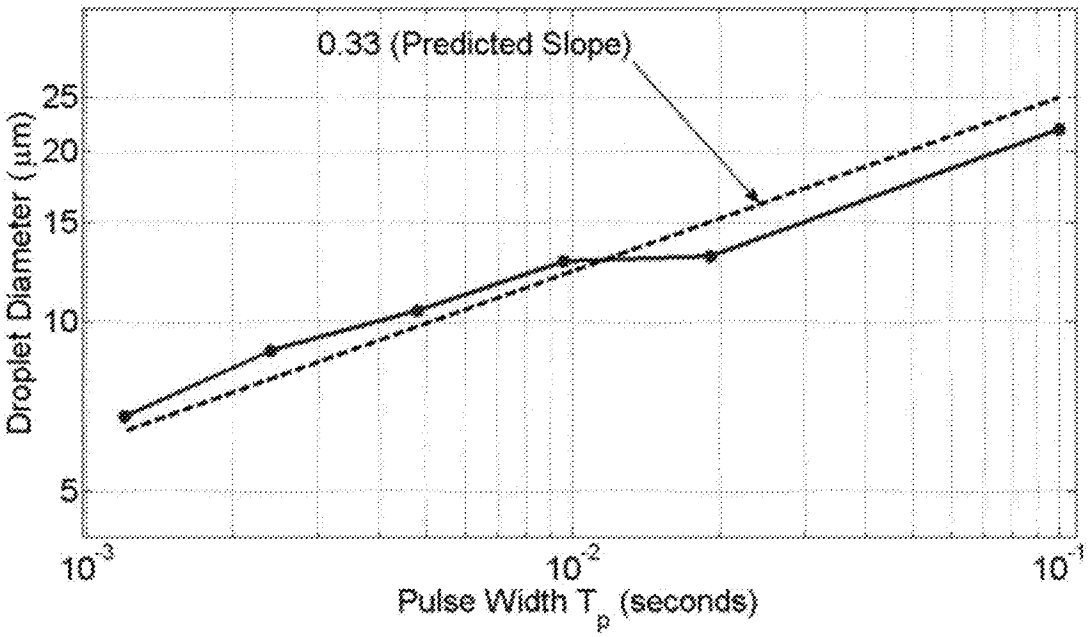

Through varying pulse time, multiple droplets can jet within the pulse width and coalesce to create different droplet sizes. FIG. 29 shows a plot of varying pulse width ($T_p$) against droplet diameter (D) on the substrate. The ink was a UV curable polyurethane ink, jetting was accomplished through using a micro capillary nozzle of inner diameter (ID) 5 μm. The droplet diameter varied from 6 μm to 22 μm based on the duration of the pulse width.

The pulsed mode operation of the E-jet process enables on-the-fly droplet diameter change. This is illustrated in FIG. 30. The droplet diameter is varied during printing by changing the pulse width, thereby generating denser and less dense printed areas without the need for changing nozzle tips, readjustment of voltage or change in deposition frequency. We therefore independently control droplet diameter and droplet spacing, as mentioned in Section 3.

This independent control of droplet spacing and droplet diameter can be exploited to create patterns with varying density of droplets or varying droplet size that can be adjusted on the fly. FIG. 30 demonstrates this capability in a printed pattern using NOA 73 from a 5 μm micro capillary. The droplet size is varied by changing the pulse width ($T_p$) from 500 μs to 2500 μs. The resulting average droplet size is found to be 3.9 μm and 8.1 μm respectively for the two cases, with standard deviations of 0.4 μm and 0.3 μm (with 16 random droplet diameter measurements). The droplet spacing (16 μm) is unaffected by changes in droplet size.

8. Conclusions: E-jet printing technology has shown tremendous potential for applications in printed electronics, biotechnology, and microelectromechanical devices. Printing speed and droplet size control present the biggest challenge for jet printing techniques. In order to address these issues simultaneously, a high-speed high-precision E-jet printing technique is developed. By using a pulsed DC voltage signal to produce E-jetting, precise droplet placement and droplet spacing is obtained at very fast printing speeds. The printing times were cut down by three orders of magnitude, while delivering specified droplet deposition rates and feature sizes. Further, the disclosed methods also demonstrate drop-on-demand capability, as well as on-the-fly droplet feature size and droplet volume control.

References for Example 2

[1] Park J-U, Hardy M, Kang S J, Barton K, Adair K, Mukhopadhyay D, Lee C Y, Strano M S, Alleyne A G, Georgiadis J G, Ferreira P M, and Rogers J A, 2007, Nature Materials, 6, 782-789.

[2] Lee D-Y, Lee J C, Shin Y-S, Park S-E, Yu T-U, Kim Y-J, Hwang J, 2008, Journal of Physics, 142 (1), 012039.

[3] Park J-U, Lee S, Unarunotai S, Sun Y, Dunham S, Song T, Ferreira P M, Alleyne A G, Paik U, and Rogers J A, 2010, Nano Letters, 584-591.

[4] Park J-U, Lee J H, Paik U, Lu Y, and Rogers J A, 2008, Nano Letters 8(12), 4210-4216.

[5] http://technologyreview.com/computing/19373/page1/.

[6] Jaworek A and Krupa A, 1996, Journal of Aerosol Science, 27, 979-986.

[7] Juraschek R and Rollgen F W, 1998, International Journal of Mass Spectrometry, 177 (1), 1-15.

[8] Choi H K, Park J-U, Park O O, Ferreira P M, Georgiadis J G, and Rogers J A, 2008, Applied Physics Letters, 92, 123109.

[9] Chen C H, Saville D A, and Aksay I A, 2006, Applied Physics Letters, 89, 124103(1)-(3).

[10] Kim Y-J, Kim S-Y, Lee J-S, Hwang J, and Kim Y-J, 2009, Journal of Micromechanics and Microengineering 19, 107001-8.

[11] Nguyen V D, Byun D, 2009, Applied Physics Letters, 94, 173509(1)-(3).

[12] Kim J, Oh H, and Kim S-S, 2008, Journal of Aerosol Science, 39 (9), 819-825.

[13] Stachewicz U, Yurteri C U, Marijnissen J C M, and Dijksman J F, 2009, Applied Physics Letters, 95(22), 224105.

[14] Stachewicz U, Dijksman J F, Burdinski D, Yurteri C U, and Marijnissen J C M, 2009, Langmuir, 25 (4), 2540-2549.

[15] Cloupeau M and Prunet-Foch B, 1994, Journal of Aerosol Science, 25, 1021-1036.

[16] Taylor G, 1969, Proc. of the Royal Soc. of London. Series A, Mathematical and Physical Sciences, 313, 453-475.

Example 3

Desktop E-Jet Printing System

This example discusses the design and integration of a desktop system for electrohydrodynamic jet (E-jet) printing (see also: Barton et al. "A desktop electrohydrodynamic jet printing system." Mechatronics 20(5), August 2010, Pages 611-616). E-jet printing is a micro/nano-manufacturing process that uses an electric field to induce fluid jet printing through micro/nano-scale nozzles. This provides better control and resolution than traditional jet-printing processes. The printing process is predominantly controlled by changing the voltage potential between the nozzle and the substrate. The push to drive E-jet printing towards a viable micro/nanomanufacturing process has led to the design of a compact, cost effective, and user friendly desktop E-jet printing system. Exemplary hardware and software components of the desktop system are described in the example. Experimental results are presented to further characterize the performance of the system.

As the demand for micro- and nano-scale devices in electronics, biotechnology and microelectromechanical systems has increased, efforts have been made to adapt current graphic art printing techniques to address this need. Conventional methods for graphic art printing such as inkjet printing include applying heat to induce a vapor bubble to form and eject a droplet of ink through a nozzle, and piezoelectric printers which squeeze a glass tube to eject ink [1]. The minimum printing resolution that can be created reliably for these methods ranges from 20-30 μm. This course resolution is due to a combination of nozzle sizes and droplet placement. Smaller nozzle sizes may become clogged due to the ink viscosity, while the vibrations caused by the piezoelectric actuators often lead to variations in the droplet placement [11]. These traditional graphic art approaches cannot be used for high-resolution manufacturing due to size and accuracy limitations.

Electrohydrodynamic jet (E-jet) printing is a technique that uses electric fields to create fluid flow necessary to deliver ink to a substrate for high-resolution (<10 μm) patterning applications [8]. E-jet has been gaining momentum in the past few years as a viable printing technique, especially in the micro- and nano-scale range [4,15,14]. As the advantages of E-jet printing become more apparent (e.g. the potential for purely additive operations, the ability to directly pattern biological materials for biosensors, drop-on demand functionality for chemical mixing and sensor fabrication, and high-resolution printing for printed electronics), the necessity for compact, affordable, and user friendly E-jet printing systems increases.

The drive to miniaturize production systems is not a new concept. Efforts to conserve space and energy, while reducing investment and operation costs, have led to a new approach to designing and building manufacturing systems [6]. Those systems aim to provide low cost, compact, and accessible alternatives to the large, expensive, and user intensive systems that are generally available. For example, Dimatix is a low cost (<$75,000), commercially available inkjet printing system which is capable of printing multiple inks with a droplet resolution of approximately 40 μm. Following this minimization approach, we designed and built a low cost, compact system for high-resolution printing. Previous work demonstrated high-resolution E-jet printing [8] using expensive custom-built equipment. This example presents a desktop system for E-jet printing, designed from commercial off the shelf technology (COTS) components, competitive in terms of cost with many of the commercially-available printers but capable of much higher resolutions. The system has the necessary hardware and software for standard E-jet printing. More specifically, this example will focus on (1) the design and fabrication of a micro/nano-manufacturing testbed for E-jet printing, and (2) the development of an integrated user interface to provide manual and automated printing. The remainder of this example is organized as follows. Section 2 provides a description of the E-jet process. Sections 3 and 4 introduce the hardware and software components of the desktop E-jet system. Experimental results validating the performance capabilities of the E-jet printer are given in Section 5. Section 6 provides concluding remarks.

2. Electrohydrodynamic jet printing: Current trends in the fields of electronics, bioengineering and microelectromechanical systems are leading to increased demands for high-resolution manufacturing capabilities. E-jet printing uses electric field induced fluid flows through microcapillary nozzles to create devices in the micro/nano-scale range [8]. E-jet printing is described in U.S. Pat. No. 5,838,349 by D. H. Choi and I. R. Smith. The printer and printing process detailed in that patent were designed to dispense different colored ink droplets into uniform patterns on a substrate. While these methods easily surpassed the 2-D printing capabilities of ink jet printers at that time, droplet resolution, ink variations, and potential applications for E-jet printing were not fully addressed. PCT Pub. No. WO2009/011709 relates to high-resolution E-jet printing for manufacturing systems. The research detailed in that patent application focused on using the E-jet process to print high-resolution patterns or functional devices (e.g. electrical or biological sensors) in the sub-micron range. The patterning of wide ranging classes of inks in diverse geometries, as well as printed examples of functional circuits and sensors demonstrating the diverse applications of E-jet printing are provided in [8]. In addition to a wide ranging class of liquids, this process has been used to deposit suspensions containing particulates such as zirconia, DNA, and silver nanoparticles as demonstrated in Wang et al. [13]; Park et al. [7]; Lee et al. [5]. Along with the ability to print electrical and biological sensors, these suspensions can be used to fabricate 3D structures without supporting material as demonstrated in [10].

FIG. 2 presents a schematic of the E-jet printing process, as discussed and FIG. 3 illustrates the change in the apex of the ink meniscus due to an increase in voltage. The pinching off of the fluid from the apex of the cone results in droplets that are typically smaller than the nozzle (micro-pipette) diameter. Initial implementation of this process was performed on a custom built air bearing positioning testbed. This system was designed as a research platform, which subsequently resulted in a large, expensive, and modular system that is suitable for experimental studies but not for use as a printing tool.

In an effort to package and simplify the process and make E-jet printing more accessible to researchers working on potential printing applications in micro/nano-manufacturing, a desktop printing system has been developed. Details describing the exemplary hardware for this system are provided in the following section.

3. Hardware for e-jet printing system: From the previous section, hardware components for the desktop E-jet system include: the positioning elements, the pressure and vacuum pumps, the visualization system, the toolbit and substrate mounts, the electrical connections for generating the required voltage potential, and the housing elements. The various components are identified in FIG. 31.

Figure 31:
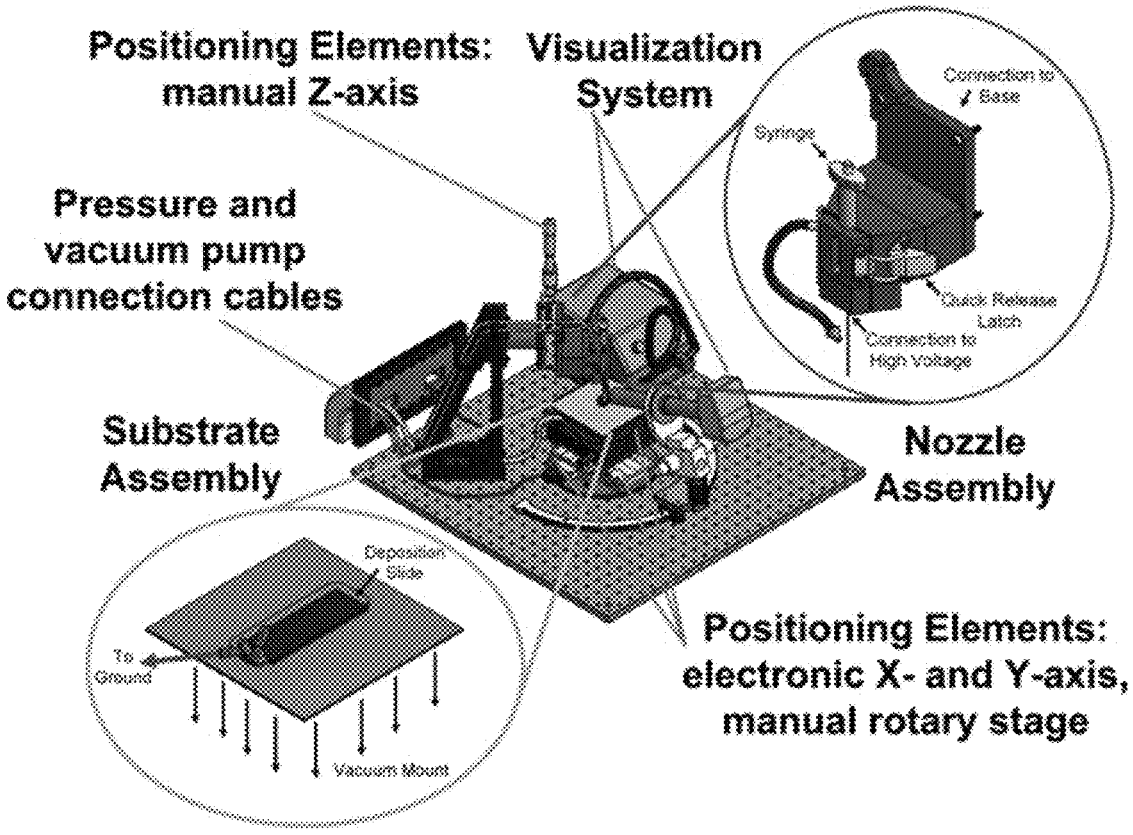
FIG. 31: Desktop E-jet system with specific hardware requirements identified. Note that the major positioning and jetting components for the desktop E-jet system are sized to fit a typical lab desktop

As can be seen from FIG. 31, the positioning system includes x- and y-axis electronic positioning stages, a manual z-axis, and a manual rotary axis. Manual z and rotary axes are used to minimize costs, but are optionally also electronic positioning stages, as desired. Alternatively, the system does not require z- or rotary axis, as the methods described herein are capable of obtaining and/or maintaining desired printing conditions without compensating for changes in stand-off height, even for significant variation up to 100%. Back pressure and voltage potential compensate for any height irregularities using the relationship provided in Eq. (1) of Example 1. The pressure pump applies back pressure to the syringe, while the vacuum pump is used to attach the substrate to the substrate mount. The visualization system includes a high-resolution camera and magnification lens mounted to a 180° rotary track, as well as a fiber optic light with adjustable arms. The housing is made up of a breadboard and glass enclosure. All of the items described thus are available as off-the-shelf components from various vendors. Table 5 is a summary of the components, along with the vendor and any relevant information.

Figure 32:
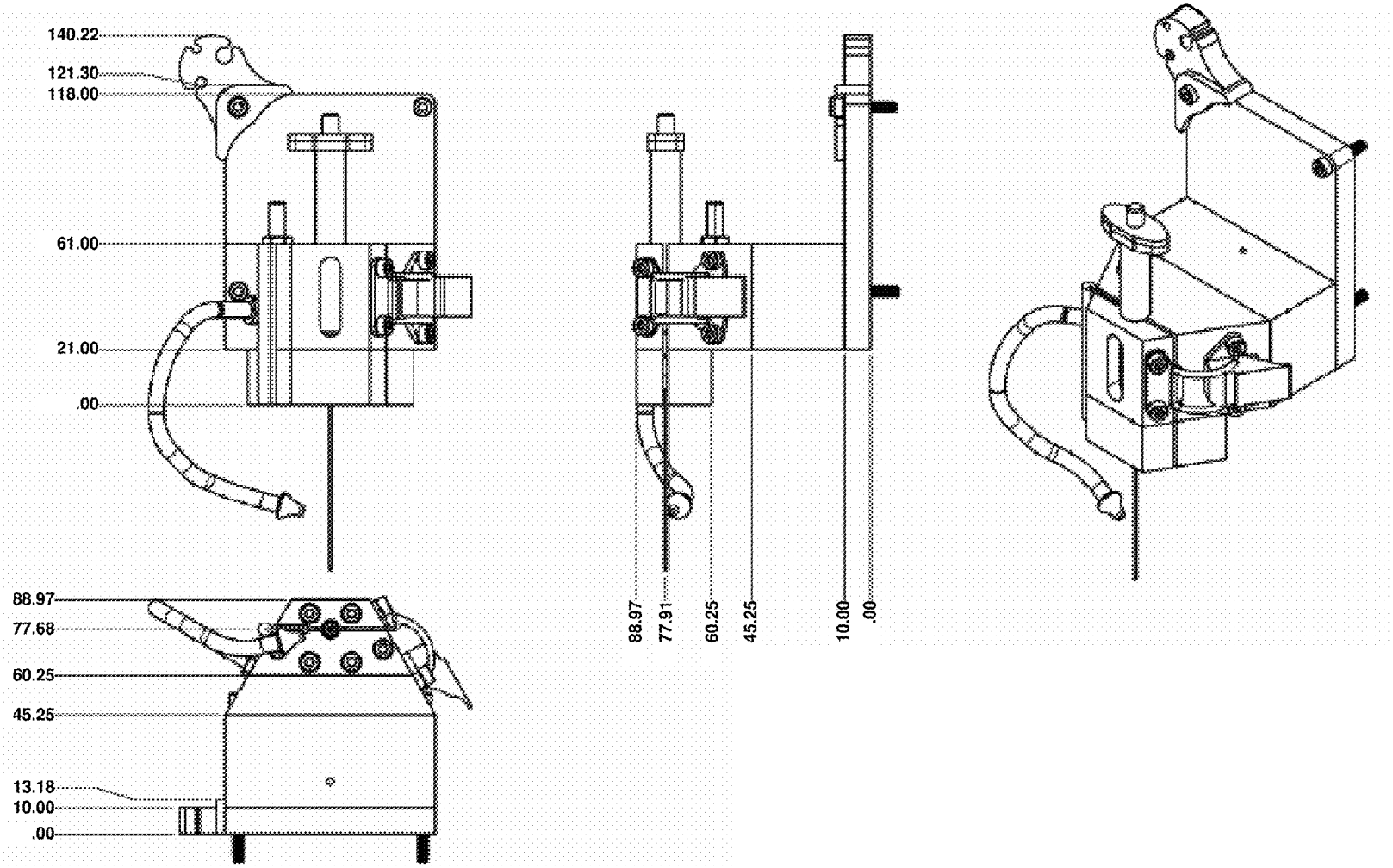
FIG. 32: Nozzle mount for the E-jet process. Note the electrical connection used to apply a high-voltage signal to the treated micro-pipette.
Figure 33:
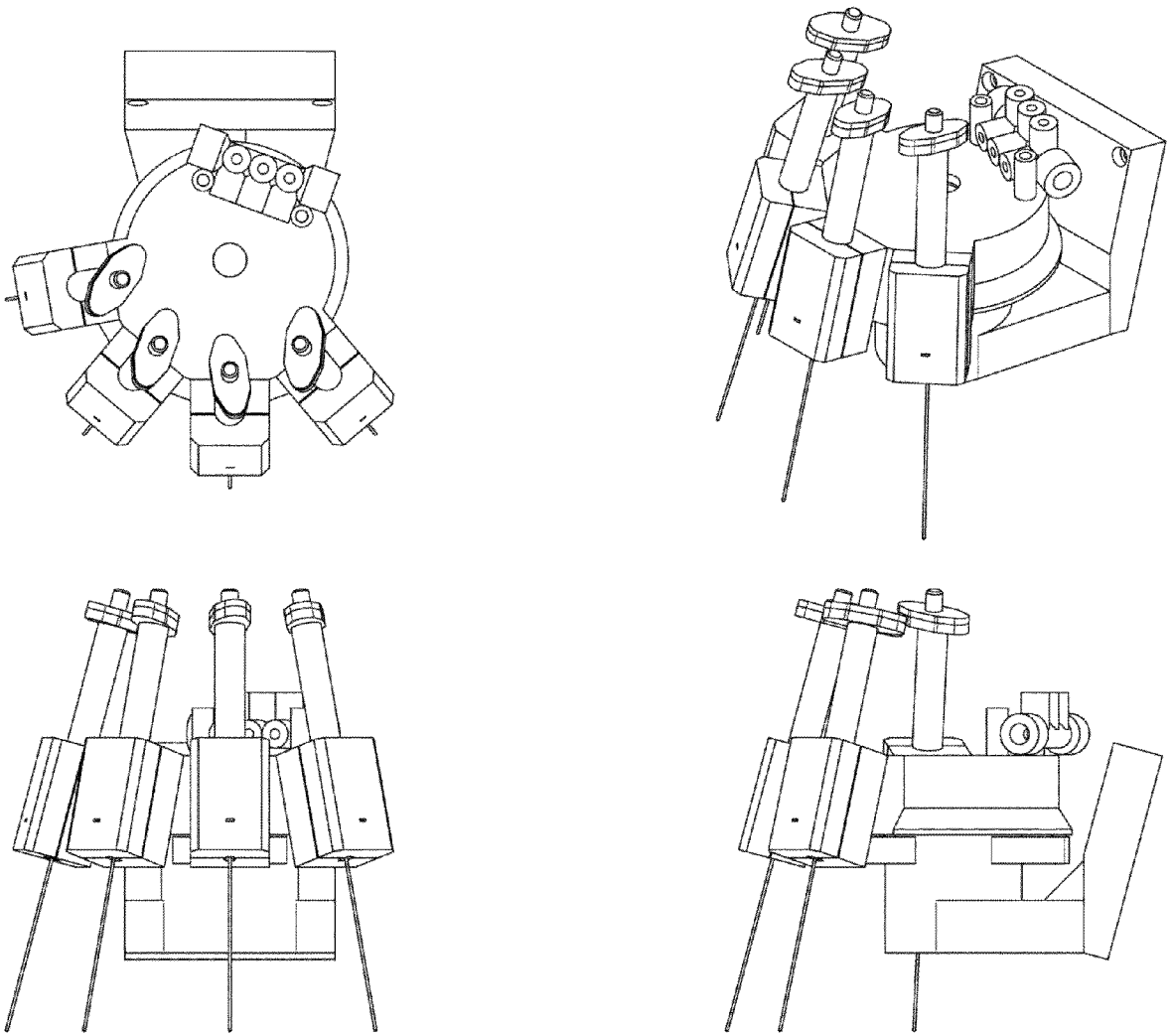
FIG. 33: Multi-nozzle rotable mount for the E-jet process. The design is an extension of the single nozzle mount with integrated high-voltage electrical connections in each individual nozzle holder. Four different views are provided.

The remaining hardware includes components that are specific to the E-jet printing process. The toolbit and substrate mounts and the electrical connections residing within these components are important to the E-jet process and are custom designs. FIG. 32 illustrates one of the toolbit mounts. This mount is designed for single nozzle deposition. An off-the-shelf syringe containing the deposition ink is connected to the pressure pump and a Luer lock micro-pipette ranging in tip size from 100 nm to 10 μm. The micro-pipette (nozzle) is sputter coated with metal prior to assembly to ensure an electrical connection along the length of the nozzle [9]. Additionally, the pipette tip is treated with a hydrophobic coating to minimize wicking of the ink along the nozzle. The conductive base of the pipette makes an electrical connection with the mount using built-in contact pins. In addition to the single nozzle mount in FIG. 32, a multi-nozzle toolbit is designed (FIG. 33). This toolbit facilitates multiple inks (printable fluids) to be used on a single part by manually rotating the nozzle mount. Alternatively, the rotation may be electronically controlled.

Figure 34:
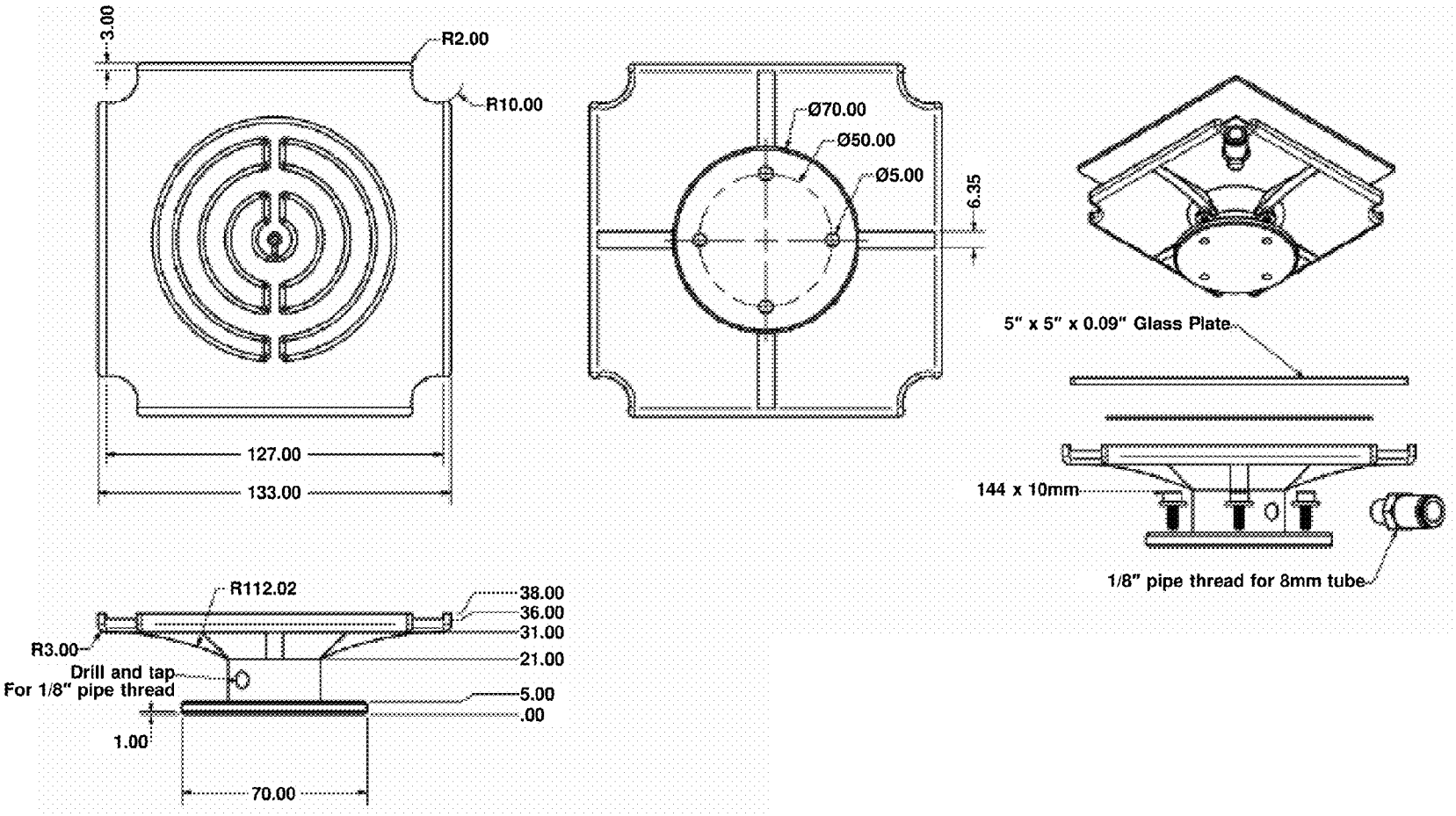
FIG. 34: Substrate mount for the E-jet process. Note the electrical connection to ground on the treated substrate. This is used to create a voltage potential between the treated substrate and nozzle.

The substrate mount shown in FIG. 34 contains a raised section designed for a generic glass slide. The slide, which has been sputtered with a metal coating for conductivity, is seated in a cutout within the raised section and held in place by a vacuum chuck. The electrical connection is maintained through contact between the conductive slide and a metal clip held in place by a plastic fly screw (FIG. 34).

The hardware components for E-jet printing make up half of the working system. In order to print, specific software requirements must be met. These are described in the following section.

4. System interfacing: The interfacing of the desktop system through LabVIEW® is designed to integrate the two major subsystems: (a) the positioning system (linear motors and the motor drivers) and (b) the electrical system (high voltage amplifier). LabVIEW was chosen for software interfacing due to its easy to use front end graphical interface and the accessibility and modular capabilities of its back end platform. There are two modes of operation for the software. In manual mode, the user has control over position and voltage signals. This mode is used to test the E-jet process for determining suitable voltages for consistent jetting conditions. In the automated operation mode, a set of pre-programmed commands can be loaded and executed sequentially to generate a specific pattern on the substrate through coordination of the voltage and position commands. The voltage commands, however, can be over-written by the user while in the automated operation mode.

Figure 35:
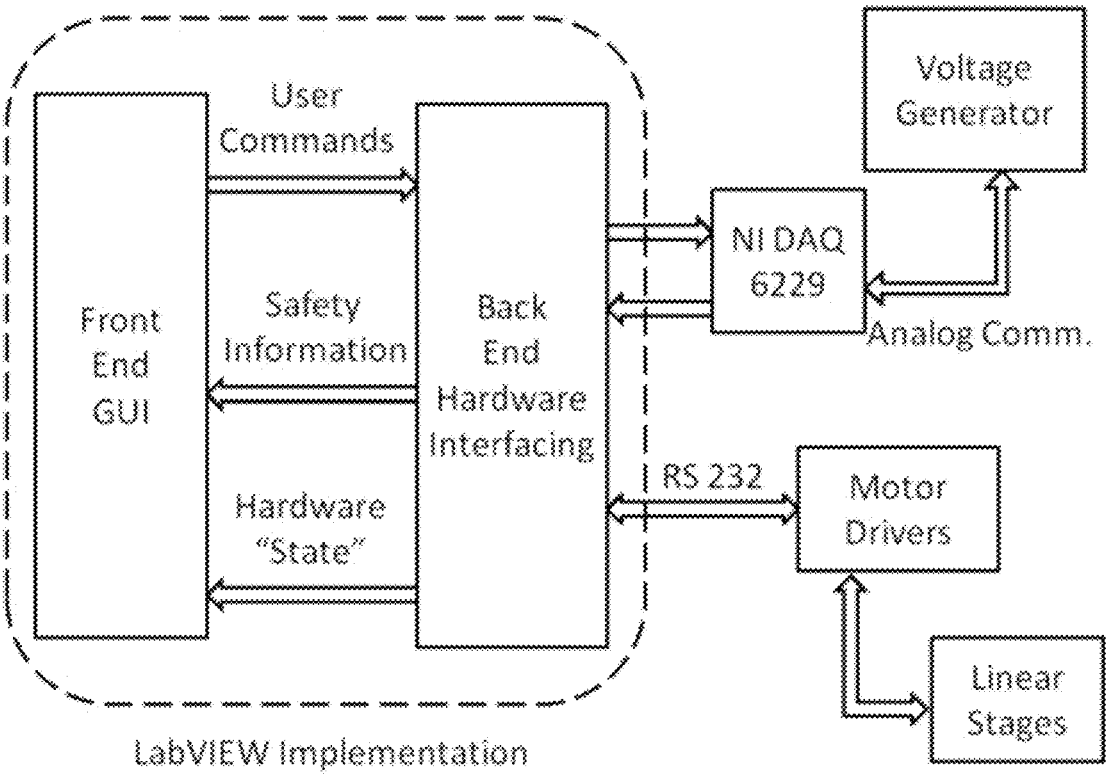
FIG. 35: Desktop E-jet system software-hardware interface.

FIG. 35 shows a schematic of the software-hardware interfacing. The voltage amplifier is controlled and monitored through analog communication via an NI-6229 DAQ board. On the other hand, the motor drivers are controlled over a serial port (RS 232) communication link. The front end GUI enables the user to monitor safety signals and send control signals for operation over these communication links.

Since the fidelity of the E-jet process relies heavily on the coordination of the two subsystems, the primary functionalities of the software system interface are:

I. The front end graphic user interface (GUI): Provides the user with an interactive panel for control of the hardware components in terms of the position of the XY axes and the voltage potential between the nozzle tip and the substrate. In manual operation mode, these are controlled by the user. In automated operation mode, the user loads up a series of commands that are executed sequentially to deposit a prescribed pattern on the substrate by coordination of the voltage on-off and positioning of the XY stages. The GUI also enables the user to visualize current position and printing on a virtual work-plate.

II. The back-end hardware interface of the software: Aims at monitoring, controlling, and coordinating the hardware components of the E-jet system. The encoder position readings, motor faults, voltage output monitor, and voltage overload readings are monitored over a fixed time-interval repeating loop. In the automated operation mode, the software simultaneously controls and coordinates voltage and position commands to generate jetting of droplets at specific locations on the substrate.

Figure 36:
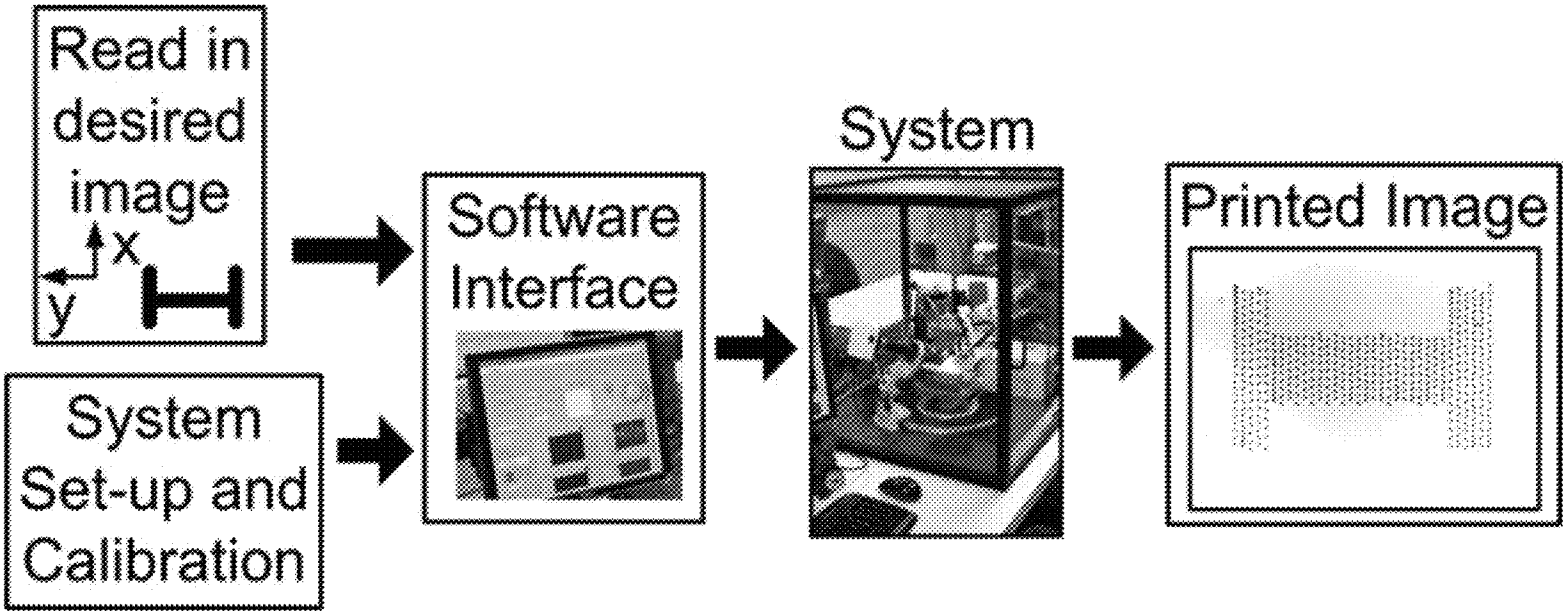
FIG. 36: Process diagram of the E-jet printing system

5. Experimental results: In order to validate the performance capabilities of the desktop E-jet printing system described herein, a sample image is drawn using the process diagrammed in FIG. 36.

Figure 37:
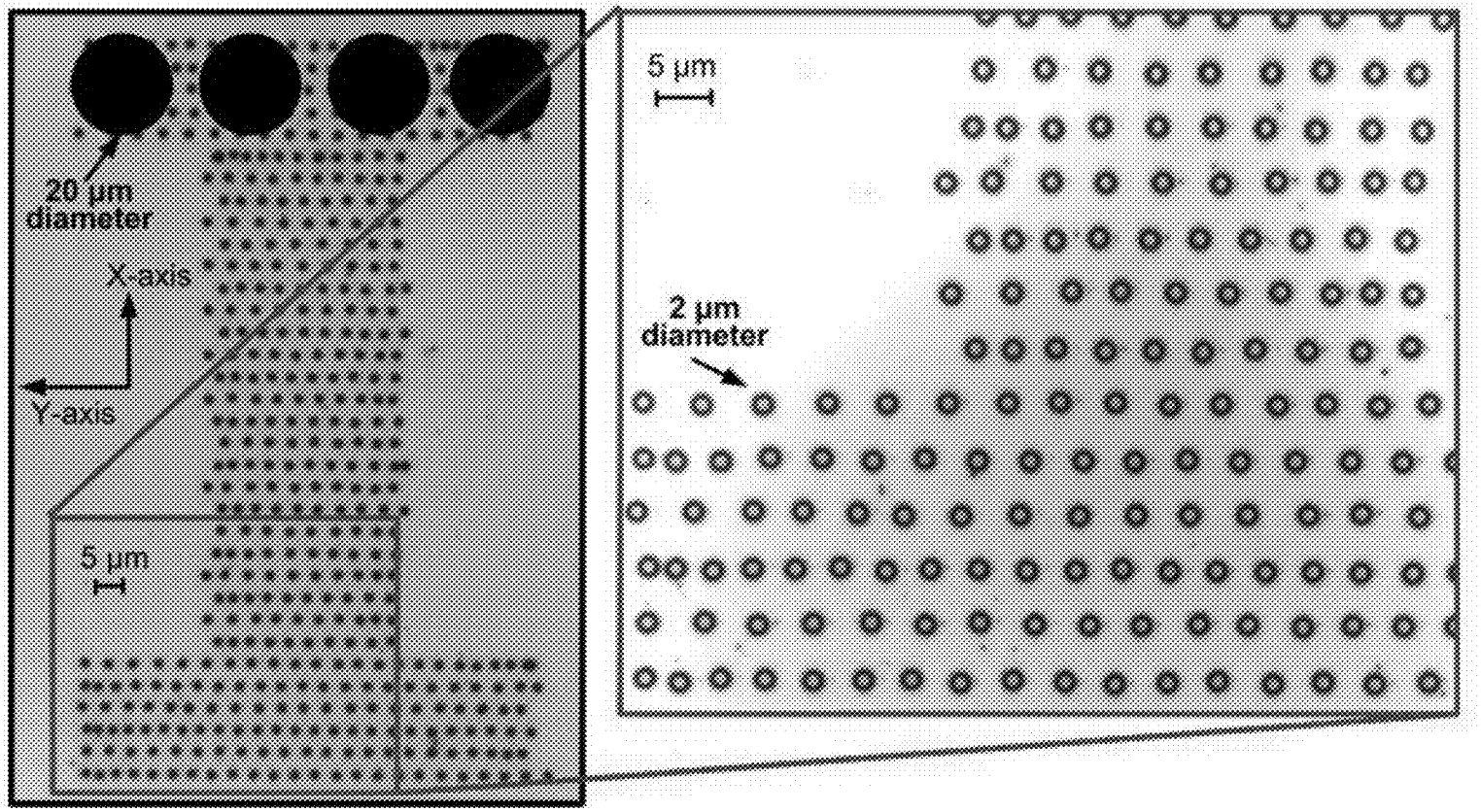
FIG. 37: Block "I" printed using the desktop E-jet system. Image was printed from a nozzle diameter of 5 μm resulting in printed droplets with an average measured diameter of 2.8 μm. Typical ink jet droplets with a 20 μm diameter are superimposed on the printed image for comparison purposes.

Operating from the manual mode on the GUI, an initial calibration is performed to determine suitable XY position, z-axis offset height, back pressure and voltage input for a desired jetting frequency. Switching over to the automated mode, a series of position and voltage commands are uploaded into the GUI. Using the experimental values listed in Table 6, sequential implementation of the uploaded commands resulted in a block 'I' image shown in FIG. 37.

Using a 5 μm nozzle tip (micro-pipette), the desktop system printed droplets with an average measured diameter of 2.8 μm. The droplet size correlates to several process variables including: nozzle tip, ink viscosity, offset height, back pressure, and applied voltage potential between the conducting nozzle tip and substrate [3,12,2]. Changes in these conditions will result in variations in the droplet diameter and jetting frequency. For the exemplified system, the process variables are shown to be consistent over a printing area of 5 mm×5 mm, thereby indicating minimal built-in tilt offset with the printer. The block 'I' is printed by rastering back and forth along the y-axis with a fixed jetting voltage determined during the initial calibration. By applying a constant DC voltage, the natural pulsating jet mode of the meniscus results in slight discrepancies in droplet placement. Control techniques which address high-resolution droplet size and placement requirements are (see, e.g., Examples 1 and 2) are optionally included. For droplet size comparison, droplets representing a typical ink jet printing resolution of approximately 20 μm are superimposed on the E-jet printed image in FIG. 37. These results clearly indicate the ability of E-jet printing to surpass the printing resolution of typical ink jet printers.

6. Conclusion and future work: The availability of compact, affordable, and user friendly test platforms for micro/nano-manufacturing processes is a critical part for the transition of these processes into mainstream manufacturing systems. The major challenge is providing affordable test platforms for researchers to further develop the process and associated applications. E-jet printing is an emerging manufacturing technology that has potential in widespread applications. This example is directed to a small and affordable desktop system for E-jet printing.

In order to simplify the experimental setup, novel toolbit and substrate mounts with built-in electrical connections were designed and fabricated. A two part GUI enables manual and automated printing modes. Experimental results verified the printing capabilities of the desktop E-jet system.

References for Example 3

[1] Calvert P. Inkjet printing for materials and devices. Chem Mater 2001; 13(10):3299-305.

[2] Chen C H, Saville D A, Aksay I A. Scaling laws for pulsed electrohydrodynamic drop formation. Appl Phys Lett 2006; 89(12):124103(1)-3(3).

[3] Choi H K, Park J U, Park O O, Ferreira P M, Georgiadis J G, Rogers J A. Scaling laws for jet pulsations associated with high-resolution electrohydrodynamic printing. Appl Phys Lett 2008; 92(12):123109. doi:10.1063/1.2903700. <http://link.aip.org/link/?APL/92/123109/1>.

[4] Jayasinghe S, Qureshi Q, Eagles P. Electrohydrodynamic jet processing: an advanced electric-field-driven jetting phenomenon for processing living cells. Small 2006; 2:216-9.

[5] Lee D, Shin Y, Park S, Yu T, Hwang J. Electrohydrodynamic printing of silver nanoparticles by using focused nanocolloid jet. Appl Phys Lett 2007; 90:0819051-53.

[6] Okazaki Y, Mishima N, Ashida K. Microfactory—concept, history, and developments. J Manuf Sci Eng 2004; 126:837-44.

[7] Park J, Lee J, Paik U, Lu Y, Rogers J. Nanoscale patterns of oligonucleotides formed by electrohydrodynamic jet printing with applications in biosensing and nanomaterials assembly. Nano Lett 2008; 8(12):4210-6.

[8] Park J U, Hardy M, Kang S J, Barton K, Adair K, Mukhopadhyay D, et al. High-resolution electrohydrodynamic jet printing. Nature Mater 2007; 6:782-9.

[9] Sigmund P. Mechanisms and theory of physical sputtering by particle impact. Nucl Instrum Methods Phys Res 1987; 27:1-20.

[10] Sullivan A, Jayasinghe S. Development of a direct three-dimensional biomicrofabrication concept based on electrospraying a custom made siloxane sol. Biomicrofluidics 2007; 1:0341031-03410310.

[11] Szczech J, Megaridis C, Gamota D, Zhang J. Fine-line conductor manufacturing using drop-on-demand pzt printing technology. IEEE Trans Electron Packag Manuf 2002; 25(1):26-33.

[12] Taylor G. Electrically driven jets. Proc Roy Soc Lond: Ser A, Math Phys Sci 1969; 313(1515):453-75.

[13] Wang D, Edirisinghe M, Jayasinghe S. Solid freeform fabrication of thin-walled ceramic structures using an electrohydrodynamic jet. J Am Ceram Soc 2006; 89(5):1727-9.

[14] Wang K, Paine M, Stark J. Fully voltage-controlled electrohydrodynamic jet printing of conductive silver tracks with a sub 100 μm linewidth. J Appl Phys 2009; 106:0249071-74.

[15] Youn D, Kim S, Yang Y, Lim S, Kim S, Ahn S, et al. Electrohydrodynamic micropatterning of silver ink using near-field electrohydrodynamic jet printing with tilted-outlet nozzle. Appl Phys A 2009; 96:933-8.

This application is related to PCT Pub. No. WO 2009/011709 (71-07WO) and corresponding U.S. National Stage application Ser. No. 12/669,287 filed Jan. 15, 2010, and priority U.S. application 60/950,679 (filed Jul. 19, 2007), each of which are hereby incorporated by reference in their entirety to the extent not inconsistent herewith.

All references cited throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

Every formulation or combination of components described or exemplified herein can be used to practice the invention, unless otherwise stated.

Whenever a range is given in the specification, for example, a resolution range, a precision range, a placement accuracy range, a statistical range, a temperature range, a size range, frequency range, field strength range, printing velocity range, a conductivity range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, materials, reagents, synthetic methods, purification methods, analytical methods, assay methods, and methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

Methods and devices useful for the present methods can include a large number of optional device elements and components including, additional substrate layers, surface layers, coatings, glass layers, ceramic layers, metal layers, microfluidic channels and elements, motors or drives, actuators such as rolled printers and flexographic printers, handle elements, temperature controllers, and/or temperature sensors.

TABLES

TABLE 1

Jetting operating parameters for process characterization

| PARAMETER | VALUE |
|---|---|
| Nozzle diameter | 5 μm |
| Substrate | Au coated on glass slide |
| Ink | 10% glycerol + 10 mM buffer solution |
| Back pressure | 1.6 psi |
| Standoff height | 30 μm |

TABLE 2

Jetting operating parameters for controller validation

| PARAMETER | VALUE |
|---|---|
| Nozzle diameter | 10 μm |
| Substrate | 3 Au strips on glass slide |
| Ink | 10% glycerol + 100 mM buffer solution |
| Back pressure | 0.1-0.2 psi |
| Printing time | 50 sec |
| Standoff height | 30 μm |

TABLE 3

Tabulated 2-norm and maximum error for open loop, feedforward only, and 2-DOF control laws.

| | Open Loop | Feedforward Control | 2 DOF Control |
|---|---|---|---|
| Error 2-norm (Hz) | 0.23 | 0.13 | 0.08 |
| Peak Error (Hz) | 0.31 | 0.26 | 0.18 |

TABLE 4

System Components

| Part | Manufacturer | Resolution |
|---|---|---|
| X, Y, Z stages | Aerotech | 0.01 μm |
| Infinity 3 Camera | Lumenera | 2 Mpixel |
| Zoom lens | EdmundOptics NT55-834 | 2.5x-10x |
| Illuminator | EdmundOptics NT55-718 | N/A |
| Voltage Amplifier | Trek 677B | 1 V |
| Current Detector | Femto NT59-178 | 1 nA |

TABLE 5

Purchased hardware components (Example 3)

| Part | Manufacturer | Part no. | Resolution |
|---|---|---|---|
| X, Y stages | Parker | MX80LT03MP | 0.1 μ |
| Z stage | Parker | MX80MT02MS | 1 μ |
| Rotary stage | Parker | M10000 | $6\frac{\text{arc}}{\text{min}}$ |
| Pump-vacuum | Cole-Parmer | EW-79610-02 | N/A |
| Pump-pressure | McMaster | 4176K11 | 1 psi |
| Infinity 2-2 | Lumenera | NT59-051 | 2 Mpixel |
| Zoom lens | EdmundOptics | NT55-834 | 2.5x-10x |
| Illuminator | EdmundOptics | NT55-718 | N/A |
| Breadboard | ThorLabs | MB6060/M | N/A |
| Enclosure | ThorLabs | TQ0004627-3 | N/A |

TABLE 6

Experimental setup

| Variable | Setup Value |
|---|---|
| Ink | Glycerol and $H_2O$ solution |
| Nozzle diameter | 5 μm |
| Pump-pressure | 0.25 psi |
| Image size | 1 mm × 1 mm |
| X position | −3.5 mm (absolute) |
| Y position | −0.5 mm (absolute) |
| Z position | 0.030 mm (offset height) |
| Feedrate | 0.39 mm/s |

TABLE 6-continued

Experimental setup

| Variable | Setup Value |
|---|---|
| Voltage input | 418 V |
| Printing time | 10 min |

We claim:

1. An electrohydrodynamic jet printing device comprising:

one or more printing nozzles configured to contain a printable fluid;

a substrate configured to receive ejected printable fluid from the one or more printing nozzles;

a current or voltage sensor electrically connected to the substrate for measuring output current or voltage during printing for real-time feedback and feedforward control;

a voltage or current generator operably connected to the one or more printing nozzles configured to establish an electric potential difference between the one or more printing nozzles and the substrate and controllably eject printable fluid from the nozzle onto the substrate;

a controller electrically connected to said sensor for controlling the voltage or current generator to maintain a desired printing condition based on the measured output current or voltage during printing by the current or voltage sensor for real-time feedback control and a process map for real-time feedforward control;

wherein the process map is generated by detecting current spikes during printing to determine jetting frequency for one or more process parameters; and wherein said device provides a print resolution that is selected from a range between 10 nm to 10 μm for a printing frequency selected from a range that is greater than 0 Hz and less than or equal to 100 kHz and a placement accuracy that is better than 500 nm.

2. The device of claim 1, that is a desktop printing device having a footprint less than or equal to 1 $m^2$.

3. The device of claim 1 wherein said print resolution and placement accuracy are maintained without varying a standoff distance between the nozzle and a substrate to which the nozzle prints.

4. An electrohydrodynamic jet printing device comprising:

a nozzle configured to contain a printable fluid;

a substrate configured to receive ejected printable fluid from the nozzle;

a sensing and control system comprising:

a current sensor electrically connected to the substrate configured to detect and quantify an output current during printing of the printable fluid from the nozzle tip to the substrate;

a controller configured to receive the quantified output current from the current sensor and generate a process parameter based on the quantified output current;

a power supply electrically connected to the controller to receive the process parameter and configured to apply a potential difference between the substrate and printable fluid in the nozzle for real time feedback control to maintain or achieve a desired printing condition based on the process parameter; and wherein the controller is configured to receive a process map, and the process map is generated by detecting current spikes during printing to determine jetting frequency for one or more process parameters.

5. The device of claim 4:

wherein the controller is configured to receive a process map is for feedforward and feedback control to provide a two-degree of freedom feedforward and feedback control of the process parameter provided to the power supply.

6. The device of claim 5, wherein the process map provides a relationship between the input process parameter selected from the group consisting of: voltage, current and standoff distance; and a printing condition selected from the group consisting of print frequency, print droplet volume, print speed, print resolution, and print precision.

7. The device of claim 4, wherein the controller is configured to provide the process parameter to the power supply in the form of a pulsed voltage or a pulsed current.

8. The device of claim 7, further comprising:

a positioning system connected to the substrate;

wherein the controller is configured to provide a process parameter to the positioning system for feedforward control by substrate tilt and the quantified output current from the current sensor provides feedback control to accommodate changes in local jetting conditions.

9. The device of claim 8, wherein the positioning system is configured to provide tilting and translation of the substrate relative to the nozzle.

10. The device of claim 4, wherein the nozzle has a nozzle tip and the power supply is in electrical contact with the nozzle tip.

11. The device of claim 4, wherein the power supply is in electrical contact with the substrate.

12. The device of claim 4, wherein the current sensor is connected to a substrate to provide substrate-side measurement of current.

13. The device of claim 4, wherein the controller is configured to provide a process parameter value to maintain a desired printing condition.

14. The device of claim 13, wherein the desired printing condition is print frequency or droplet size.

15. The device of claim 13, wherein the process parameter value is adjusted to maintain the desired printing condition.

16. The device of claim 4, further comprising:

a printable fluid chamber;

the nozzle having a nozzle tip fluidically connected to the printable fluid chamber;

the substrate having a substrate receiving surface opposed to and facing the nozzle tip for receiving printable fluid ejected from the nozzle tip;

the power supply electrically connected to the nozzle tip to apply a voltage potential between the nozzle tip and the substrate receiving surface.

17. The device of claim 16, wherein the current sensor, controller and power supply are configured for high speed printing, wherein the high speed printing is selected from a range that is greater than or equal to 300 μm/s and less than or equal to 10 mm/s.

18. The device of claim 16, wherein the nozzle and substrate are configured for high-resolution printing, wherein the high resolution printing has a resolution in the sub-micron range.

19. The device of claim 16, wherein the nozzle tip has a substantially circular ejection orifice with a diameter that is less than 20 μm.

20. The device of claim 16, wherein the electrohydrodynamic jet printing device compensates for changes in stand-off distance, substrate irregularities that change stand-off distance, substrate tilt, noise, or unwanted movement of the nozzle tip relative to the substrate, to maintain continuously good printing characteristics.

21. The device of claim 16 comprising multiple printable fluid chambers.

22. The device of claim 4, wherein the process parameter is continuously provided to the power supply and has a magnitude that is adjustable by the controller.

* * * * *

UNITED STATES PATENT AND TRADEMARK OFFICE

CERTIFICATE OF CORRECTION

PATENT NO. : 9,278,522 B2
APPLICATION NO. : 14/033765
DATED : March 8, 2016
INVENTOR(S) : Alleyne et al.

It is certified that error appears in the above-identified patent and that said Letters Patent is hereby corrected as shown below:

In the Claims
In claim 5, column 46, line 66, replace "wherein the controller is configured to receive a process" with --wherein the process--

Signed and Sealed this
Sixteenth Day of August, 2016

Michelle K. Lee

Michelle K. Lee
*Director of the United States Patent and Trademark Office*